US011154132B2

(12) United States Patent
Volin

(10) Patent No.: US 11,154,132 B2
(45) Date of Patent: Oct. 26, 2021

(54) FIVE-DEVICE-IN-ONE MULTI-FUNCTION MULTI-CONFIGURABLE HITCH-MOUNTABLE ROLLABLE ROTATABLE COLLAPSABLE TEA TABLE, CAPABLE OF FUNCTIONING AS A PET-KENNEL, A STORAGE LOCKER, A TABLE, A COOLER, AND AN UMBRELLA BASE

(71) Applicant: Dee Volin, Gresham, OR (US)

(72) Inventor: Dee Volin, Gresham, OR (US)

( * ) Notice: Subject to any disclaimer, the term of this patent is extended or adjusted under 35 U.S.C. 154(b) by 0 days.

(21) Appl. No.: 16/942,782

(22) Filed: Jul. 30, 2020

(65) Prior Publication Data

US 2021/0085075 A1 Mar. 25, 2021

Related U.S. Application Data

(60) Provisional application No. 62/903,446, filed on Sep. 20, 2019.

(51) Int. Cl.
*A47B 37/04* (2006.01)
*A47B 13/08* (2006.01)

(52) U.S. Cl.
CPC ..... *A47B 37/04* (2013.01); *A47B 13/081* (2013.01)

(58) Field of Classification Search
CPC .... A47B 37/04; A47B 13/081; A01K 1/0272; A01K 1/0236; A01K 1/02; A01K 1/03; A01K 1/031; A01K 1/033; A01K 1/034; A01K 1/0035; A01K 1/0245
USPC .... 108/23, 50.11–50.13, 25; 135/16, 96, 46; 312/265.1–265.6, 287, 289, 213, 204, 312/207, 100, 249.8, 249.9
See application file for complete search history.

(56) References Cited

U.S. PATENT DOCUMENTS

| | | | | |
|---|---|---|---|---|
| 375,953 | A * | 1/1888 | Richter | |
| 2,502,103 | A * | 3/1950 | Puls | A47C 29/003 135/155 |
| 2,806,755 | A * | 9/1957 | Glass | A47B 47/0008 312/265.4 |
| 3,006,498 | A * | 10/1961 | Thiede | F24F 1/58 220/255 |
| 4,005,661 | A | 2/1977 | Mason | |
| D258,104 | S | 2/1981 | Baker | |

(Continued)

*Primary Examiner* — Janet M Wilkens

(57) ABSTRACT

A five-device-in-one multi-function tea table, capable of functioning as a pet kennel, a storage locker, a table, a cooler, and an umbrella base, comprises: top and side and bottom frames attached to each other, solid and double-sized and pole-receiving panels respectively inserted into the top and side frames for the five-device-in-one multi-function tea table to function as a kennel or a grooming station or a pet-drying platform or a storage locker or a table or a cooler or an umbrella base, pole-receiving holes drilled into one of the panels, a pole-receiver-shaft attached to the top or side or bottom frame for attaching the five-device-in-one multi-function tea table to a fence post or to a tow hitch or to a pickup-truck utility hole, a waterproof bag having cord tunnels for securely holding rocks or sand or water to function as a ballast or as a cooler or as a cinch-sack or as a backpack, and a securing cord inserted into the cord tunnels for cinchably securing and protecting contents inside the waterproof bag when used as a cinch-sack and for wearably providing shoulder straps for the waterproof bag when used as a backpack.

20 Claims, 70 Drawing Sheets

(56) References Cited

U.S. PATENT DOCUMENTS

| | | | | | |
|---|---|---|---|---|---|
| 4,315,467 | A | | 2/1982 | Vanderminden | |
| 4,522,130 | A | | 6/1985 | Worthington | |
| D280,686 | S | | 9/1985 | Kramer | |
| 4,582,287 | A | | 4/1986 | DeLeary | |
| 4,810,353 | A | | 3/1989 | Cartwright | |
| 4,924,782 | A | | 5/1990 | Nichoalds | |
| 4,936,594 | A | * | 6/1990 | Oliver, III | A47C 7/664 280/47.19 |
| 5,048,902 | A | * | 9/1991 | Daly | B62B 3/006 312/249.8 |
| D346,080 | S | | 4/1994 | Weis | |
| 5,353,716 | A | | 10/1994 | Wilbert | |
| 5,417,166 | A | | 5/1995 | Credle, Sr. | |
| 5,470,139 | A | * | 11/1995 | Hsiao | A47B 47/005 312/111 |
| 5,524,553 | A | * | 6/1996 | Argabright | A47B 63/02 108/25 |
| 5,638,849 | A | * | 6/1997 | Scott | A47C 7/66 135/96 |
| D383,924 | S | | 9/1997 | Dormon | |
| D392,812 | S | | 3/1998 | Hicks | |
| 5,762,004 | A | | 6/1998 | Vashon | |
| 6,039,501 | A | * | 3/2000 | Ruther | A47B 47/005 211/182 |
| D472,953 | S | | 4/2003 | Jacob | |
| 6,705,240 | B2 | | 3/2004 | Block | |
| 6,722,266 | B1 | | 4/2004 | Yang | |
| 7,004,082 | B2 | | 2/2006 | Yang | |
| 7,296,522 | B1 | | 11/2007 | Mahmalji | |
| 7,537,015 | B1 | | 5/2009 | Molnar, IV | |
| 7,926,496 | B2 | | 4/2011 | Young | |
| 8,117,971 | B1 | * | 2/2012 | Cotton | B65F 1/0006 108/90 |
| D668,886 | S | | 10/2012 | Mafi | |
| 8,316,778 | B2 | | 11/2012 | Smith | |
| 8,387,543 | B2 | | 3/2013 | Mallon | |
| 8,456,814 | B2 | * | 6/2013 | Gerovac | H02B 1/301 361/679.01 |
| D720,252 | S | | 12/2014 | Burt | |
| 9,392,868 | B2 | | 7/2016 | Nardi | |
| 9,578,966 | B2 | | 2/2017 | Paoletti | |
| 9,851,050 | B1 | | 12/2017 | Cano | |
| 10,107,502 | B2 | | 10/2018 | Mueller | |
| 10,136,725 | B2 | | 11/2018 | Mueller | |
| D851,971 | S | | 6/2019 | Axelsson | |
| 2006/0272555 | A1 | | 12/2006 | Carter | |
| 2011/0068668 | A1 | * | 3/2011 | Wilson | A47B 47/0083 312/265.5 |
| 2011/0146583 | A1 | * | 6/2011 | Larson | A01K 1/033 119/455 |
| 2011/0226190 | A1 | * | 9/2011 | Lamontagne | A01K 1/033 119/482 |
| 2012/0067252 | A1 | | 3/2012 | Mallon | |
| 2015/0083172 | A1 | * | 3/2015 | Boal | A45B 23/00 135/16 |
| 2015/0216602 | A1 | * | 8/2015 | Brotzman | A61B 50/20 108/25 |
| 2017/0030584 | A1 | | 2/2017 | Mueller et al. | |
| 2020/0060224 | A1 | * | 2/2020 | Volin | B60R 3/02 |

* cited by examiner

FIVE-DEVICE-IN-ONE MULTI-FUNCTION MULTI-CONFIGURABLE HITCH-MOUNTABLE ROLLABLE ROTATABLE COLLAPSABLE TEA TABLE, CAPABLE OF FUNCTIONING AS A PET-KENNEL, A STORAGE LOCKER, A TABLE, A COOLER, AND AN UMBRELLA BASE

1. FIELD OF THE INVENTION

The present invention relates to a tea table, which is cheap to produce, is easy to ship as one unit, can quickly and easily be assembled and disassembled, and can quickly and be easily folded and unfolded. Particularly, the present invention relates to a five-device-in-one multi-function multi-configurable hitch-mountable rollable rotatable collapsible tea table (capable of functioning as a pet kennel, a storage locker, a table, a cooler, and an umbrella base) comprising:

1) Interchangeable rotatable multi-positionable panel system,
2) Panel securing tea-table umbrella-stand support frame system,
3) Adjustable rotatable tow-hitch-attaching fence-post attaching umbrella-pole receiver system,
4) Plastic-coated waterproof-fabric water-tight reinforce-stitched rock-Tillable sand-fillable water-Tillable ice-fillable cinchable backpack cinch-sack cooler ballast bag system, and
5) Lockable pivotable caster system.

2. DESCRIPTION OF THE PRIOR ART

A number of tea tables have been introduced.

U.S. Pat. No. 4,005,661, issued 1977 Feb. 1, to Dewey Mason, discloses a folding umbrella table, which comprises a central column for supporting the table, the column comprising two nesting cylindrical portions, the bottom portion having means for applying supporting legs to hold the column upright. At the top of the column is a circular plate with a plurality of radial slots near the edges. Means are provided for inserting and locking into the slots, a plurality of radial arms each of which is formed of angular material, one web of the angle in the form of a triangle, and the other web of the angle a narrow web of uniform width. Of the entire plurality of segmental arms, there are a first plurality of special support arms, which have a wider vertical web than the others. These act as support for the other segmental arms. There are six of these supporting arms, each of which is adapted to hinge from a horizontal to a vertical position. Each is held in a horizontal position by a folding bracket which is attached by hinge means to the central column of the table. There are two hinged channels between each pair of the six support arms, near the outer ends of the arms. The purpose of these channels is to support the intermediate segmental arms having the short vertical web, which webs rest on the channels, which are hinged to the support arms.

U.S. Pat. No. 4,315,467, issued 1982 Feb. 16, to Robert D. Vanderminden, discloses a cocktail table leg assembly, which includes three legs which are pivotally secured together in order to support the table top in a non-rockable manner. Each leg of the leg assembly includes a resiliently deformable tip for frictionally engaging against the peripheral flange of the table when in assembled condition.

U.S. Pat. No. 4,522,130, issued 1985 Jun. 11, to Roy Worthington, discloses a portable mobile foldable table, which includes a foldable frame having rigidly connected upper and lower side rails and legs, inwardly foldable end rail assemblies, and upper and lower trays which fit within the framework of the upper and lower side and end rail assemblies rigidly locking the frame in operating position. Shoulder surfaces along the side rails with an engageable relationship between the top edges of the end rail assemblies with end handles on the trays provides support at tray ends as well as support along the full lengths of the opposite sides of the trays. The spacing between the legs, side rails, and folded end rail assemblies provides storage space within the folded frame for two trays which are slightly longer than the distance between the legs at opposite ends of the frame assembly so that the trays rest on the folded lower end rail assemblies contained between the legs on opposite sides of the frame for tray storage when the frame is fully folded.

U.S. Pat. No. 4,582,287, issued 1986 Apr. 15, to Robert H. DeLeary, discloses a stand for removably interconnecting an intermediate portion of a horizontally disposed elongated member, such as a board of a patio deck, with the lower end of a vertically disposed elongated member, such as the umbrella post of an umbrella table. The stand includes a main body having first and second spaced apart flanges for removably interconnecting the main body with the intermediate portion of the horizontally disposed elongated member. The stand also includes a socket formed in the main body, the socket opening in a direction opposite the direction in which the first and second flanges extend. The socket accepts the lower end of the vertically disposed elongated member. In the preferred embodiment, the main body consists of a U-shaped stamping having a base and two flanges extending therefrom as well as a right circular cylindrical tube welded to the base portion of the U-shaped stamping.

U.S. Pat. No. 4,810,353, issued 1989 Mar. 7, to John V. Cartwright, discloses a pop-up table assembly, which comprises support sections supporting a table telescopically mounted on a stabilizing shaft secured within a drum mounted in the ground or other sub-structure. The table assembly is releasably positioned in either its elevated mode or down mode (within the drum). U-shaped channel members provide a way to guide the reciprocation of the assembly, and are longitudinally secured to the interior wall of the drum. Means for positively locking the assembly in its down mode is provided. Alternative embodiments of counter-balancing mechanisms are disclosed, whereby raising and lowering of the assembly is facilitated. Drainage passage provide for run-off of water that may accumulate upon the stored assembly or while it is in use. A storage chamber is generated between the table assembly elements and the drum, for introduction of furniture or the like to be stored when the assembly is not in elevated mode or used. Means for initially raising the table assembly from the ground plane is included in order to easily grasp the table to raise the assembly to its elevated mode.

U.S. Pat. No. 4,924,782, issued 1990 May 15, to Donald L. Nichoalds, discloses a wheeled table, which includes a base section, wheels mounted to the base section, a tabletop carried on an upper section above the base section and having an upstanding peripheral wall, and a pad removably carried on the upper surface of the tabletop. The tabletop and pad have aligned elongated openings adjacent to and extending parallel to one end of the tabletop. The openings cooperate with the upstanding edge wall to provide improved handle means for manipulating the table when desired. The upstanding edge wall further provides for maintained positioning of the pad on the tabletop.

U.S. Pat. No. 5,353,716, issued 1994 Oct. 11, to Bruno Wilbert, discloses a standing table with a hollow formed pedestal and a table top. The pedestal is hollow and is formed radially symmetrically, tapering upwardly. The central region of the table top is implemented so that it can be connected, through form-fitting, with upper edge regions of the pedestal. The standing table is stackable, while including a continuous table top and a separate pedestal.

U.S. Pat. No. 5,417,166, issued 1995 May 23, to Michael T. Credle, Sr., discloses a portable umbrella table, which is easily assembled and is affixed to the ground by a central hollow stake. The umbrella includes a shaft which is joined to a post which slides through the hollow stake into the ground to provide additional security and stability to table during wind gusts. Adjustable straps are provided on the bottom surface of the table top to laterally contain the umbrella against the table top for transportation and storage and a table top handle allows one person to easily transport the umbrella table before and after use.

U.S. Pat. No. 5,762,004, issued 1998 Jun. 9, to Adrian R. Vashon, discloses a portable, collapsible recreation table for use on unleveled terrain or other area surface suitable for a table to be supported by an implanted stake. This table is comprised of a rimmed table top, three rounded legs which fold up under the table when disassembled, or mount into a connecting disc when assembled, a stake which is implanted into the ground after being threaded into the threaded stake holder in the connecting disc, and the legs are then placed in the leg connectors, also in the connecting disc. The table also has a flexible handle which can be tucked away under the table when the table is in the assembled position. Also included under the table top are a threaded disc holder and stake holders which hold the stake and connection disc when the table is in the disassembled position.

U.S. Pat. No. 6,705,240, issued 2004 Mar. 16, to Robert H. Block, discloses a portable table, that can be anchored to an earthen surface. The portable table has a top portion comprising opposing surfaces, and at least one stand member. The stand member may be secured to the top portion by a securing member in a disassembled state to facilitate transportation of the portable table. In addition, the top portion may include an opening capable of receiving and holding drinking containers.

U.S. Pat. No. 6,722,266, issued 2004 Apr. 20, to Jim Chi Hsiang Yang, discloses a multipurpose outdoor table, which is disclosed to include a polygonal table top formed of a polygonal base plate with a polygonal center opening and face slats arranged on the polygonal base plate around the polygonal center opening, and a barbecue grill unit selectively mounted in the polygonal center opening of the tabletop between a first position where the face slats of the barbecue grill unit are disposed in flush with the face slats of the tabletop, and a second position where the barbecue grill of the barbecue grill unit stands at the top side for roasting meat, the barbecue grill unit having a heat-insulating center sleeve adapted to support a parasol.

U.S. Pat. No. 7,004,082, issued 2006 Feb. 28, to Jim Chi Hsiang Yang, discloses an outdoor table and chair set in which the tabletop of the table is constructed to include a plurality of polygonal tabletop box panels abutted against one another and defining a center hole for the mounting of the shank of a parasol, each tabletop box panel having a polygonal open chamber, a plurality of frames respectively detachably mounted in the polygonal open chambers of the polygonal tabletop box panels, and a plurality of ornamental glass cover plates respectively detachably mounted in the frames.

U.S. Pat. No. 7,296,522, issued 2007 Nov. 20, to Alan J. Mahmalji, discloses a patio heater table (10) for encompassing a patio heater (14), which consists of a duplicate pair of table sides (20) having a table upper portion with legs (46) that are connected by a permanent brace ring segment (52). The table upper portion is formed with a semi-circular structure (22) made of a peripheral ring (24) and a bisecting chord (28) having a midpoint radial concave portion (30) for avoiding contact with the heater standard, or post, (12). The two table sides mate together and are attached with each side positioned over and around the patio heater. The table includes removable brace ring segments (54) that are attached to the leg permanent brace ring segments providing access to the patio heater for fuel replacement. The table is made of steel or aluminum material and is preferably of welded construction.

U.S. Pat. No. 7,537,015, issued 2009 May 26, to William F. Molnar, IV, discloses a table umbrella apparatus has a base, a table affixed to the base, a canopy support by the base a distance above the table, and an air treating means positioned in the base for delivering a flow of air outwardly of the base. The air treating system includes a fan, a motor drivingly connected to the fan, a reservoir positioned in the base, and a pump cooperative with the water in the reservoir for passing a flow of water across air urged by the fan. An aspen wood intake filter is positioned in the base so that the air is urged by the fan across this intake filter.

U.S. Pat. No. 7,926,496, issued 2011 Apr. 19, to David Young, discloses an apparatus and methods for holding and tilting an umbrella. The apparatus comprises at least one spring connected to an umbrella pole so that operation of the spring(s) moves the umbrella pole so as to adjust the pole angle of the umbrella. The apparatus also comprises a pivot for the umbrella pole that allows angular motion of the umbrella pole. The apparatus also comprises a rotary bearing capable of rotating around an axis of the umbrella pole. The spring(s) and the pivot can be connected to the rotary bearing. The present apparatus can also include a shade umbrella and an outdoor table. Methods for tilting an umbrella are also provided.

U.S. Pat. No. 8,316,778, issued 2012 Nov. 27, to Dale M. Smith, discloses a table, which includes a collapsible umbrella and a hollow main body. The hollow main body is adapted to receive the umbrella when the umbrella is in a collapsed position. The collapsible umbrella may include a pole coupled to a plurality of hinged ribs supporting a canopy. Each of the ribs may include a first hinge coupled to the pole that facilitates a downward folding of the umbrella, and a second hinge disposed between a first end of the rib and a second end of the rib that facilitates an upward folding of a portion of the umbrella. A method for storing the umbrella of the table is also provided.

U.S. Pat. No. 8,387,543, issued 2013 Mar. 5, to Timothy Mallon, discloses an extendable table, which comprises a frame, a table top portion, and a cutout filling mechanism. The table top portion is slidably attached to the frame and defines a cutout. The cutout filling mechanism is attached to the table top portion and comprises a filler portion. In use, the cutout filling mechanism is operative to place at least a portion of the filler portion into the cutout when the cutout is not occupied by another object. The cutout filling mechanism is also operative to place the filler portion outside the cutout when the cutout is occupied by another object.

U.S. Pat. No. 9,392,868, issued 2016 Jul. 19, to Sandra Nardi, discloses a portable folding outdoor table, which includes a foldable table top including a flat top and includes foldable portions joined together at joint(s) that extend through the table top and bottom, cup holders extending through the table top, a beach umbrella shaft substantially positioned in the center, extending through the table top and sized to accept a shaft of a beach umbrella, holes defined by the table top, where the holes are smaller in diameter than the cup holders and permit wind to blow through the table top, and foldable legs attached to the table top bottom, where the foldable legs are designed to position the table top at a height in the range of 10" to 20" above a ground surface on which the portable outdoor table sits.

U.S. Pat. No. 9,578,966, issued 2017 Feb. 28, to Jodie A. Paoletti, discloses portable structures, which convert into furniture articles, such as chairs, backrests, and tables, when substantially filled with sand and revert to collapsed portable structures for easy transport after a substantial amount of sand has been removed. The portable structures include a cover, made from a flexible and deformable material, and a frame that includes one or more flexible frame members disposed on or incorporated within the cover. The flexible frame members have spring-like characteristics such that a portable structure, without substantial sand therein, can be collapsed for storage and/or transport, and when ready for use, automatically converted to an "uncollapsed pop-up" state adapted to receive sand filling to form the furniture article.

U.S. Pat. No. 9,851,050, issued 2017 Dec. 26, to Luis Cano, discloses an umbrella mounting system for PURPOSE, which includes a cart that may be urged along a support surface. The cart has a plurality of horizontal members. An umbrella is provided that has a shaft and a canopy. A mounting unit is removably coupled to the cart. The mounting unit insertably receives the shaft such that the canopy is positioned over the cart. Thus, the umbrella shades an area around the cart.

U.S. Pat. No. 10,107,502, issued 2018 Oct. 23, to Erik Mueller, discloses a multi-function outdoor patio table, which includes a base surrounding a contained space and a tabletop coupled to the base by a movement assembly. The tabletop is moveable relative to the base between open and closed positions to provide selective access to a functional/storage device within the base, such as a fire pit or an ice bucket. The movement assembly includes a slide rail assembly, a pivot linkage assembly, or the like such that a tabletop surface defined by the tabletop is disposed in a substantially horizontal orientation at both of the open and closed positions and also during movement of the tabletop between the open and closed positions. Thus, the tabletop surface can continue to be used in all configurations of the multi-function outdoor patio table.

U.S. Pat. No. 10,136,725, issued 2018 Nov. 27, to Erik Mueller, discloses a convertible outdoor patio table. The table includes a metallic frame mounted on wheels, the frame surrounding a generally hollow interior, an outer body member which is coupled to and substantially surrounds side portions of the frame, the outer body member being made of a weather resistant material, a railing coupled to the frame and defining a shoulder positioned adjacent the outer body member at the generally hollow interior, a tabletop lid member which removably engages with at least one of the shoulder or the outer body member to close the generally hollow interior, and a functional/storage device which is revealed for access and use when the tabletop lid member is disengaged from the outer body member. The functional/storage device substantially covers a surface area bounded at the top end of the frame to maximize usage of space within the generally hollow interior.

U.S. Pat. No. D258,104, issued 1981 Feb. 3, to Bertrand M. Baker, discloses an ornamental design for a tea table.

U.S. Pat. No. D280,686, issued 1985 Sep. 24, to Jol A. Kramer, discloses an ornamental design for a tea table.

U.S. Pat. No. D346,080, issued 1994 Apr. 19, to Jeffrey A. Weis, discloses an ornamental design for patio table.

U.S. Pat. No. D383,924, issued 1997 Sep. 23, to Nicholas Q. Dormon, discloses an ornamental design for a mobile table.

U.S. Pat. No. D392,812, issued 1998 Mar. 31, to Billy W. Hicks, discloses an ornamental design for a portable outdoor table.

U.S. Pat. No. D472,953, issued 2003 Apr. 8, to Lisa S. Jacob, discloses an ornamental design for a recreational outdoor table.

U.S. Pat. No. D668,886, issued 2012 Oct. 16, to Masoud Mafi, discloses an ornamental design for an outdoor table.

U.S. Pat. No. D720,252, issued 2014 Dec. 30, to Andy Burt, discloses an ornamental design for a planter umbrella stand table.

U.S. Pat. No. D851,971, issued 2019 Jun. 25, to Mikael Axelsson, discloses an ornamental design for a tea table.

U.S. Pub. No. 20060272555, published 2006 Dec. 7, to Raymond M. Carter, discloses an umbrella table with an oversized opening in the center of the table, that allows the umbrella pole to pivot below the table while accommodating the angle of the tilt of the pole. The umbrella table has a pair of flanges on either side of the table underneath the surface of the table. The flanges are used to secure sitting furniture to either side of the table. This prevents the sitting furniture and table from becoming separated due to wind or other forces that may cause movement of the sitting furniture or table. The table is also weighted with a heavy base, which prevents the umbrella table from toppling over.

U.S. Pub. No. 20120067252, published 2012 Mar. 22, to Timothy Mallon, discloses an extendable table, which comprises a frame, a table top portion, and a cutout filling mechanism. The table top portion is slidably attached to the frame and defines a cutout. The cutout filling mechanism is attached to the table top portion and comprises a filler portion. In use, the cutout filling mechanism is operative to place at least a portion of the filler portion into the cutout when the cutout is not occupied by another object. The cutout filling mechanism is also operative to place the filler portion outside the cutout when the cutout is occupied by another object.

U.S. Pub. No. 20170030584, issued 2017 Feb. 2, to Plank and Hide, discloses a multi-function outdoor patio table, which includes a base surrounding a contained space and a tabletop coupled to the base by a movement assembly. The tabletop is moveable relative to the base between open and closed positions to provide selective access to a functional/storage device within the base, such as a fire pit or an ice bucket. The movement assembly includes a slide rail assembly, a pivot linkage assembly, or the like such that a tabletop surface defined by the tabletop is disposed in a substantially horizontal orientation at both of the open and closed positions and also during movement of the tabletop between the open and closed positions. Thus, the tabletop surface can continue to be used in all configurations of the multi-function outdoor patio table.

DISADVANTAGES OF THE PRIOR ART

The prior art have failed to solve many problems associated with such tea table, as follows:

1) No prior art mention or disclose any tea table, having interchangeable multi-positionable slideable rotatable umbrella-pole-receiving panels 102.

Therefore, the prior art of tea table is (or are each):

a) Not capable of acting as an interchangeable surface for multi-positionable umbrella-pole-receiving holes 103 to allow at least one umbrella pole to be inserted therein (See FIG. 1, FIG. 2, FIG. 3, FIG. 4, FIG. 23, FIG. 24, FIG. 25, FIG. 26, FIG. 27, FIG. 28, FIG. 29, FIG. 30, FIG. 31, FIG. 32, FIG. 33, FIG. 34, FIG. 35, FIG. 36, FIG. 37, FIG. 38, FIG. 39, FIG. 40, FIG. 41, FIG. 42, FIG. 43, FIG. 44, FIG. 45, FIG. 46, FIG. 47, FIG. 48, FIG. 49, FIG. 50, FIG. 51, FIG. 52, FIG. 53A, FIG. 53B, FIG. 53C, FIG. 54, FIG. 55. FIG. 56, FIG. 57, FIG. 63, FIG. 64, FIG. 65B, FIG. 66D, FIG. 67, FIG. 68, FIG. 69B, FIG. 70B, and FIG. 70C);

b) When the tea table is functioning as a kennel, not capable of acting providing an interchangeable surface to act as a top and/or wall in the directions of arrows 131, 132, and 133 (See FIG. 61B);

c) When the tea table is functioning as a grooming station, not capable of providing an interchangeable surface to act as a top and/or wall in the directions of arrows 131, 132, and 133 (See FIG. 62);

d) When the tea table is functioning as a pet drying platform, not capable of providing an interchangeable surface to act as a top and/or wall in the directions of arrows 131, 132, and 133 (See FIG. 62);

e) When the tea table is functioning as a storage locker, not capable of providing an interchangeable surface to act as a top and/or wall in the directions of arrows 131, 132, and 133 (See FIG. 61A);

f) When the tea table is functioning as a table, not capable of providing an interchangeable surface to act as a top and/or wall in the directions of arrows 131, 132, and 133 (See FIG. 50, FIG. 51, FIG. 53B, FIG. 53C, FIG. 63, and FIG. 64); and g) When the tea table is functioning as a cooler, not capable of providing an interchangeable surface to act as a top and/or wall in the directions of arrows 131, 132, and 133 (See FIG. 20D).

2) No prior art mention or disclose any tea table, having multi-positionable umbrella-pole-receiving holes 103.

Therefore, the prior art of tea table is (or are each):

a) Not capable of providing multiple options for an umbrella pole to be inserted vertically (see FIG. 50, FIG. 51, FIG. 52, FIG. 53A, FIG. 53B, FIG. 53C, FIG. 55, FIG. 56, FIG. 57, FIG. 65B, FIG. 66D, FIG. 68, FIG. 69B, FIG. 70B, and FIG. 70C);

b) Not capable of providing multiple options for an umbrella pole to be inserted horizontally (see FIG. 52, FIG. 70B, and FIG. 70C); and c) Not capable of providing multiple options for an umbrella pole to be inserted diagonally (see FIG. 53A, FIG. 65B, and FIG. 69B).

3) No prior art mention or disclose any tea table, having interchangeable slideable rotatable solid panels 104.

Therefore, the prior art of tea table is (or are each):

a) When the tea table is functioning as a kennel, not capable of providing an interchangeable surface to act as a top and/or wall in the directions of arrows 131, 132, and 133 (See FIG. 61B);

b) When the tea table is functioning as a grooming station, not capable of providing an interchangeable surface to act as a top and/or wall in the directions of arrows 131, 132, and 133 (See FIG. 62);

c) When the tea table is functioning as a pet drying platform, not capable of providing an interchangeable surface to act as a top and/or wall in the directions of arrows 131, 132, and 133 (See FIG. 62);

d) When the tea table is functioning as a storage locker, not capable of providing an interchangeable surface to act as a top and/or wall in the directions of arrows 131, 132, and 133 (See FIG. 61A);

e) When the tea table is functioning as a table, not capable of providing an interchangeable surface to act as a top and/or wall in the directions of arrows 131, 132, and 133 (See FIG. 50, FIG. 51, FIG. 53B, FIG. 53C, FIG. 63, and FIG. 64); and f) When the tea table is functioning as a cooler, not capable of providing an interchangeable surface to act as a top and/or wall in the directions of arrows 131, 132, and 133 (See FIG. 20D).

4) No prior art mention or disclose any tea table, having interchangeable slideable rotatable breathable ornamental double-sized panels 105.

Therefore, the prior art of tea table is (or are each):

a) When the tea table is functioning as a kennel, not capable of providing an interchangeable surface to act as a top and/or wall in the directions of arrows 131, 132, and 133 (See FIG. 61B);

b) When the tea table is functioning as a grooming station, not capable of providing an interchangeable surface to act as a top and/or wall in the directions of arrows 131, 132, and 133 (See FIG. 62);

c) When the tea table is functioning as a pet drying platform, not capable of providing an interchangeable surface to act as a top and/or wall in the directions of arrows 131, 132, and 133 (See FIG. 62);

d) When the tea table is functioning as a storage locker, not capable of providing an interchangeable surface to act as a top and/or wall in the directions of arrows 131, 132, and 133 (See FIG. 61A);

e) When the tea table is functioning as a table, not capable of providing an interchangeable surface to act as a top and/or wall in the directions of arrows 131, 132, and 133 (See FIG. 50, FIG. 51, FIG. 53B, FIG. 53C, FIG. 63, and FIG. 64); and f) When the tea table is functioning as a cooler, not capable of providing an interchangeable surface to act as a top and/or wall in the directions of arrows 131, 132, and 133
(See FIG. 20D).

5) No prior art mention or disclose any tea table, having top-panel-securing support frame 110.
Therefore, the prior art of tea table is (or are each):
a) When the tea table is functioning as a kennel, not capable of providing support for interchangeable multi-positionable slideable rotatable umbrella-pole-receiving panels 102, interchangeable slideable rotatable solid panels 104, and interchangeable slideable rotatable breathable ornamental double-sized panels 105
in the directions of arrows 131, 132, and 133
(See FIG. 61B);
b) When the tea table is functioning as a grooming station, not capable of providing support for interchangeable multi-positionable slideable rotatable umbrella-pole-receiving panels 102, interchangeable slideable rotatable solid panels 104, and interchangeable slideable rotatable breathable ornamental double-sized panels 105
in the directions of arrows 131, 132, and 133
(See FIG. 62);
c) When the tea table is functioning as a drying platform, not capable of providing support for interchangeable multi-positionable slideable rotatable umbrella-pole-receiving panels 102, interchangeable slideable rotatable solid panels 104, and interchangeable slideable rotatable breathable ornamental double-sized panels 105
in the directions of arrows 131, 132, and 133
(See FIG. 62);
d) When the tea table is functioning as a storage locker, not capable of providing support for interchangeable multi-positionable slideable rotatable umbrella-pole-receiving panels 102, interchangeable slideable rotatable solid panels 104, and interchangeable slideable rotatable breathable ornamental double-sized panels 105
in the directions of arrows 131, 132, and 133
(See FIG. 61A);
e) When the tea table is functioning as a table, not capable of providing support for interchangeable multi-positionable slideable rotatable umbrella-pole-receiving panels 102, interchangeable slideable rotatable solid panels 104, and interchangeable slideable rotatable breathable ornamental double-sized panels 105
in the directions of arrows 131, 132, and 133
(See FIG. 50, FIG. 51, FIG. 53B, FIG. 53C, FIG. 63, and FIG. 64); and
f) When the tea table is functioning as a cooler, not capable of providing support for interchangeable multi-positionable slideable rotatable umbrella-pole-receiving panels 102, interchangeable slideable rotatable solid panels 104, and interchangeable slideable rotatable breathable ornamental double-sized panels 105
in the directions of arrows 131, 132, and 133
(See FIG. 20D).

6) No prior art mention or disclose any tea table, having side-panel-securing support frame 111.
Therefore, the prior art of tea table is (or are each):
a) When the tea table is functioning as a kennel, not capable of providing support for interchangeable multi-positionable slideable rotatable umbrella-pole-receiving panels 102, interchangeable slideable rotatable solid panels 104, and interchangeable slideable rotatable breathable ornamental double-sized panels 105
(See FIG. 61B);
b) When the tea table is functioning as a grooming station, not capable of providing support for interchangeable multi-positionable slideable rotatable umbrella-pole-receiving panels 102, interchangeable slideable rotatable solid panels 104, and interchangeable slideable rotatable breathable ornamental double-sized panels 105
(See FIG. 62);
c) When the tea table is functioning as a drying platform, not capable of providing support for interchangeable multi-positionable slideable rotatable umbrella-pole-receiving panels 102, interchangeable slideable rotatable solid panels 104, and interchangeable slideable rotatable breathable ornamental double-sized panels 105
(See FIG. 62);
d) When the tea table is functioning as a storage locker, not capable of providing support for interchangeable multi-positionable slideable rotatable umbrella-pole-receiving panels 102, interchangeable slideable rotatable solid panels 104, and interchangeable slideable rotatable breathable ornamental double-sized panels 105
(See FIG. 61A);
e) When the tea table is functioning as a table, not capable of providing support for interchangeable multi-positionable slideable rotatable umbrella-pole-receiving panels 102, interchangeable slideable rotatable solid panels 104, and interchangeable slideable rotatable breathable ornamental double-sized panels 105
(See FIG. 50, FIG. 51, FIG. 53B, FIG. 53C, FIG. 63, and FIG. 64); and
f) When the tea table is functioning as a cooler, not capable of providing support for interchangeable multi-positionable slideable rotatable umbrella-pole-receiving panels 102, interchangeable slideable rotatable solid panels 104, and interchangeable slideable rotatable breathable ornamental double-sized panels 105
(See FIG. 20D).

7) No prior art mention or disclose any tea table, having breathable bottom support frame 112.
Therefore, the prior art of tea table is (or are each):
a) When used as a kennel, not capable of providing structural rigidity to the tea table
(See FIG. 61B);
b) When used as a grooming station, not capable of providing structural rigidity to the tea table
(See FIG. 62);
c) When used as a drying platform, not capable of providing structural rigidity to the tea table
(See FIG. 62);
d) When used as a storage locker, not capable of providing structural rigidity to the tea table
(See FIG. 61A);
e) When used as a table, not capable of providing structural rigidity to the tea table
(See FIG. 50, FIG. 51, FIG. 53B, FIG. 53C, FIG. 63, and FIG. 64); and
f) When used as a cooler, not capable of providing structural rigidity to the tea table
(See FIG. 20D).

8) No prior art mention or disclose any tea table, having tow-hitch-attaching fence-post-attaching truck-utility-hole-inserting umbrella-pole-receiver shaft 116.

Therefore, the prior art of tea table is (or are each):

a) Not capable of vertically attaching an umbrella pole for shade and/or privacy (see FIG. 54 and FIG. 63);

b) Not capable of horizontally attaching an umbrella pole to be used for shade and/or privacy (see FIG. 65A and FIG. 68);

c) Not capable of slidably attaching to a fence post (see FIG. 69A, FIG. 69B, and FIG. 70B);

d) Not capable of slidably attaching to a tow hitch receiver (see FIG. 65B, FIG. 66D, and FIG. 68); and e) Not capable of slidably attaching to a utility hole of a pickup truck (see FIG. 70C).

9) No prior art mention or disclose any tea table, having plastic-coated waterproof-fabric water-tight reinforce-stitched walls 123.

Therefore, the prior art of tea table is (or are each):

a) Not capable of securely holding rocks, sand, and/or water to be a ballast to provide added stability to the tea table (see FIG. 20A, FIG. 20B, FIG. 20C, FIG. 20D, FIG. 71, FIG. 72, FIG. 73, and FIG. 74);

b) Not capable of waterproofedly and insulatedly holding ice to function as a cooler (see FIG. 20D and FIG. 74);

c) Not capable of securing contents when functioning as a cinch-sack (see FIG. 75); and d) Not capable of protecting contents when functioning as a backpack (see FIG. 76).

10) No prior art mention or disclose any tea table, having cinchable tieable backpack cinch-sack shoulder-strap content-securing cord 125.

Therefore, the prior art of tea table is (or are each):

a) Not capable of cinchably securing contents inside (see FIG. 20A, FIG. 20B, FIG. 20C, FIG. 20D, FIG. 71, FIG. 72, FIG. 73, FIG. 74, FIG. 75, and FIG. 76);

b) Not capable of acting as cinching-straps when functioning as cinch-sack (see FIG. 75); and c) Not capable of wearably providing shoulder straps when functioning as a backpack (see FIG. 76).

OBJECTS AND ADVANTAGES OF THE INVENTION

The new invention substantially departs from the conventional concepts and designs of the prior art. In doing so, the new invention provides (a or an) five-device-in-one multi-function multi-configurable hitch-mountable rollable rotatable collapsible tea table (capable of functioning as a pet kennel, a storage locker, a table, a cooler, and an umbrella base), having many unique and significant features, functions, and advantages, which overcome all the disadvantages of the prior art, as follows:

1) It is an object of the new invention to provide (a or an) five-device-in-one multi-function multi-configurable hitch-mountable rollable rotatable collapsible tea table, having interchangeable multi-positionable slideable rotatable umbrella-pole-receiving panels 102.

Therefore, the five-device-in-one multi-function multi-configurable hitch-mountable rollable rotatable collapsible tea table is (or are each):

a) Capable of acting as an interchangeable surface for multi-positionable umbrella-pole-receiving holes 103 to allow at least one umbrella pole to be inserted therein (See FIG. 1, FIG. 2, FIG. 3, FIG. 4, FIG. 23, FIG. 24, FIG. 25, FIG. 26, FIG. 27, FIG. 28, FIG. 29, FIG. 30, FIG. 31, FIG. 32, FIG. 33, FIG. 34, FIG. 35, FIG. 36, FIG. 37, FIG. 38, FIG. 39, FIG. 40, FIG. 41, FIG. 42, FIG. 43, FIG. 44, FIG. 45, FIG. 46, FIG. 47, FIG. 48, FIG. 49, FIG. 50, FIG. 51, FIG. 52, FIG. 53A, FIG. 53B, FIG. 53C, FIG. 54, FIG. 55. FIG. 56, FIG. 57, FIG. 63, FIG. 64, FIG. 65B, FIG. 66D, FIG. 67, FIG. 68, FIG. 69B, FIG. 70B, and FIG. 70C);

b) When the tea table is functioning as a kennel, capable of acting providing an interchangeable surface to act as a top and/or wall in the directions of arrows 131, 132, and 133 (See FIG. 61B);

c) When the tea table is functioning as a grooming station, capable of providing an interchangeable surface to act as a top and/or wall in the directions of arrows 131, 132, and 133 (See FIG. 62);

d) When the tea table is functioning as a pet drying platform, capable of providing an interchangeable surface to act as a top and/or wall in the directions of arrows 131, 132, and 133 (See FIG. 62);

e) When the tea table is functioning as a storage locker, capable of providing an interchangeable surface to act as a top and/or wall in the directions of arrows 131, 132, and 133 (See FIG. 61A);

f) When the tea table is functioning as a table, capable of providing an interchangeable surface to act as a top and/or wall in the directions of arrows 131, 132, and 133 (See FIG. 50, FIG. 51, FIG. 53B, FIG. 53C, FIG. 63, and FIG. 64); and g) When the tea table is functioning as a cooler, capable of providing an interchangeable surface to act as a top and/or wall in the directions of arrows 131, 132, and 133 (See FIG. 20D).

2) It is another object of the new invention to provide (a or an) five-device-in-one multi-function multi-configurable hitch-mountable rollable rotatable collapsible tea table, having multi-positionable umbrella-pole-receiving holes 103.

Therefore, the five-device-in-one multi-function multi-configurable hitch-mountable rollable rotatable collapsible tea table is (or are each):

a) Capable of providing multiple options for an umbrella pole to be inserted vertically (see FIG. 50, FIG. 51, FIG. 52, FIG. 53A, FIG. 53B, FIG. 53C, FIG. 55, FIG. 56, FIG. 57, FIG. 65B, FIG. 66D, FIG. 68, FIG. 69B, FIG. 70B, and FIG. 70C);

b) Capable of providing multiple options for an umbrella pole to be inserted horizontally (see FIG. 52, FIG. 70B, and FIG. 70C); and c) Capable of providing multiple options for an umbrella pole to be inserted diagonally (see FIG. 53A, FIG. 65B, and FIG. 69B).

3) It is still another object of the new invention to provide (a or an) five-device-in-one multi-function multi-configurable hitch-mountable rollable rotatable collapsible tea table, having
interchangeable slideable rotatable solid panels 104.
Therefore, the five-device-in-one multi-function multi-configurable hitch-mountable rollable rotatable collapsible tea table is (or are each):
a) When the tea table is functioning as a kennel, capable of providing an interchangeable surface to act as a top and/or wall
in the directions of arrows 131, 132, and 133
(See FIG. 61B);
b) When the tea table is functioning as a grooming station, capable of providing an interchangeable surface to act as a top and/or wall
in the directions of arrows 131, 132, and 133
(See FIG. 62);
c) When the tea table is functioning as a pet drying platform, capable of providing an interchangeable surface to act as a top and/or wall
in the directions of arrows 131, 132, and 133
(See FIG. 62);
d) When the tea table is functioning as a storage locker, capable of providing an interchangeable surface to act as a top and/or wall
in the directions of arrows 131, 132, and 133
(See FIG. 61A);
e) When the tea table is functioning as a table, capable of providing an interchangeable surface to act as a top and/or wall
in the directions of arrows 131, 132, and 133
(See FIG. 50, FIG. 51, FIG. 53B, FIG. 53C, FIG. 63, and FIG. 64); and
f) When the tea table is functioning as a cooler, capable of providing an interchangeable surface to act as a top and/or wall
in the directions of arrows 131, 132, and 133
(See FIG. 20D).

4) It is yet still another object of the new invention to provide (a or an) five-device-in-one multi-function multi-configurable hitch-mountable rollable rotatable collapsible tea table, having
interchangeable slideable rotatable breathable ornamental double-sized panels 105.
Therefore, the five-device-in-one multi-function multi-configurable hitch-mountable rollable rotatable collapsible tea table is (or are each):
a) When the tea table is functioning as a kennel, capable of providing an interchangeable surface to act as a top and/or wall
in the directions of arrows 131, 132, and 133
(See FIG. 61B);
b) When the tea table is functioning as a grooming station, capable of providing an interchangeable surface to act as a top and/or wall
in the directions of arrows 131, 132, and 133
(See FIG. 62);
c) When the tea table is functioning as a pet drying platform, capable of providing an interchangeable surface to act as a top and/or wall
in the directions of arrows 131, 132, and 133
(See FIG. 62);
d) When the tea table is functioning as a storage locker, capable of providing an interchangeable surface to act as a top and/or wall
in the directions of arrows 131, 132, and 133
(See FIG. 61A);
e) When the tea table is functioning as a table, capable of providing an interchangeable surface to act as a top and/or wall
in the directions of arrows 131, 132, and 133
(See FIG. 50, FIG. 51, FIG. 53B, FIG. 53C, FIG. 63, and FIG. 64); and
f) When the tea table is functioning as a cooler, capable of providing an interchangeable surface to act as a top and/or wall
in the directions of arrows 131, 132, and 133
(See FIG. 20D).

5) It is a further object of the new invention to provide (a or an) five-device-in-one multi-function multi-configurable hitch-mountable rollable rotatable collapsible tea table, having
top-panel-securing support frame 110.
Therefore, the five-device-in-one multi-function multi-configurable hitch-mountable rollable rotatable collapsible tea table is (or are each):
a) When the tea table is functioning as a kennel, capable of providing support for interchangeable multi-positionable slideable rotatable umbrella-pole-receiving panels 102, interchangeable slideable rotatable solid panels 104, and interchangeable slideable rotatable breathable ornamental double-sized panels 105
in the directions of arrows 131, 132, and 133
(See FIG. 61B);
b) When the tea table is functioning as a grooming station, capable of providing support for interchangeable multi-positionable slideable rotatable umbrella-pole-receiving panels 102, interchangeable slideable rotatable solid panels 104, and interchangeable slideable rotatable breathable ornamental double-sized panels 105
in the directions of arrows 131, 132, and 133
(See FIG. 62);
c) When the tea table is functioning as a drying platform, capable of providing support for interchangeable multi-positionable slideable rotatable umbrella-pole-receiving panels 102, interchangeable slideable rotatable solid panels 104, and interchangeable slideable rotatable breathable ornamental double-sized panels 105
in the directions of arrows 131, 132, and 133
(See FIG. 62);
d) When the tea table is functioning as a storage locker, capable of providing support for interchangeable multi-positionable slideable rotatable umbrella-pole-receiving panels 102, interchangeable slideable rotatable solid panels 104, and interchangeable slideable rotatable breathable ornamental double-sized panels 105
in the directions of arrows 131, 132, and 133
(See FIG. 61A);
e) When the tea table is functioning as a table, capable of providing support for interchangeable multi-positionable slideable rotatable umbrella-pole-receiving panels 102, interchangeable slideable rotatable solid panels 104, and interchangeable slideable rotatable breathable ornamental double-sized panels 105
in the directions of arrows 131, 132, and 133

(See FIG. 50, FIG. 51, FIG. 53B, FIG. 53C, FIG. 63, and FIG. 64); and f) When the tea table is functioning as a cooler, capable of providing support for interchangeable multi-positionable slideable rotatable umbrella-pole-receiving panels 102, interchangeable slideable rotatable solid panels 104, and interchangeable slideable rotatable breathable ornamental double-sized panels 105 in the directions of arrows 131, 132, and 133 (See FIG. 20D).

6) It is an even further object of the new invention to provide (a or an) five-device-in-one multi-function multi-configurable hitch-mountable rollable rotatable collapsible tea table, having side-panel-securing support frame 111.

Therefore, the five-device-in-one multi-function multi-configurable hitch-mountable rollable rotatable collapsible tea table is (or are each):

a) When the tea table is functioning as a kennel, capable of providing support for interchangeable multi-positionable slideable rotatable umbrella-pole-receiving panels 102, interchangeable slideable rotatable solid panels 104, and interchangeable slideable rotatable breathable ornamental double-sized panels 105 (See FIG. 61B);

b) When the tea table is functioning as a grooming station, capable of providing support for interchangeable multi-positionable slideable rotatable umbrella-pole-receiving panels 102, interchangeable slideable rotatable solid panels 104, and interchangeable slideable rotatable breathable ornamental double-sized panels 105 (See FIG. 62);

c) When the tea table is functioning as a drying platform, capable of providing support for interchangeable multi-positionable slideable rotatable umbrella-pole-receiving panels 102, interchangeable slideable rotatable solid panels 104, and interchangeable slideable rotatable breathable ornamental double-sized panels 105 (See FIG. 62);

d) When the tea table is functioning as a storage locker, capable of providing support for interchangeable multi-positionable slideable rotatable umbrella-pole-receiving panels 102, interchangeable slideable rotatable solid panels 104, and interchangeable slideable rotatable breathable ornamental double-sized panels 105 (See FIG. 61A);

e) When the tea table is functioning as a table, capable of providing support for interchangeable multi-positionable slideable rotatable umbrella-pole-receiving panels 102, interchangeable slideable rotatable solid panels 104, and interchangeable slideable rotatable breathable ornamental double-sized panels 105 (See FIG. 50, FIG. 51, FIG. 53B, FIG. 53C, FIG. 63, and FIG. 64); and f) When the tea table is functioning as a cooler, capable of providing support for interchangeable multi-positionable slideable rotatable umbrella-pole-receiving panels 102, interchangeable slideable rotatable solid panels 104, and interchangeable slideable rotatable breathable ornamental double-sized panels 105 (See FIG. 20D).

7) It is still an even further object of the new invention to provide (a or an) five-device-in-one multi-function multi-configurable hitch-mountable rollable rotatable collapsible tea table, having breathable bottom support frame 112.

Therefore, the five-device-in-one multi-function multi-configurable hitch-mountable rollable rotatable collapsible tea table is (or are each):

a) When used as a kennel, capable of providing structural rigidity to the tea table (See FIG. 61B);

b) When used as a grooming station, capable of providing structural rigidity to the tea table (See FIG. 62);

c) When used as a drying platform, capable of providing structural rigidity to the tea table (See FIG. 62);

d) When used as a storage locker, capable of providing structural rigidity to the tea table (See FIG. 61A);

e) When used as a table, capable of providing structural rigidity to the tea table (See FIG. 50, FIG. 51, FIG. 53B, FIG. 53C, FIG. 63, and FIG. 64); and f) When used as a cooler, capable of providing structural rigidity to the tea table (See FIG. 20D).

8) It is yet still an even further object of the new invention to provide (a or an) five-device-in-one multi-function multi-configurable hitch-mountable rollable rotatable collapsible tea table, having tow-hitch-attaching fence-post-attaching truck-utility-hole-inserting umbrella-pole-receiver shaft 116.

Therefore, the five-device-in-one multi-function multi-configurable hitch-mountable rollable rotatable collapsible tea table is (or are each):

a) Capable of vertically attaching an umbrella pole for shade and/or privacy (see FIG. 54 and FIG. 63);

b) Capable of horizontally attaching an umbrella pole to be used for shade and/or privacy (see FIG. 65A and FIG. 68);

c) Capable of slidably attaching to a fence post (see FIG. 69A, FIG. 69B, and FIG. 70B);

d) Capable of slidably attaching to a tow hitch receiver (see FIG. 65B, FIG. 66D, and FIG. 68); and e) Capable of slidably attaching to a utility hole of a pickup truck (see FIG. 70C).

9) It is yet still an even further object of the new invention to provide (a or an) five-device-in-one multi-function multi-configurable hitch-mountable rollable rotatable collapsible tea table, having plastic-coated waterproof-fabric water-tight reinforce-stitched walls 123.

Therefore, the five-device-in-one multi-function multi-configurable hitch-mountable rollable rotatable collapsible tea table is (or are each):

a) Capable of securely holding rocks, sand, and/or water to be a ballast to provide added stability to the tea table (see FIG. 20A, FIG. 20B, FIG. 20C, FIG. 20D, FIG. 71, FIG. 72, FIG. 73, and FIG. 74);

b) Capable of waterproofedly and insulatedly holding ice to function as a cooler (see FIG. 20D and FIG. 74);

c) Capable of securing contents when functioning as a cinch-sack
(see FIG. 75); and d) Capable of protecting contents when functioning as a backpack
(see FIG. 76).

10) It is yet still an even further object of the new invention to provide (a or an) five-device-in-one multi-function multi-configurable hitch-mountable rollable rotatable collapsible tea table, having cinchable tieable backpack cinch-sack shoulder-strap content-securing cord 125.

Therefore, the five-device-in-one multi-function multi-configurable hitch-mountable rollable rotatable collapsible tea table is (or are each):

a) Capable of cinchably securing contents inside
(see FIG. 20A, FIG. 20B, FIG. 20C, FIG. 20D, FIG. 71, FIG. 72, FIG. 73, FIG. 74, FIG. 75, and FIG. 76);

b) Capable of acting as cinching-straps when functioning as cinch-sack
(see FIG. 75); and c) Capable of wearably providing shoulder straps when functioning as a backpack
(see FIG. 76).

Other objects and advantages of the present invention will become apparent from a consideration of the accompanying drawings and ensuing description.

SUMMARY OF THE INVENTION

A five-device-in-one multi-function multi-configurable hitch-mountable rollable rotatable collapsible tea table, capable of functioning as a pet kennel, a storage locker, a table, a cooler, and an umbrella base, comprises: a top frame and a side frame and a bottom frame attached to each other, solid panels and double-sized panels and pole-receiving panels respectively slidably inserted into the top frame or the side frame providing an interchangeable surface to act as a top or wall when the tea table is functioning as a kennel and a grooming station and a pet drying platform and a storage locker and a table and a cooler, pole-receiving holes respectively drilled into the pole-receiving panels for vertically or horizontally or diagonally inserting at least one umbrella pole in multiple different locations through the tea table, a pole-receiver-shaft welded to a pole-receiver-shaft base-plate and attached to the top frame or the side frame or the bottom frame for vertically or horizontally attaching an umbrella pole for shade or privacy and for horizontally mounting a half umbrella directly against a wall and for slidably attaching to a fence post and for slidably attaching to a tow hitch receiver and for slidably attaching to a utility hole of a pickup truck, a pole-receiver-shaft bracket attached around the pole-receiver shaft and screwed to the top frame or the side frame or the bottom frame, a waterproof-fabric bag having fabric walls and cord tunnels respectively sewn to each other for securely holding rocks or sand or water to act as a ballast to provide added stability for the tea table and for waterproofingly and insulatedly holding ice to function as a cooler and for securing and protecting contents when functioning as a cinch-sack or a backpack, and a securing cord inserted into the cord tunnels for cinchably securing and protecting contents when functioning as a cinch-sack or a backpack and for providing cinching-straps when used as a cinch-sack and for wearably providing shoulder straps when used as a backpack.

DETAILED DESCRIPTION OF THE INVENTION

Figure 1:
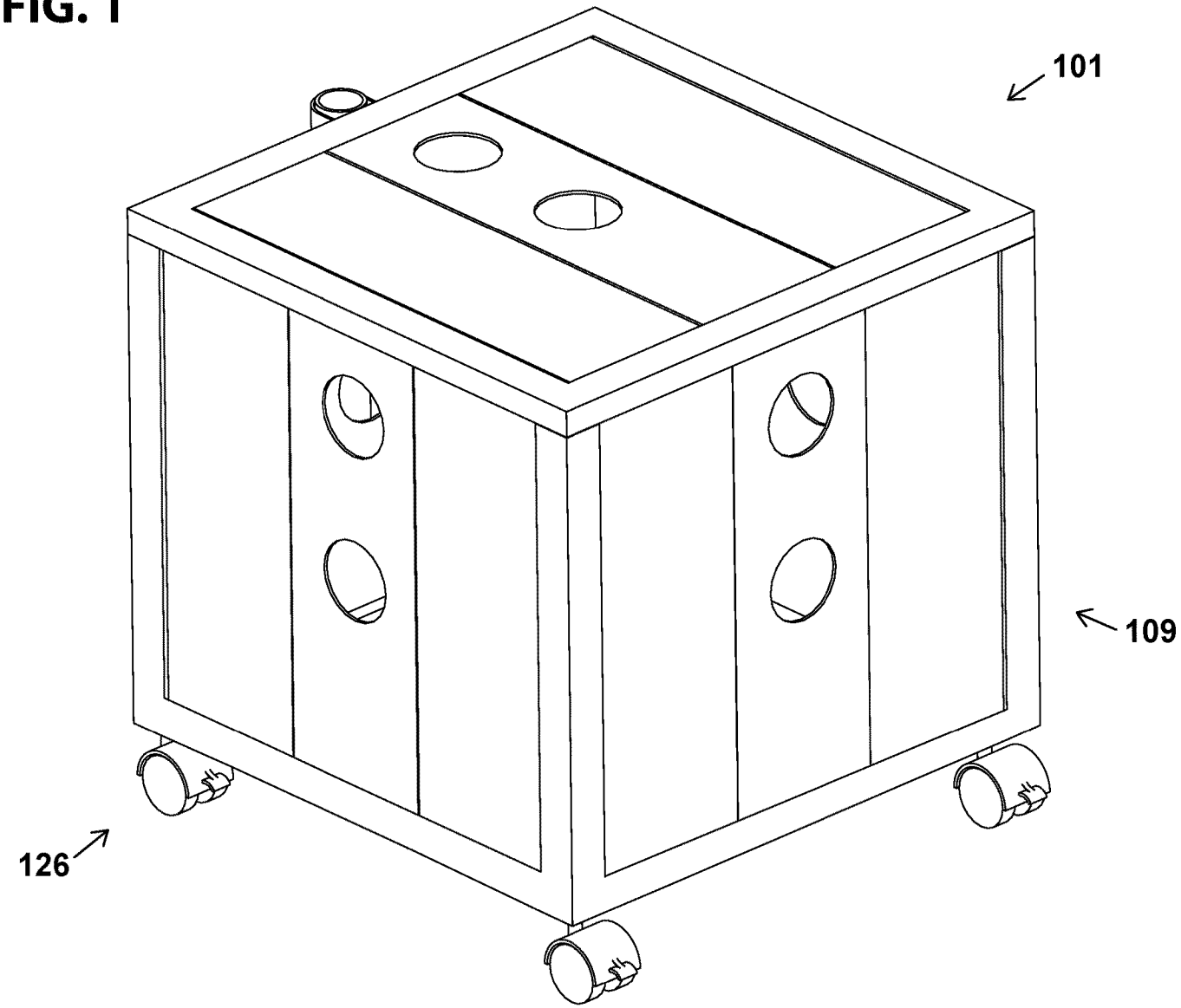
FIG. 1, FIG. 2, FIG. 3, FIG. 4, and FIG. 5 illustrate perspective, back, and top views of the five-device-in-one multi-function multi-configurable hitch-mountable rollable rotatable collapsible tea table (capable of functioning as a pet kennel, a storage locker, a table, a cooler, and an umbrella base).
Figure 2:
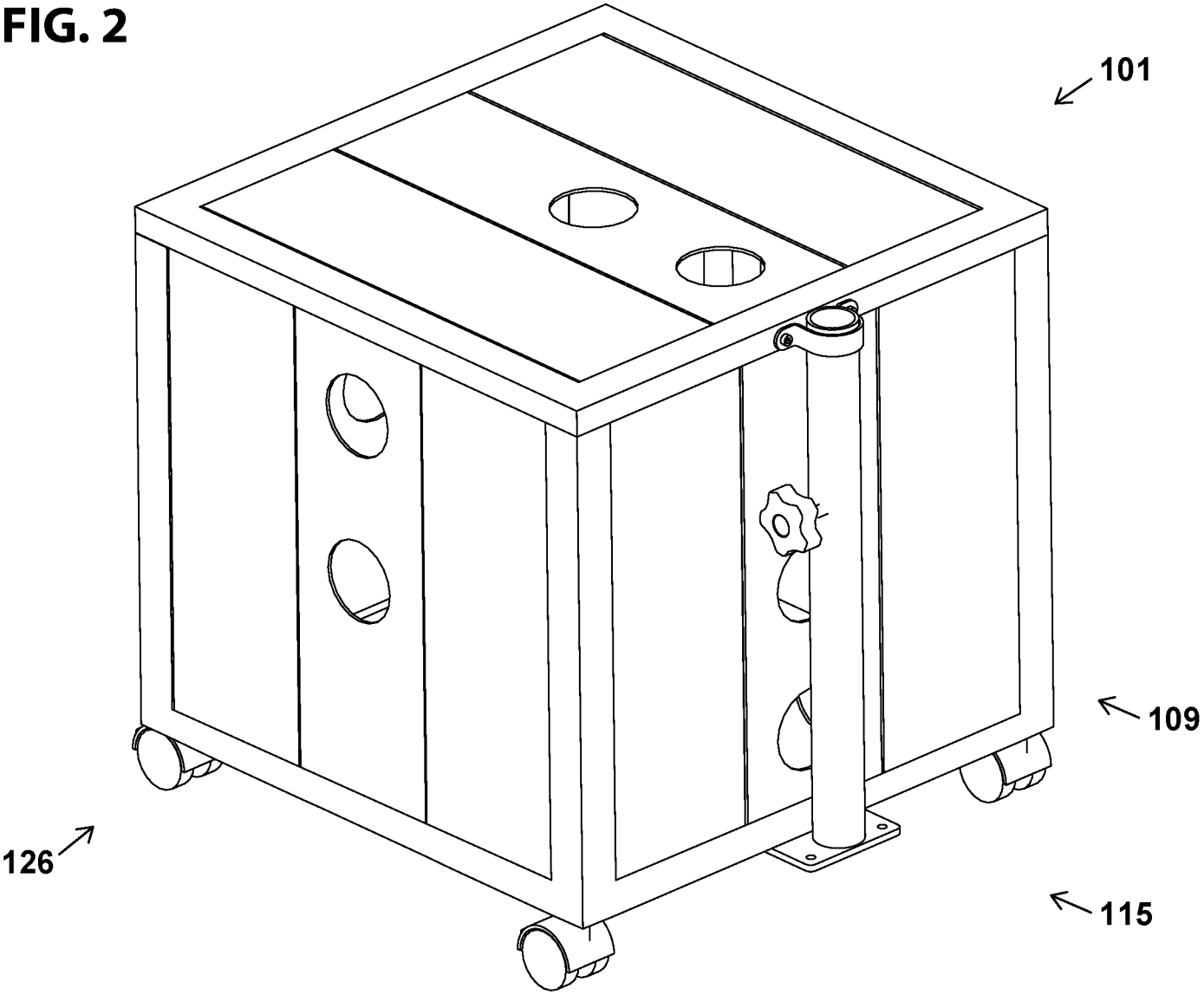
Figure 3:
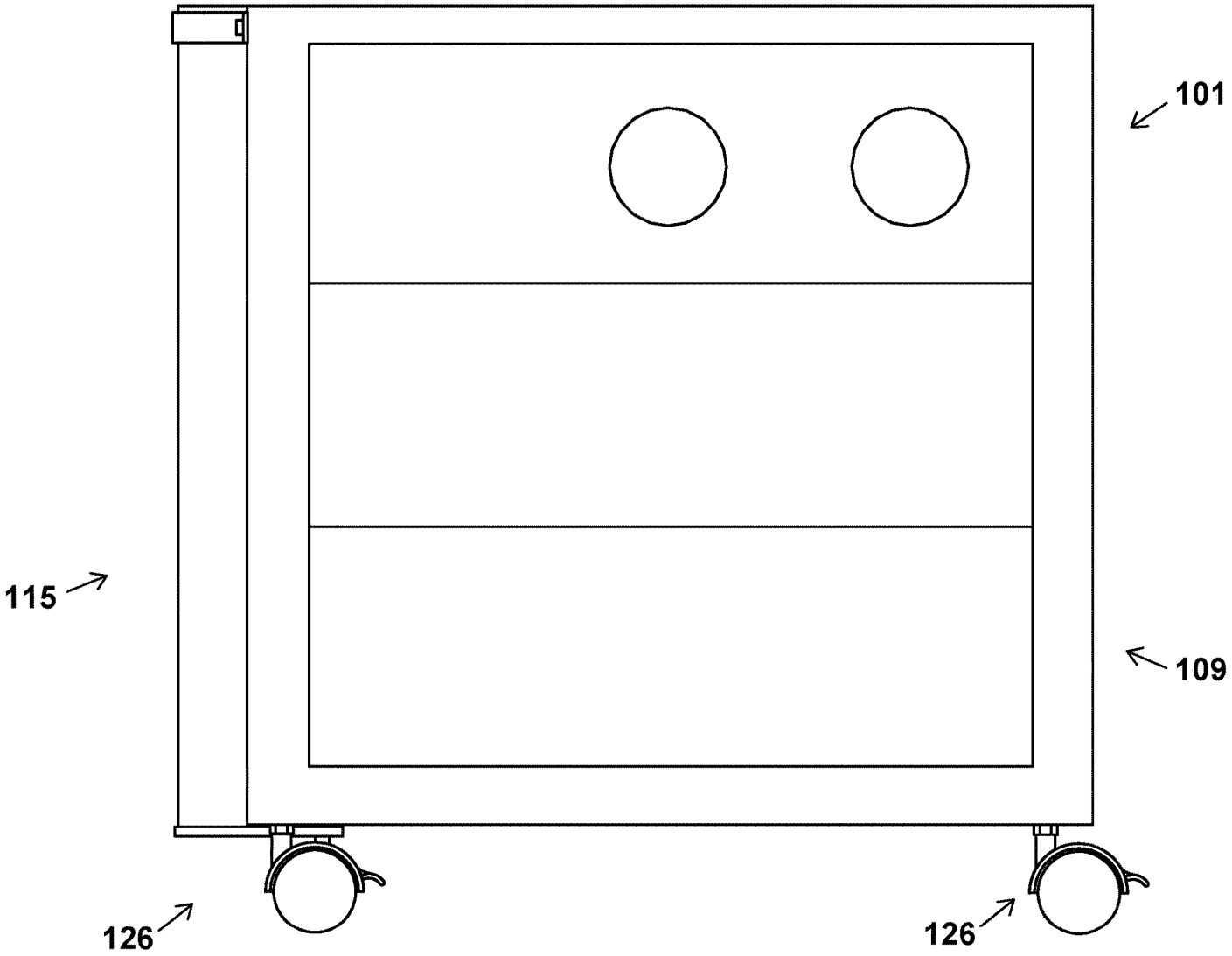
Figure 4:
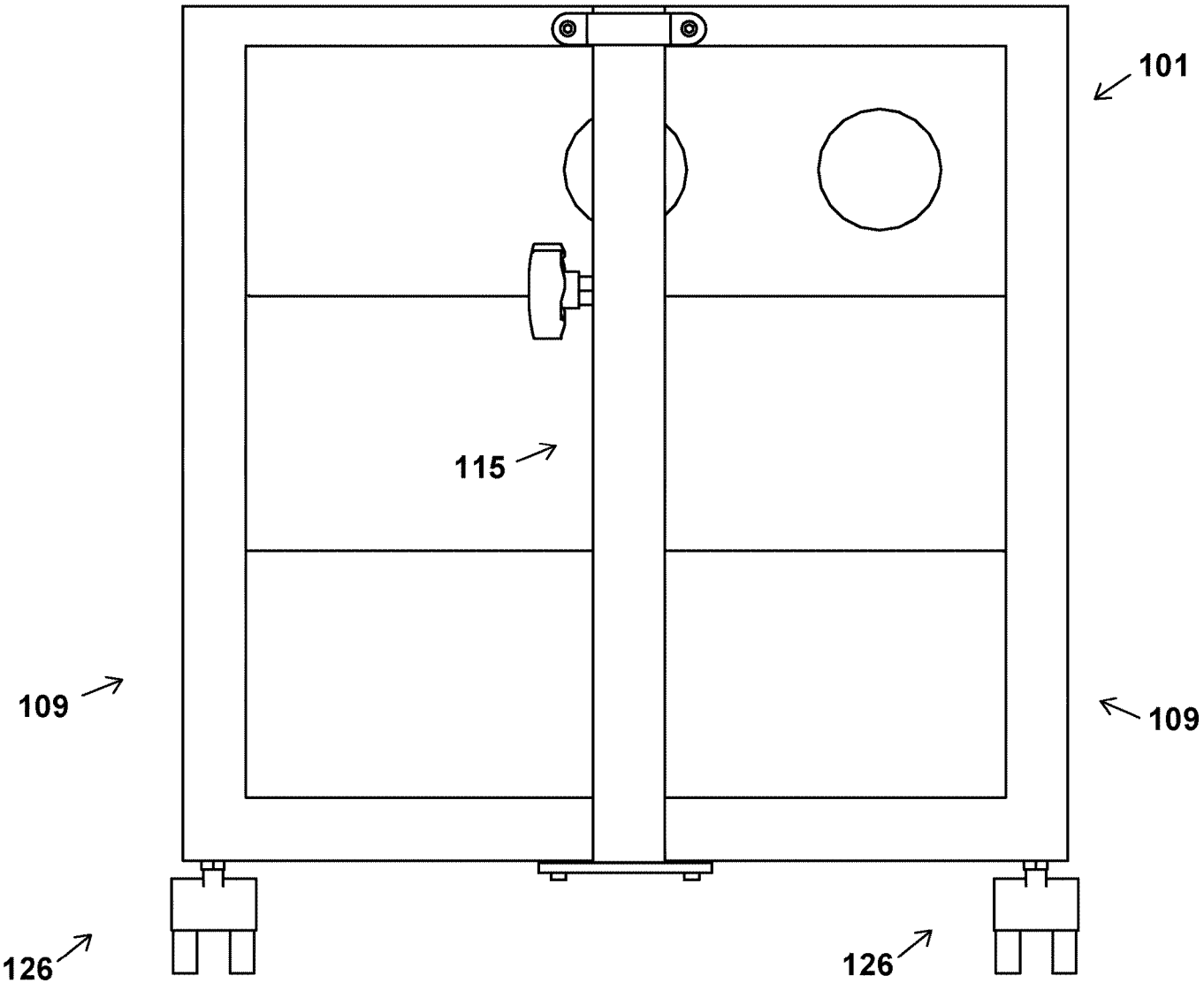
Figure 5:
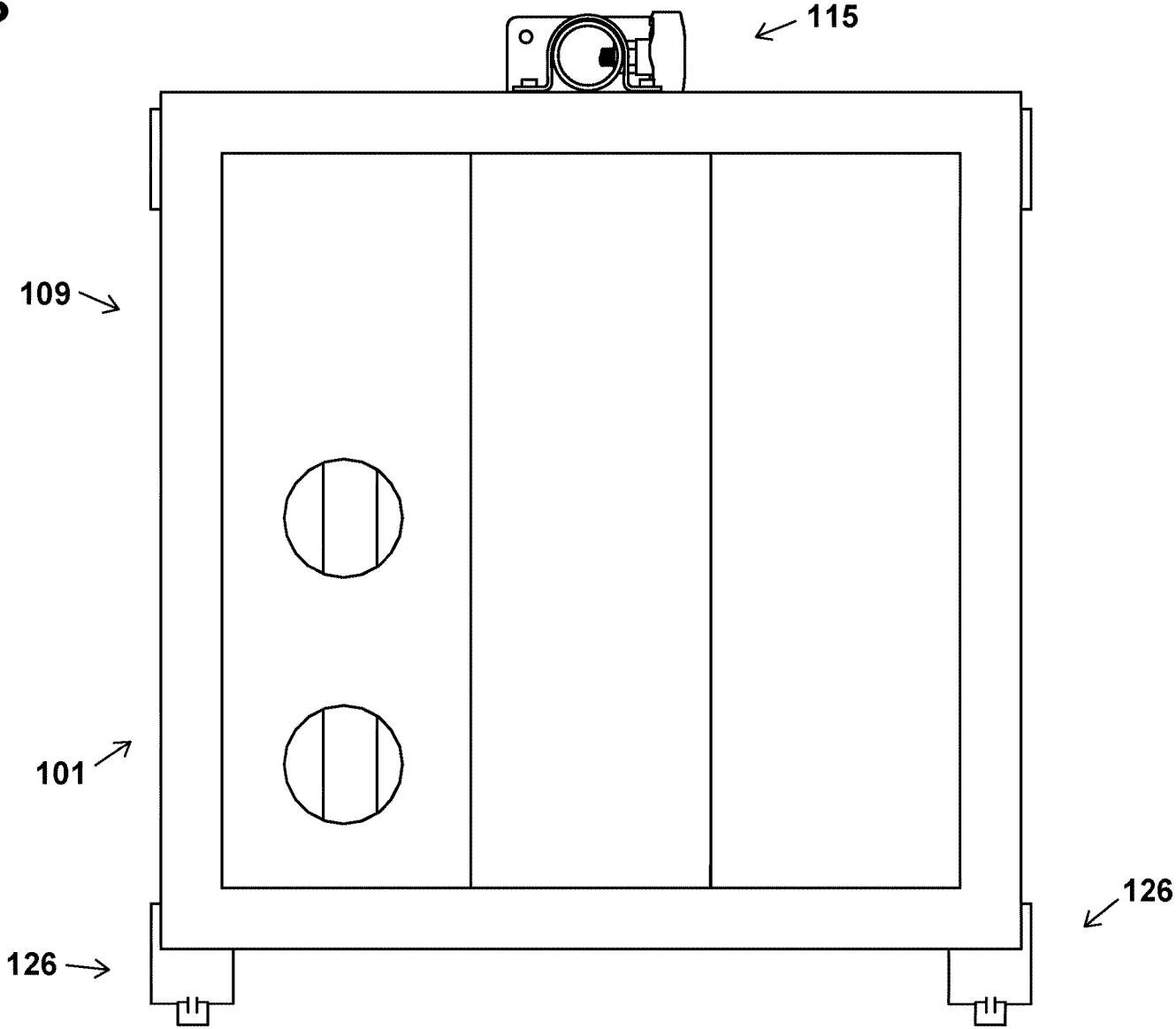
Figure 6:
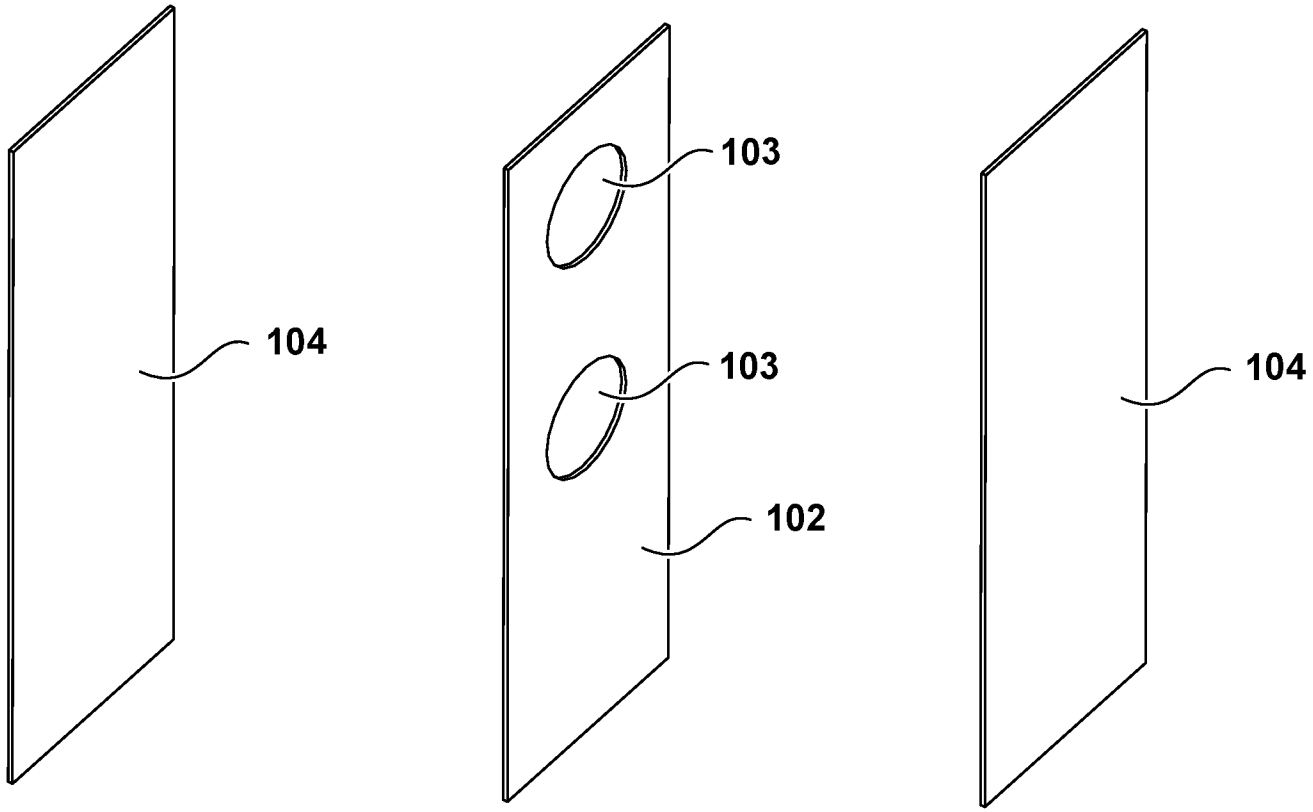
FIG. 6, FIG. 7, and FIG. 8 illustrate perspective views of the interchangeable multi-positionable slideable rotatable umbrella-pole-receiving panels 102, multi-positionable umbrella-pole-receiving holes 103, interchangeable slideable rotatable solid panels 104, and interchangeable slideable rotatable breathable ornamental double-sized panels 105.
Figure 7:
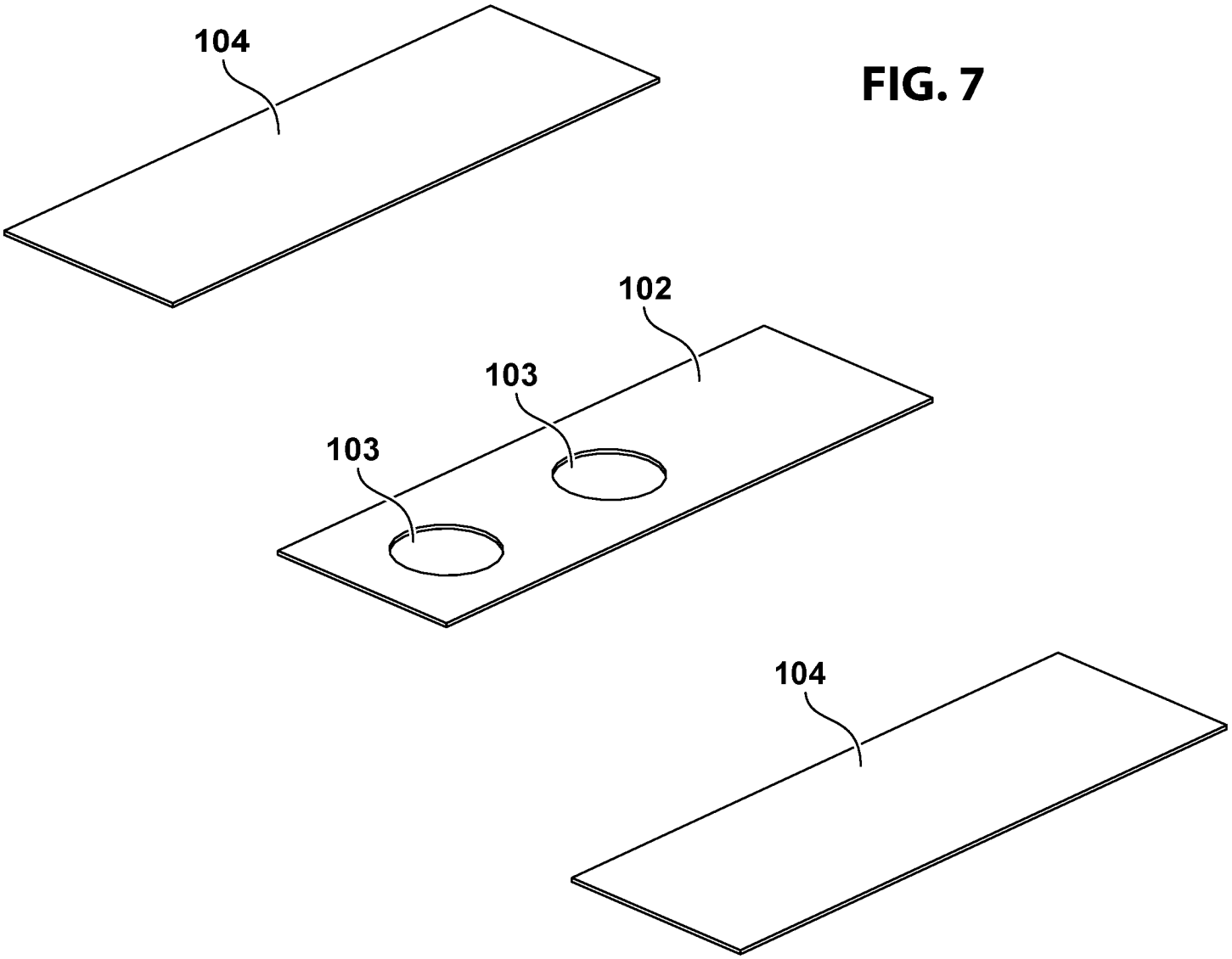
Figure 8:
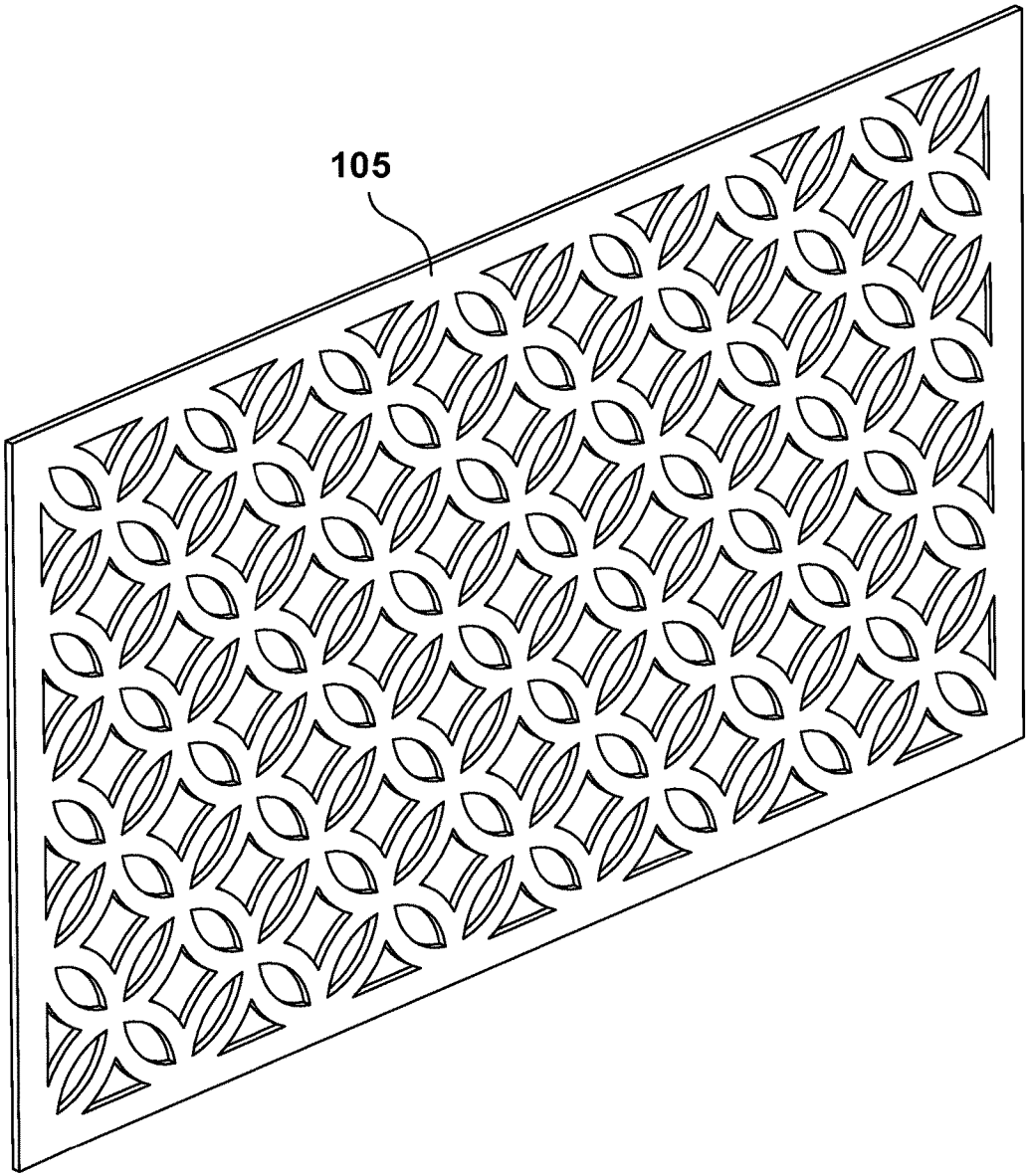
Figure 9:
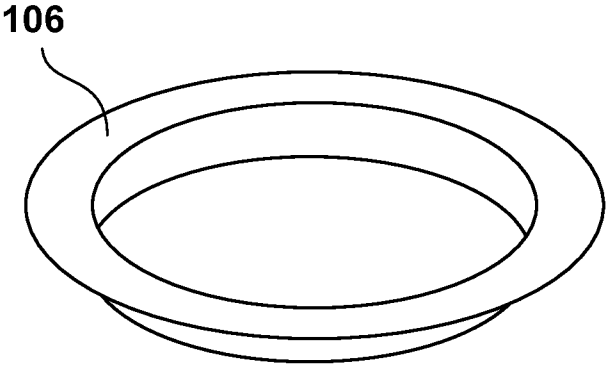
FIG. 9 and FIG. 10 illustrate perspective and top views of the pole-receiving-hole sheaths 106 and pole-receiving-hole caps 107.
Figure 10:
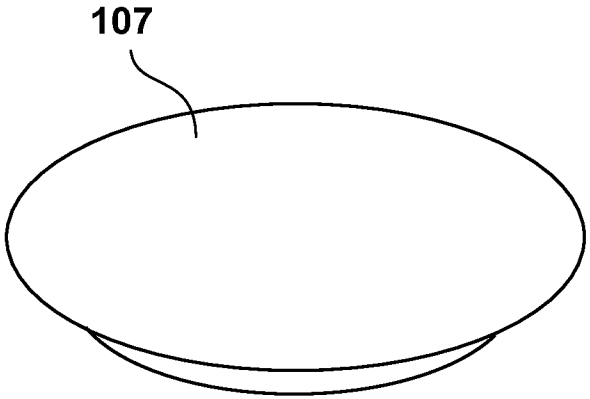

The five-device-in-one multi-function multi-configurable hitch-mountable rollable rotatable collapsible tea table (capable of functioning as a pet kennel, a storage locker, a table, a cooler, and an umbrella base) comprises:

1) Interchangeable rotatable multi-positionable panel system,
2) Panel securing tea-table umbrella-stand support frame system,
3) Adjustable rotatable tow-hitch-attaching fence-post attaching umbrella-pole receiver system,
4) Plastic-coated waterproof-fabric water-tight reinforce-stitched rock-Tillable sand-fillable water-Tillable ice-fillable cinchable backpack cinch-sack cooler ballast bag system, and
5) Lockable pivotable caster system.

Component

Referring to FIG. 1, FIG. 2, FIG. 3, FIG. 4, FIG. 5, FIG. 6, FIG. 7, FIG. 8, FIG. 9, FIG. 10, FIG. 11, FIG. 12, FIG. 13, FIG. 14, FIG. 15, FIG. 16, FIG. 17, FIG. 18, FIG. 19, FIG. 20A, FIG. 20B, FIG. 20C, FIG. 20D, FIG. 21, and FIG. 22, the five-device-in-one multi-function multi-configurable hitch-mountable rollable rotatable collapsible tea table (capable of functioning as a pet kennel, a storage locker, a table, a cooler, and an umbrella base) comprises:

1) Interchangeable rotatable multi-positionable panel system 101 comprising (or each comprising):
2) Interchangeable multi-positionable slideable rotatable umbrella-pole-receiving panels 102,
3) Multi-positionable umbrella-pole-receiving holes 103,
4) Interchangeable slideable rotatable solid panels 104,
5) Interchangeable slideable rotatable breathable ornamental double-sized panels 105,
6) Pole-receiving-hole sheaths 106,
7) Pole-receiving-hole caps 107, and
8) Panel-attaching bolts 108;
9) Panel securing tea-table umbrella-stand support frame system 109 comprising (or each comprising):
10) Top-panel-securing support frame 110,
11) Side-panel-securing support frame 111,
12) Breathable bottom support frame 112,
13) Threaded bolt holes 113, and
14) Frame-securing bolts 114;
15) Adjustable rotatable tow-hitch-attaching fence-post attaching umbrella-pole receiver system 115 comprising (or each comprising):
16) Tow-hitch-attaching fence-post-attaching truck-utility-hole-inserting umbrella-pole-receiver shaft 116,
17) Tow-hitch-attaching fence-post-attaching umbrella-pole-receiver-shaft-securing bracket 117,
18) Tow-hitch-attaching fence-post-attaching umbrella-pole-receiver-shaft-securing-bracket bolts 118,
19) Tow-hitch-attaching fence-post-attaching umbrella-pole-securing hand-screw 119,
20) Umbrella-pole-receiver-shaft-attaching base-plate 120, and
21) Base-plate-securing bolts 121;
22) Plastic-coated waterproof-fabric water-tight reinforce-stitched rock-fillable sand-fillable water-fillable ice-fillable cinchable backpack cinch-sack cooler ballast bag system 122 comprising (or each comprising):
23) Plastic-coated waterproof-fabric water-tight reinforce-stitched walls 123,
24) Plastic-coated waterproof-fabric reinforce-stitched cord tunnels 124, and
25) Cinchable tieable backpack cinch-sack shoulder-strap content-securing cord 125; and
26) Lockable pivotable caster system 126 comprising (or each comprising):
27) Pivoting locking frame-connecting caster pins 127,
28) Caster-wheel shields 128,
29) Caster-wheel-locking switches 129, and
30) Caster wheels 130.

Material

Referring to FIG. 1, FIG. 2, FIG. 3, FIG. 4, FIG. 5, FIG. 6, FIG. 7, FIG. 8, FIG. 9, FIG. 10, FIG. 11, FIG. 12, FIG. 13, FIG. 14, FIG. 15, FIG. 16, FIG. 17, FIG. 18, FIG. 19, FIG. 20A, FIG. 20B, FIG. 20C, FIG. 20D, FIG. 21, and FIG. 22:

1) Interchangeable rotatable multi-positionable panel system 101 is (or are each) made of the combined materials of its components.
2) Interchangeable multi-positionable slideable rotatable umbrella-pole-receiving panels 102 is (or are each) made of metal and/or plastic.
3) Multi-positionable umbrella-pole-receiving holes 103 is (or are each) made of empty space.
4) Interchangeable slideable rotatable solid panels 104 is (or are each) made of metal and/or plastic.
5) Interchangeable slideable rotatable breathable ornamental double-sized panels 105 is (or are each) made of metal and/or plastic.
6) Pole-receiving-hole sheaths 106 is (or are each) made of plastic.
7) Pole-receiving-hole caps 107 is (or are each) made of plastic.
8) Panel-attaching bolts 108 is (or are each) made of metal.
9) Panel securing tea-table umbrella-stand support frame system 109 is (or are each) made of the combined materials of its components.
10) Top-panel-securing support frame 110 is (or are each) made of metal.
11) Side-panel-securing support frame 111 is (or are each) made of metal.
12) Breathable bottom support frame 112 is (or are each) made of metal.
13) Threaded bolt holes 113 is (or are each) made of empty space.
14) Frame-securing bolts 114 is (or are each) made of metal.
15) Adjustable rotatable tow-hitch-attaching fence-post attaching umbrella-pole receiver system 115 is (or are each) made of the combined materials of its components.
16) Tow-hitch-attaching fence-post-attaching truck-utility-hole-inserting umbrella-pole-receiver shaft 116 is (or are each) made of metal.
17) Tow-hitch-attaching fence-post-attaching umbrella-pole-receiver-shaft-securing bracket 117 is (or are each) made of metal.
18) Tow-hitch-attaching fence-post-attaching umbrella-pole-receiver-shaft-securing-bracket bolts 118 is (or are each) made of metal.
19) Tow-hitch-attaching fence-post-attaching umbrella-pole-securing hand-screw 119 is (or are each) made of metal and plastic.
20) Umbrella-pole-receiver-shaft-attaching base-plate 120 is (or are each) made of metal.
21) Base-plate-securing bolts 121 is (or are each) made of metal.
22) Plastic-coated waterproof-fabric water-tight reinforce-stitched rock-fillable sand-fillable water-fillable ice-fillable cinchable backpack cinch-sack cooler ballast bag system 122 is (or are each) made of the combined materials of its components.

23) Plastic-coated waterproof-fabric water-tight reinforce-stitched walls 123 is (or are each) made of waterproof-coated fabric.

24) Plastic-coated waterproof-fabric reinforce-stitched cord tunnels 124 is (or are each) made of waterproof-coated fabric.

25) Cinchable tieable backpack cinch-sack shoulder-strap content-securing cord 125 is (or are each) made of flexible cord.

26) Lockable pivotable caster system 126 is (or are each) made of the combined materials of its components.

27) Pivoting locking frame-connecting caster pins 127 is (or are each) made of metal.

28) Caster-wheel shields 128 is (or are each) made of plastic and/or metal.

29) Caster-wheel-locking switches 129 is (or are each) made of plastic and/or metal.

30) Caster wheels 130 is (or are each) made of plastic and/or metal.

Shape

Referring to FIG. 1, FIG. 2, FIG. 3, FIG. 4, FIG. 5, FIG. 6, FIG. 7, FIG. 8, FIG. 9, FIG. 10, FIG. 11, FIG. 12, FIG. 13, FIG. 14, FIG. 15, FIG. 16, FIG. 17, FIG. 18, FIG. 19, FIG. 20A, FIG. 20B, FIG. 20C, FIG. 20D, FIG. 21, and FIG. 22:

1) Interchangeable rotatable multi-positionable panel system 101 is (or are each) formed into the combined shapes of its components.

2) Interchangeable multi-positionable slideable rotatable umbrella-pole-receiving panels 102 is (or are each) formed into a rectangular shape.

3) Multi-positionable umbrella-pole-receiving holes 103 is (or are each) formed into a round-hole shape.

4) Interchangeable slideable rotatable solid panels 104 is (or are each) formed into a rectangular shape.

5) Interchangeable slideable rotatable breathable ornamental double-sized panels 105 is (or are each) formed into a rectangular shape.

6) Pole-receiving-hole sheaths 106 is (or are each) formed into a round shape.

7) Pole-receiving-hole caps 107 is (or are each) formed into a round shape.

8) Panel-attaching bolts 108 is (or are each) formed into a threaded cylindrical shape.

9) Panel securing tea-table umbrella-stand support frame system 109 is (or are each) formed into the combined shapes of its components.

10) Top-panel-securing support frame 110 is (or are each) formed into a square with a square cross-sectional tube shape.

11) Side-panel-securing support frame 111 is (or are each) formed into a square with a square cross-sectional tube shape.

12) Breathable bottom support frame 112 is (or are each) formed into a square with a square cross-sectional tube shape.

13) Threaded bolt holes 113 is (or are each) formed into a round shape.

14) Frame-securing bolts 114 is (or are each) formed into a threaded cylindrical shape.

15) Adjustable rotatable tow-hitch-attaching fence-post attaching umbrella-pole receiver system 115 is (or are each) formed into the combined shapes of its components.

16) Tow-hitch-attaching fence-post-attaching truck-utility-hole-inserting umbrella-pole-receiver shaft 116 is (or are each) formed into a pipe with round cross-sectional shape.

17) Tow-hitch-attaching fence-post-attaching umbrella-pole-receiver-shaft-securing bracket 117 is (or are each) formed into a semi-circular shape.

18) Tow-hitch-attaching fence-post-attaching umbrella-pole-receiver-shaft-securing-bracket bolts 118 is (or are each) formed into a threaded cylindrical shape.

19) Tow-hitch-attaching fence-post-attaching umbrella-pole-securing hand-screw 119 is (or are each) formed into a star shape.

20) Umbrella-pole-receiver-shaft-attaching base-plate 120 is (or are each) formed into a rectangular shape.

21) Base-plate-securing bolts 121 is (or are each) formed into a threaded cylindrical shape.

22) Plastic-coated waterproof-fabric water-tight reinforce-stitched rock-fillable sand-fillable water-fillable ice-fillable cinchable backpack cinch-sack cooler ballast bag system 122 is (or are each) formed into the combined shapes of its components.

23) Plastic-coated waterproof-fabric water-tight reinforce-stitched walls 123 is (or are each) formed into a fabric wall shape.

24) Plastic-coated waterproof-fabric reinforce-stitched cord tunnels 124 is (or are each) formed into a fabric tunnel shape.

25) Cinchable tieable backpack cinch-sack shoulder-strap content-securing cord 125 is (or are each) formed into a cord shape.

26) Lockable pivotable caster system 126 is (or are each) formed into the combined shapes of its components.

27) Pivoting locking frame-connecting caster pins 127 is (or are each) formed into a cylindrical shape.

28) Caster-wheel shields 128 is (or are each) formed into a semi-circular shape.

29) Caster-wheel-locking switches 129 is (or are each) formed into a quarter-circle shape.

30) Caster wheels 130 is (or are each) formed into a round shape.

Connection

Referring to FIG. 1, FIG. 2, FIG. 3, FIG. 4, FIG. 5, FIG. 6, FIG. 7, FIG. 8, FIG. 9, FIG. 10, FIG. 11, FIG. 12, FIG. 13, FIG. 14, FIG. 15, FIG. 16, FIG. 17, FIG. 18, FIG. 19, FIG. 20A, FIG. 20B, FIG. 20C, FIG. 20D, FIG. 21, and FIG. 22:

1) Interchangeable rotatable multi-positionable panel system 101 is (or are respectively) connected by the combined connections of its components.

2) Interchangeable multi-positionable slideable rotatable umbrella-pole-receiving panels 102 is (or are respectively) slidably inserted into top-panel-securing support frame 110 and/or side-panel-securing support frame 111.

3) Multi-positionable umbrella-pole-receiving holes 103 is (or are respectively) drilled into interchangeable multi-positionable slideable rotatable umbrella-pole-receiving panels 102.

4) Interchangeable slideable rotatable solid panels 104 is (or are respectively) slidably inserted into top-panel-securing support frame 110 and/or side-panel-securing support frame 111.

5) Interchangeable slideable rotatable breathable ornamental double-sized panels 105 is (or are respectively) slidably inserted into top-panel-securing support frame 110 and/or side-panel-securing support frame 111.

6) Pole-receiving-hole sheaths 106 is (or are respectively) inserted into multi-positionable umbrella-pole-receiving holes 103.

7) Pole-receiving-hole caps 107 is (or are respectively) inserted into pole-receiving-hole sheaths 106.

8) Panel-attaching bolts 108 is (or are respectively) screwed into threaded bolt holes 113.

9) Panel securing tea-table umbrella-stand support frame system 109 is (or are respectively) connected by the combined connections of its components.

10) Top-panel-securing support frame 110 is (or are respectively) attached to side-panel-securing support frame 111.

11) Side-panel-securing support frame 111 is (or are respectively) attached to top-panel-securing support frame 110 and breathable bottom support frame 112.

12) Breathable bottom support frame 112 is (or are respectively) attached to side-panel-securing support frame 111.

13) Threaded bolt holes 113 is (or are respectively) drilled into top-panel-securing support frame 110, side-panel-securing support frame 111, and breathable bottom support frame 112.

14) Frame-securing bolts 114 is (or are respectively) screwed into threaded bolt holes 113.

15) Adjustable rotatable tow-hitch-attaching fence-post attaching umbrella-pole receiver system 115 is (or are respectively) connected by the combined connections of its components.

16) Tow-hitch-attaching fence-post-attaching truck-utility-hole-inserting umbrella-pole-receiver shaft 116 is (or are respectively) welded to umbrella-pole-receiver-shaft-attaching base-plate 120.

17) Tow-hitch-attaching fence-post-attaching umbrella-pole-receiver-shaft-securing bracket 117 is (or are respectively) attached around tow-hitch-attaching fence-post-attaching truck-utility-hole-inserting umbrella-pole-receiver shaft 116 to top-panel-securing support frame 110, side-panel-securing support frame 111, and/or breathable bottom support frame 112.

18) Tow-hitch-attaching fence-post-attaching umbrella-pole-receiver-shaft-securing-bracket bolts 118 is (or are respectively) screwed into threaded bolt holes 113.

19) Tow-hitch-attaching fence-post-attaching umbrella-pole-securing hand-screw 119 is (or are respectively) screwed into tow-hitch-attaching fence-post-attaching truck-utility-hole-inserting umbrella-pole-receiver shaft 116.

20) Umbrella-pole-receiver-shaft-attaching base-plate 120 is (or are respectively) welded to tow-hitch-attaching fence-post-attaching truck-utility-hole-inserting umbrella-pole-receiver shaft 116.

21) Base-plate-securing bolts 121 is (or are respectively) screwed through umbrella-pole-receiver-shaft-attaching base-plate 120 into threaded bolt holes 113.

22) Plastic-coated waterproof-fabric water-tight reinforce-stitched rock-fillable sand-fillable water-fillable ice-fillable cinchable backpack cinch-sack cooler ballast bag system 122 is (or are respectively) connected by the combined connections of its components.

23) Plastic-coated waterproof-fabric water-tight reinforce-stitched walls 123 is (or are respectively) sewn to each other.

24) Plastic-coated waterproof-fabric reinforce-stitched cord tunnels 124 is (or are respectively) sewn into plastic-coated waterproof-fabric water-tight reinforce-stitched walls 123.

25) Cinchable tieable backpack cinch-sack shoulder-strap content-securing cord 125 is (or are respectively) inserted into plastic-coated waterproof-fabric reinforce-stitched cord tunnels 124.

26) Lockable pivotable caster system 126 is (or are respectively) connected by the combined connections of its components.

27) Pivoting locking frame-connecting caster pins 127 is (or are respectively) lockably inserted into the bottom of side-panel-securing support frame 111.

28) Caster-wheel shields 128 is (or are respectively) attached to pivoting locking frame-connecting caster pins 127.

29) Caster-wheel-locking switches 129 is (or are respectively) switchably attached to caster-wheel shields 128.

30) Caster wheels 130 is (or are respectively) rotatably attached to caster-wheel shields 128.

Function

Referring to FIG. 23, FIG. 24, FIG. 25, FIG. 26, FIG. 27, FIG. 28, FIG. 29, FIG. 30, FIG. 31, FIG. 32, FIG. 33, FIG. 34, FIG. 35, FIG. 36, FIG. 37, FIG. 38, FIG. 39, FIG. 40, FIG. 41, FIG. 42, FIG. 43, FIG. 44, FIG. 45, FIG. 46, FIG. 47, FIG. 48, FIG. 49, FIG. 50, FIG. 51, FIG. 52, FIG. 53A, FIG. 53B, FIG. 53C, FIG. 54, FIG. 55, FIG. 56, FIG. 57, FIG. 58, FIG. 59, FIG. 60, FIG. 61A, FIG. 61B, FIG. 62, FIG. 63, FIG. 64, FIG. 65A, FIG. 65B, FIG. 66A, FIG. 66B, FIG. 66C, FIG. 66D, FIG. 67A, FIG. 67B, FIG. 67C, FIG. 68, FIG. 69A, FIG. 69B, FIG. 70A, FIG. 70B, FIG. 70C, FIG. 71, FIG. 72, FIG. 73, FIG. 74, FIG. 75, and FIG. 76:

1) Interchangeable rotatable multi-positionable panel system 101 is (or are respectively) for performing the combined functions of its components.

Figure 20A:
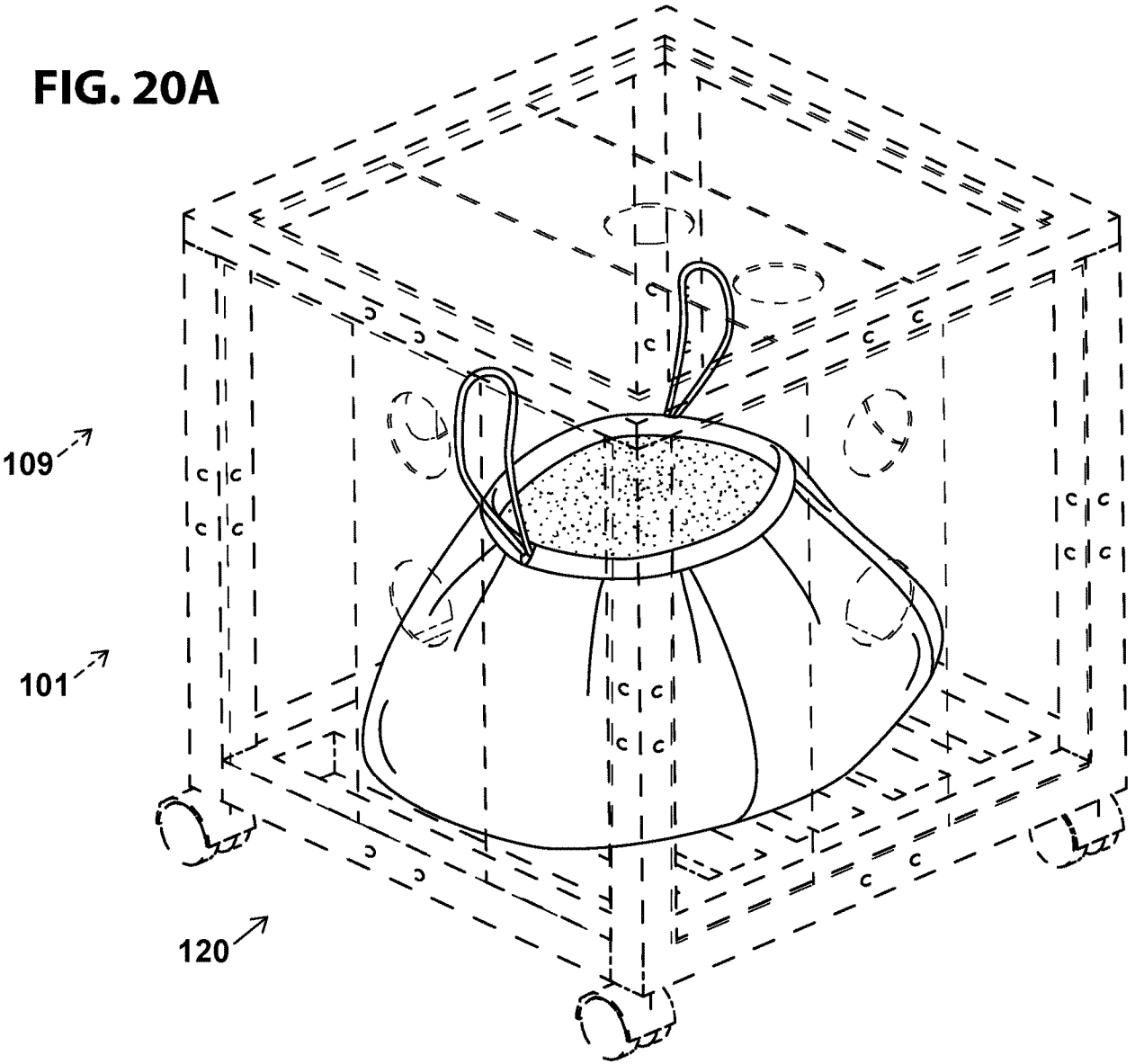
Figure 20B:
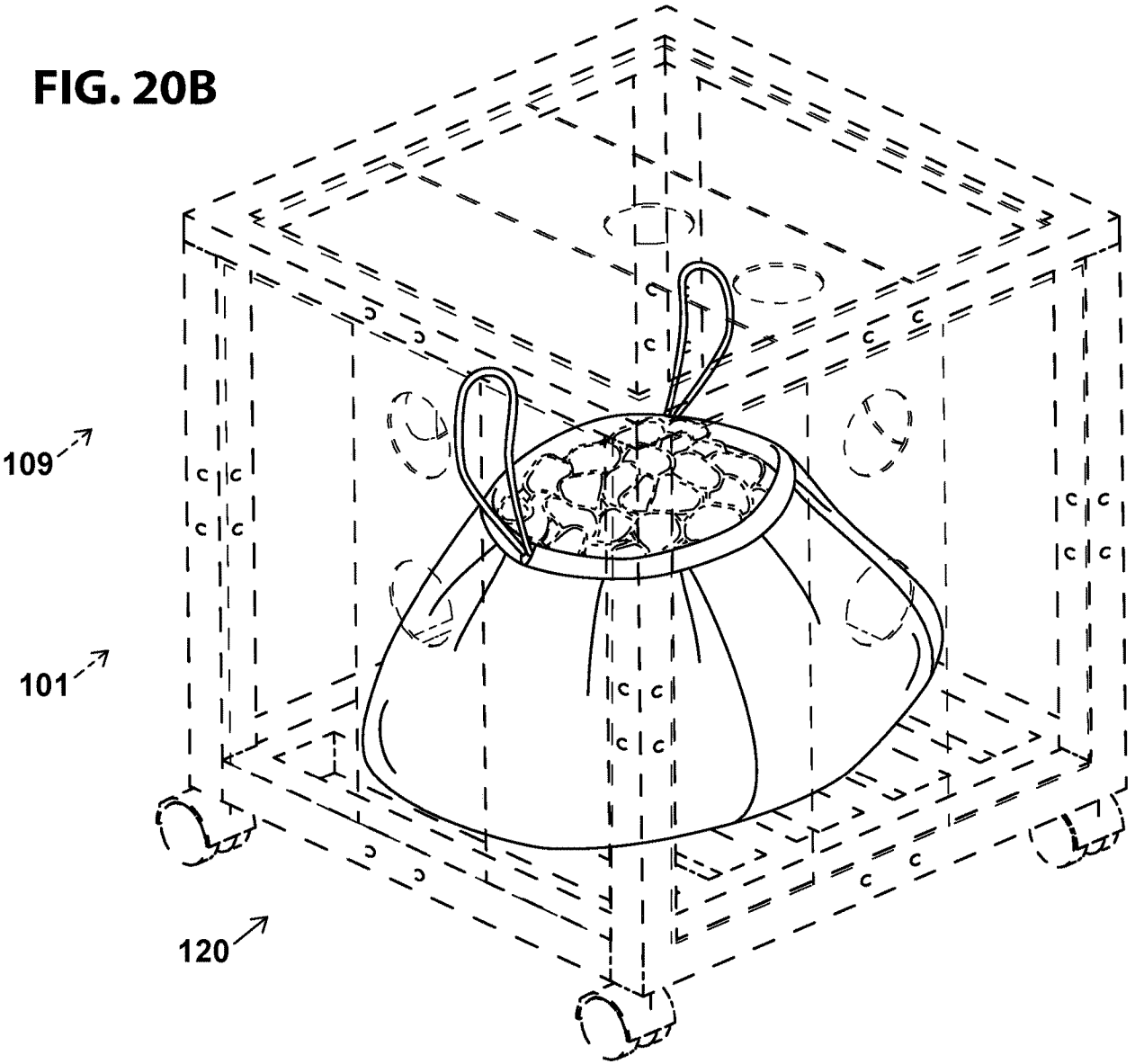
Figure 20C:
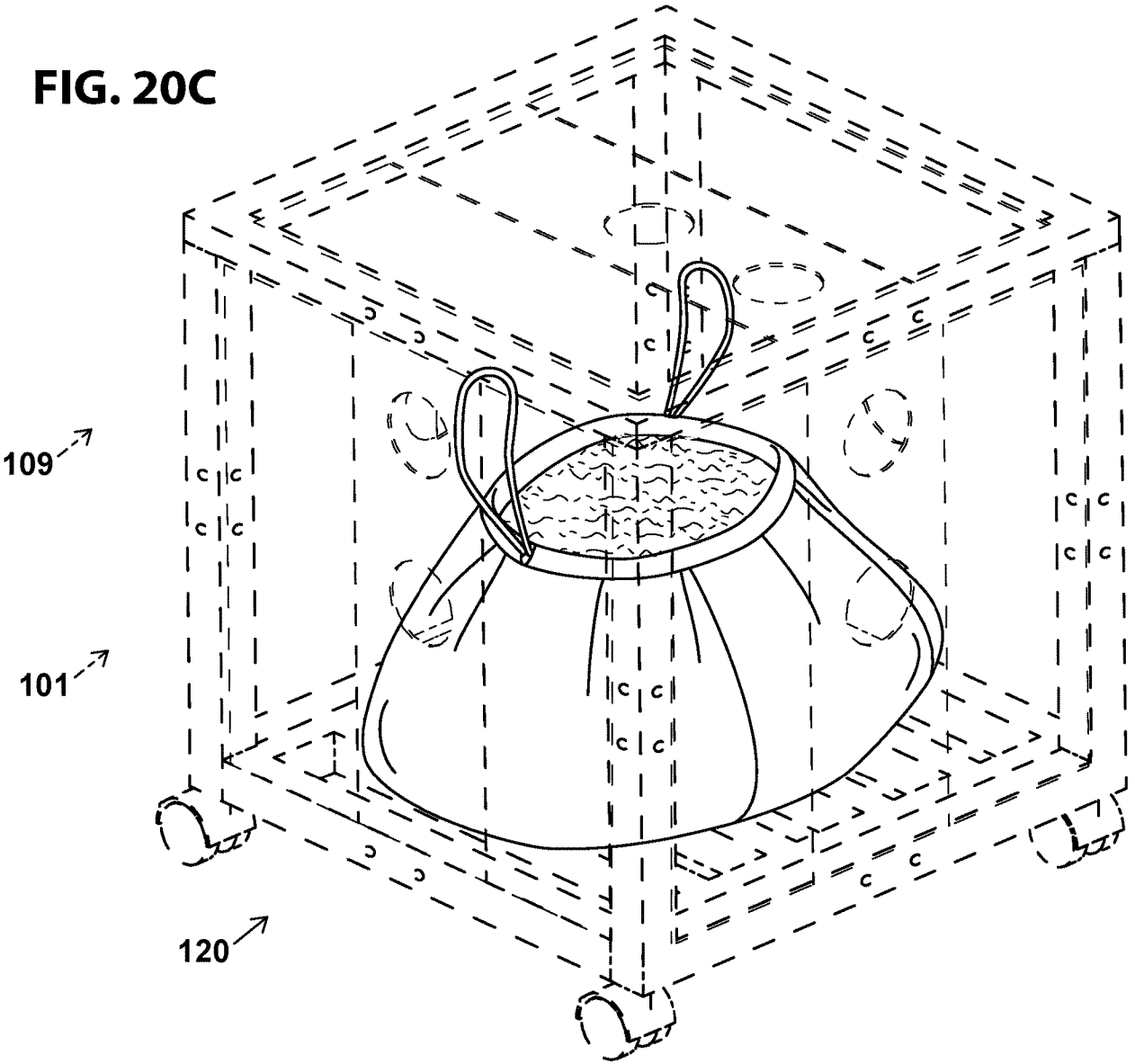
Figure 20D:
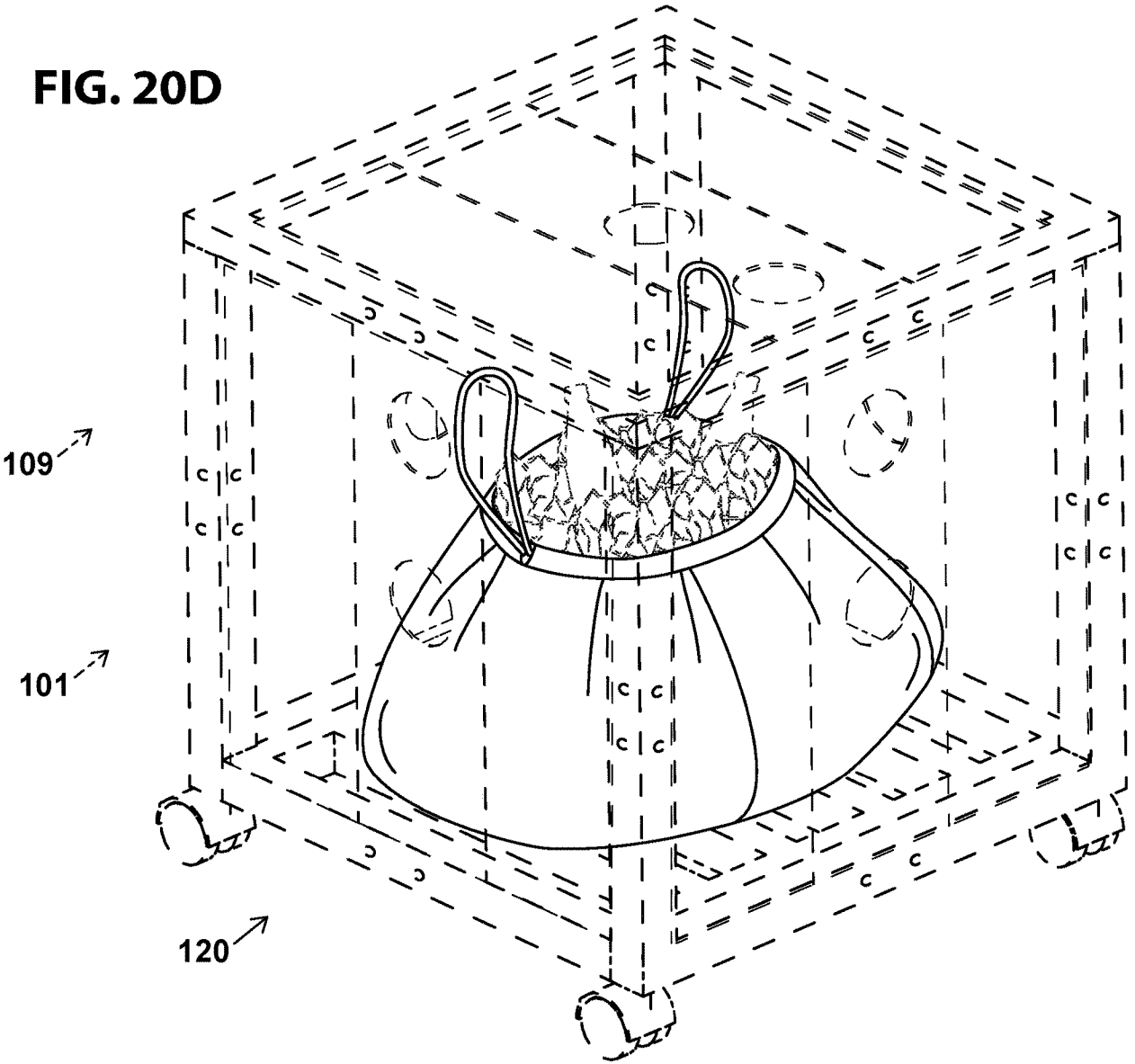
Figure 22:
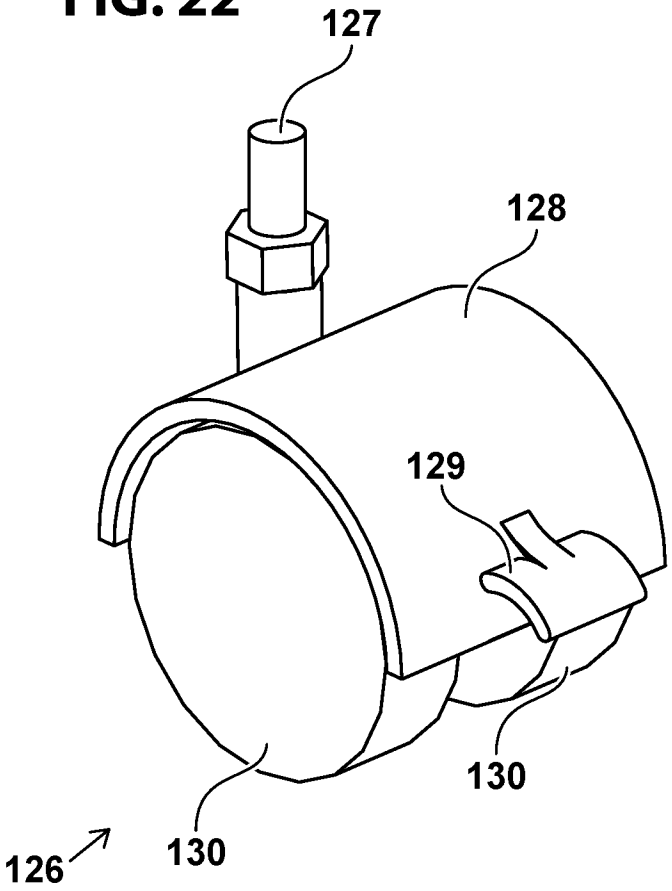
FIG. 21 and FIG. 22 illustrate perspective views of lockable pivotable caster system 126.
Figure 21:
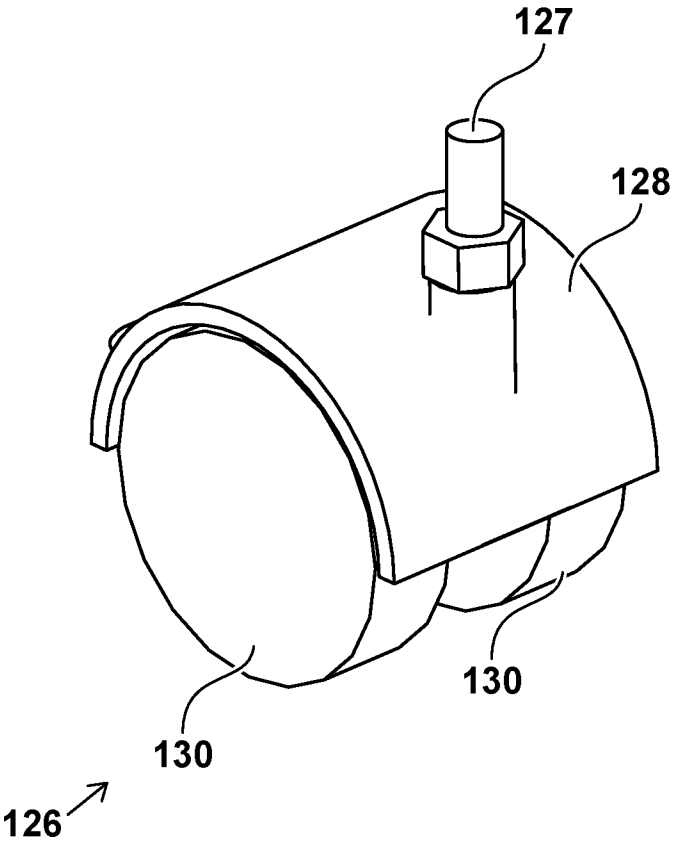
Figure 23:
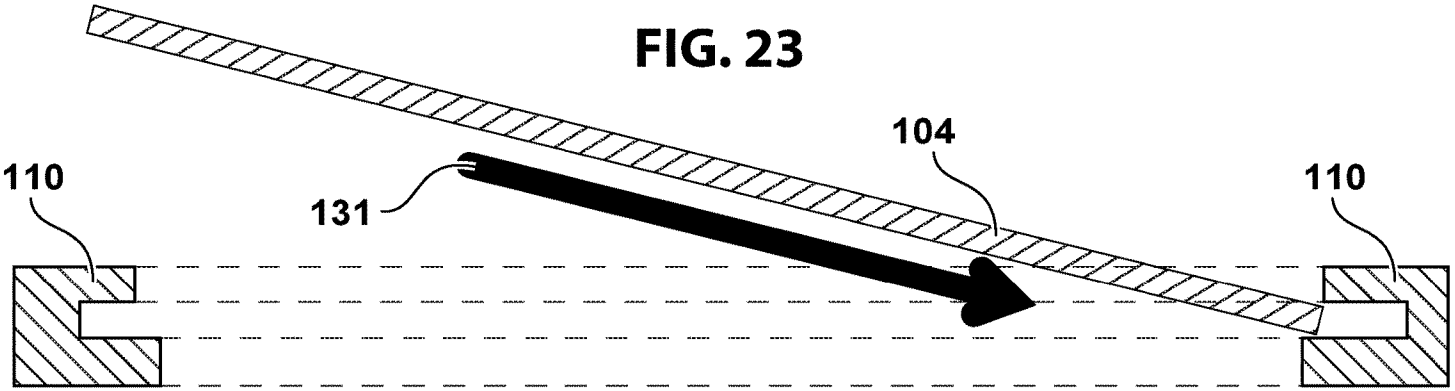
FIG. 23, FIG. 24, and FIG. 25 illustrate side cross-sectional views demonstrating how interchangeable multi-positionable slideable rotatable umbrella-pole-receiving panels 102, interchangeable slideable rotatable solid panels 104, and/or interchangeable slideable rotatable breathable ornamental double-sized panels 105 are reconfigurably attached to top-panel-securing support frame 110.
Figure 24:
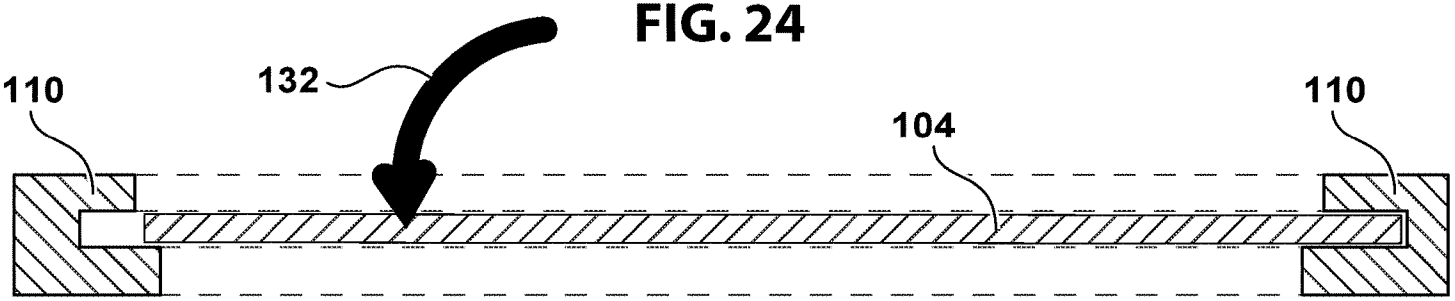
Figure 25:
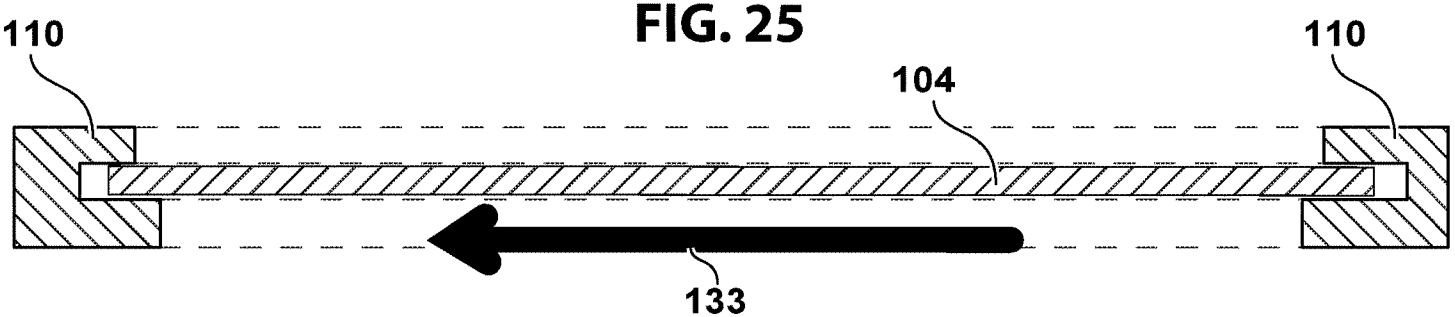
Figure 27:
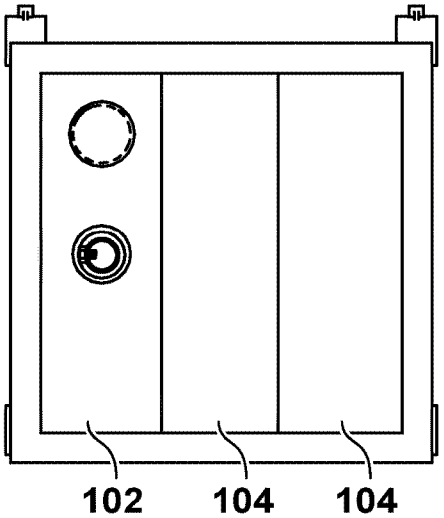
FIG. 26, FIG. 27, FIG. 28, FIG. 29, FIG. 30, FIG. 31, FIG. 32, FIG. 33, FIG. 34, FIG. 35, FIG. 36, and FIG. 37 illustrate top views of various arrangement possibilities of interchangeable multi-positionable slideable rotatable umbrella-pole-receiving panels 102 and interchangeable slideable rotatable solid panels 104 within top-panel-securing support frame 110.
Figure 26:
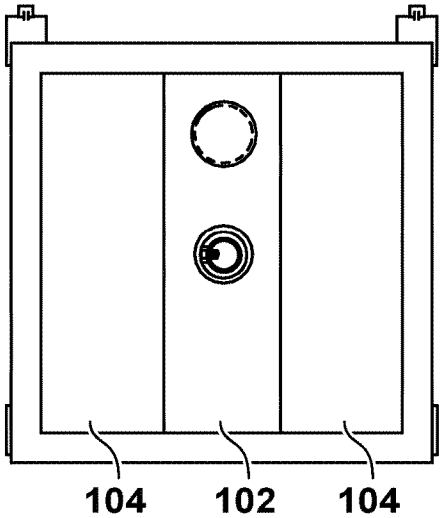
Figure 28:
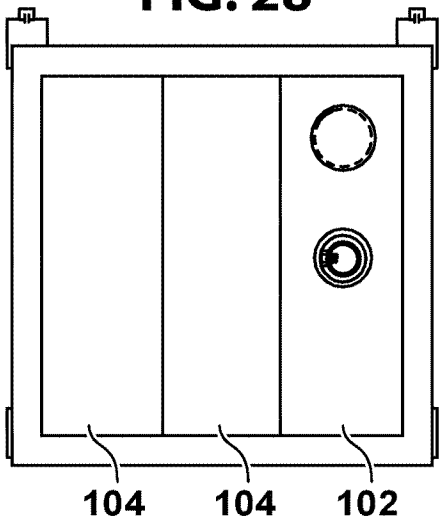
Figure 30:
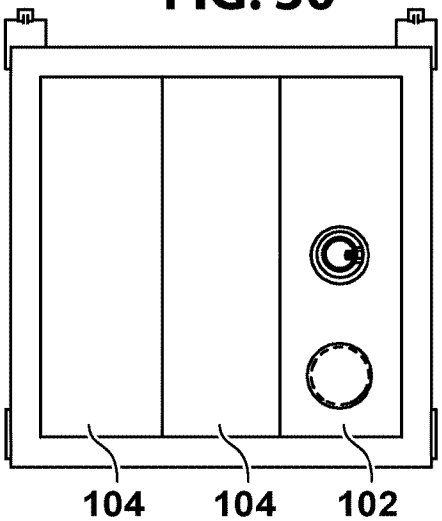
Figure 29:
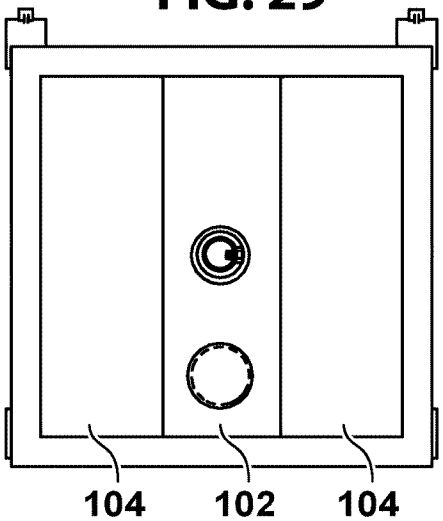
Figure 31:
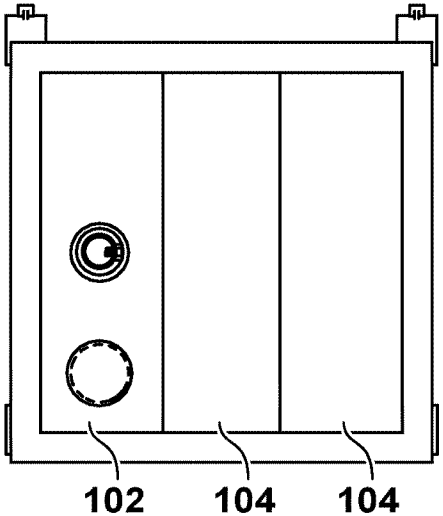
Figure 33:
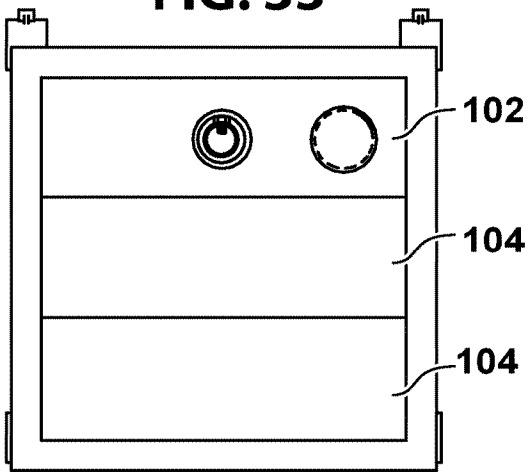
Figure 32:
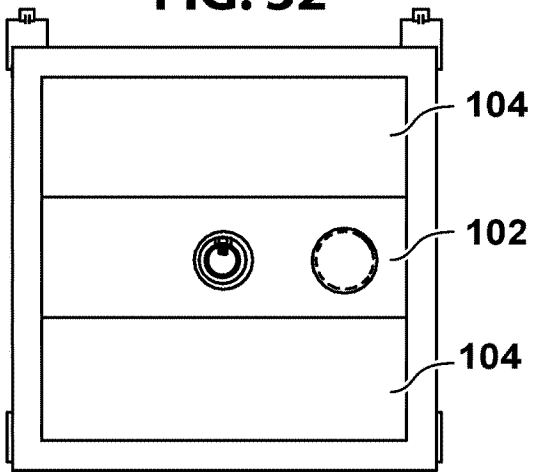
Figure 34:
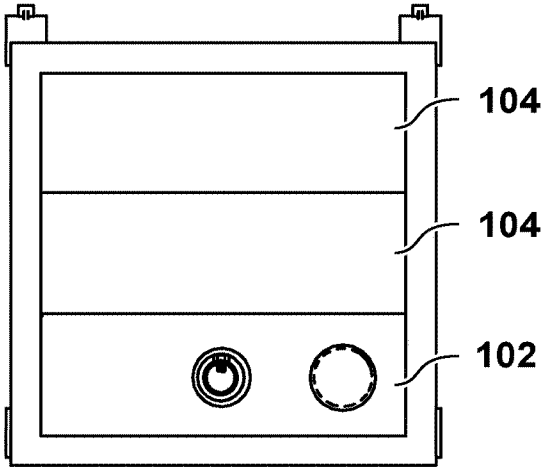
Figure 36:
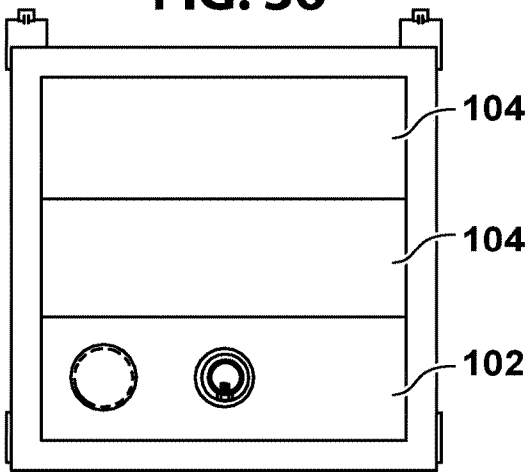
Figure 35:
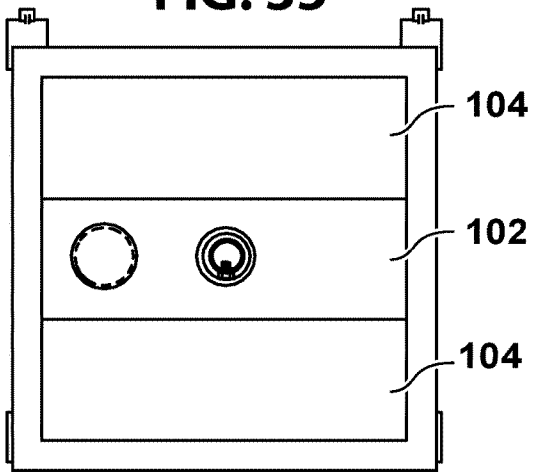
Figure 37:
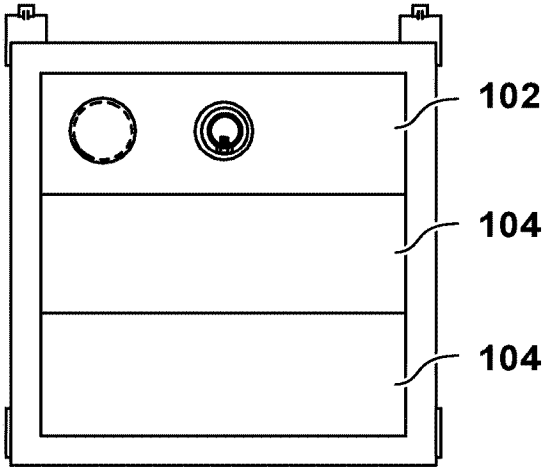
Figure 39:
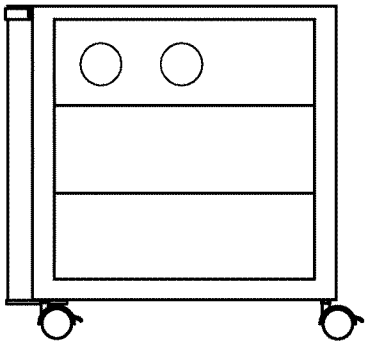
FIG. 38, FIG. 39, FIG. 40, FIG. 41, FIG. 42, FIG. 43, FIG. 44, FIG. 45, FIG. 46, FIG. 47, FIG. 48, and FIG. 49 illustrate side views of various arrangement possibilities of interchangeable multi-positionable slideable rotatable umbrella-pole-receiving panels 102 and interchangeable slideable rotatable solid panels 104 within side-panel-securing support frame 111.
Figure 38:
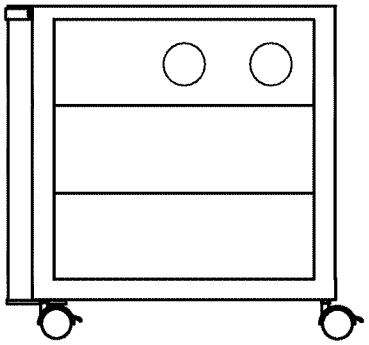
Figure 41:
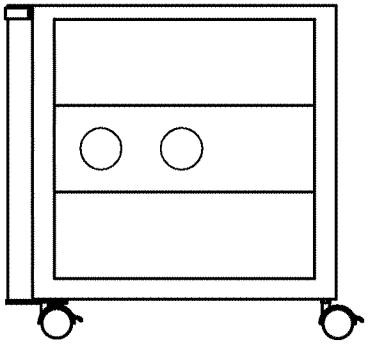
Figure 40:
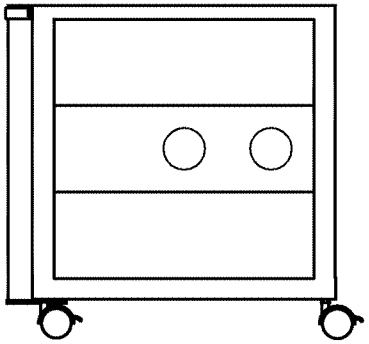
Figure 43:
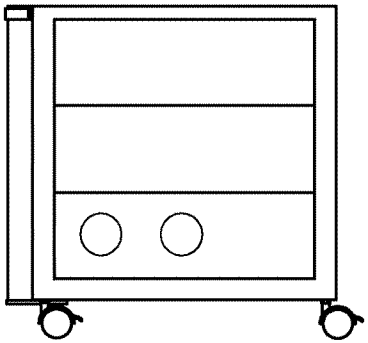
Figure 42:
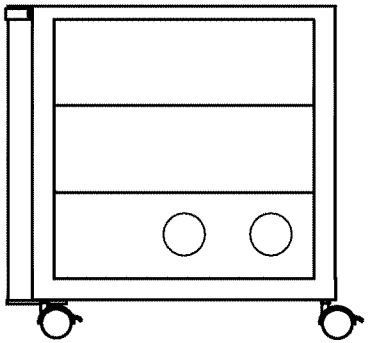
Figure 44:
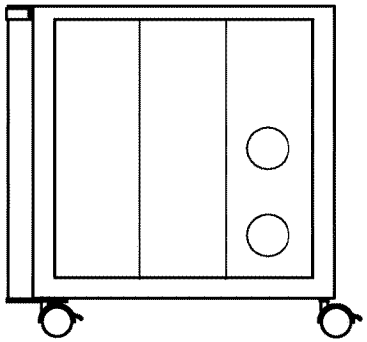
Figure 45:
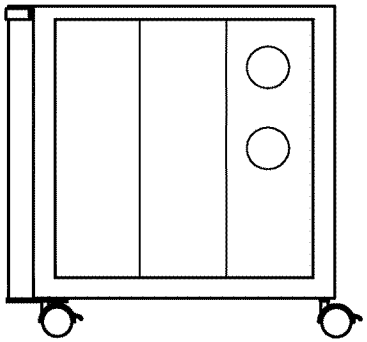
Figure 46:
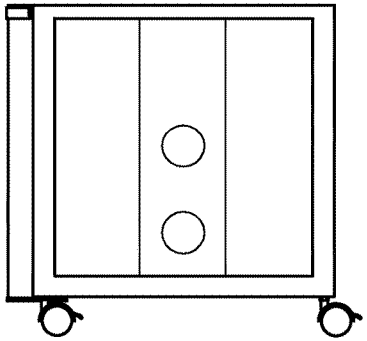
Figure 47:
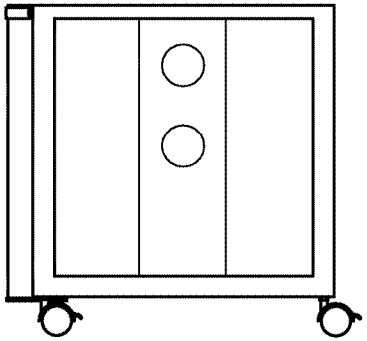
Figure 48:
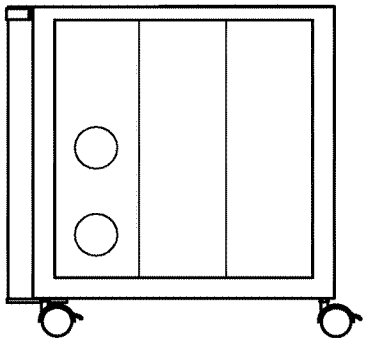
Figure 49:
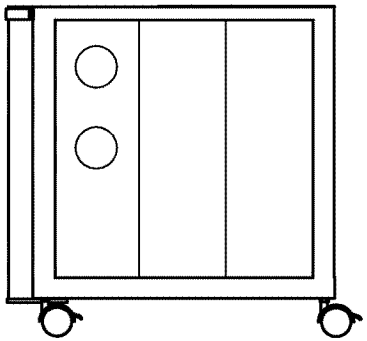
Figure 50:
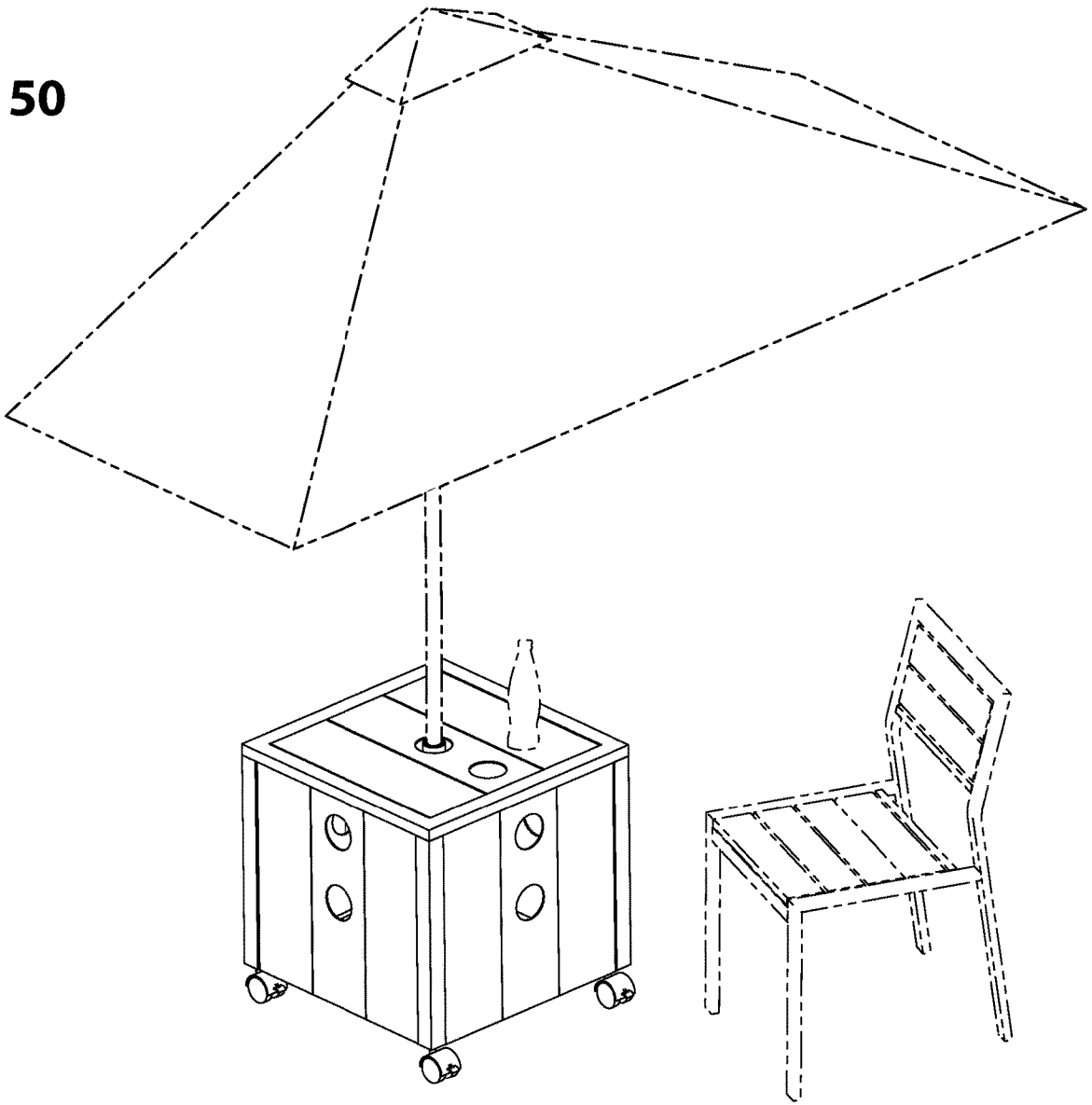
FIG. 50, FIG. 51, and FIG. 52 illustrate perspective views demonstrating different configurations of five-device-in-one multi-function multi-configurable hitch-mountable rollable rotatable collapsible tea table (capable of functioning as a pet kennel, a storage locker, a table, a cooler, and an umbrella base) having one half-umbrellas installed.
Figure 51:
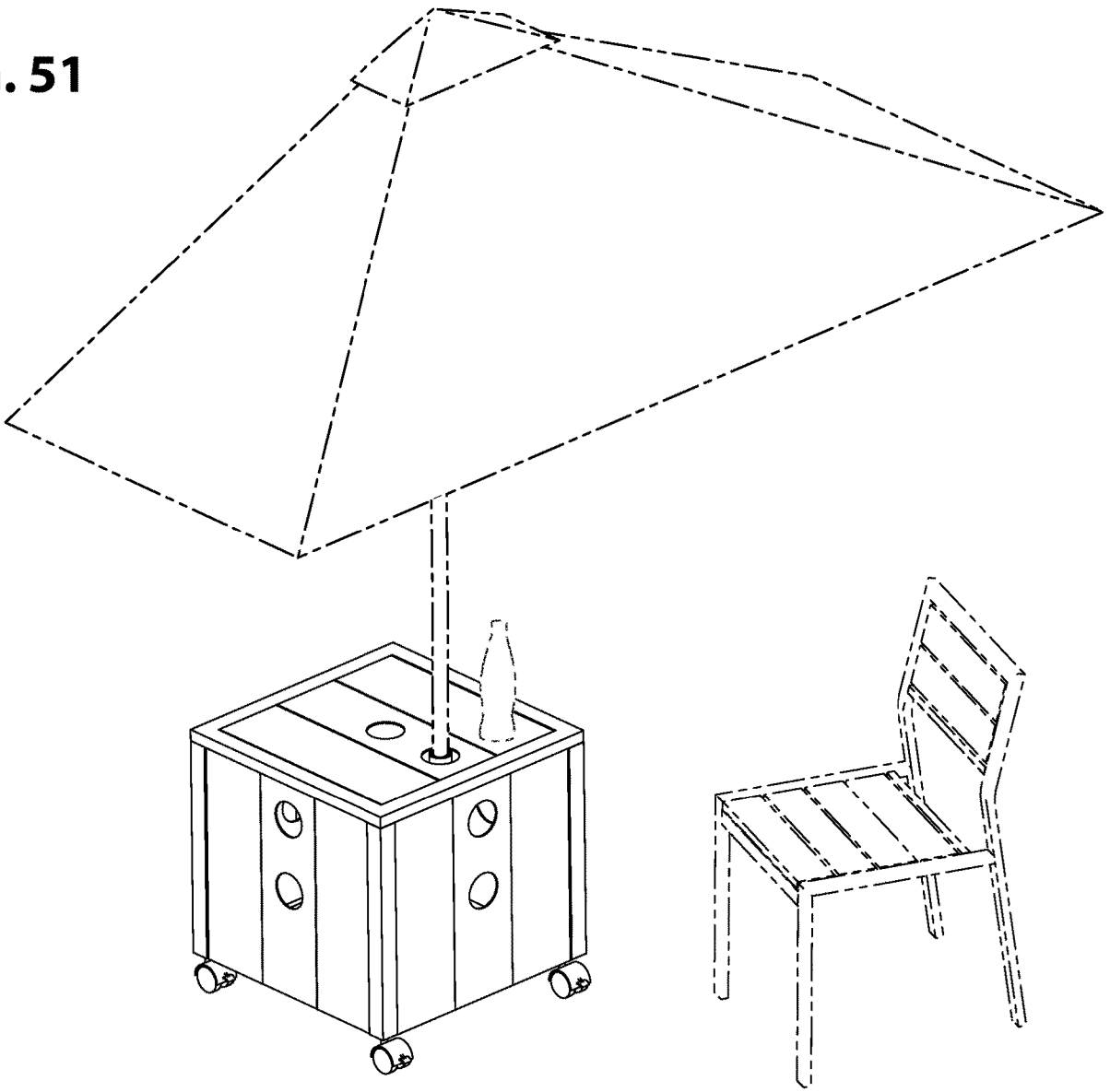
Figure 52:
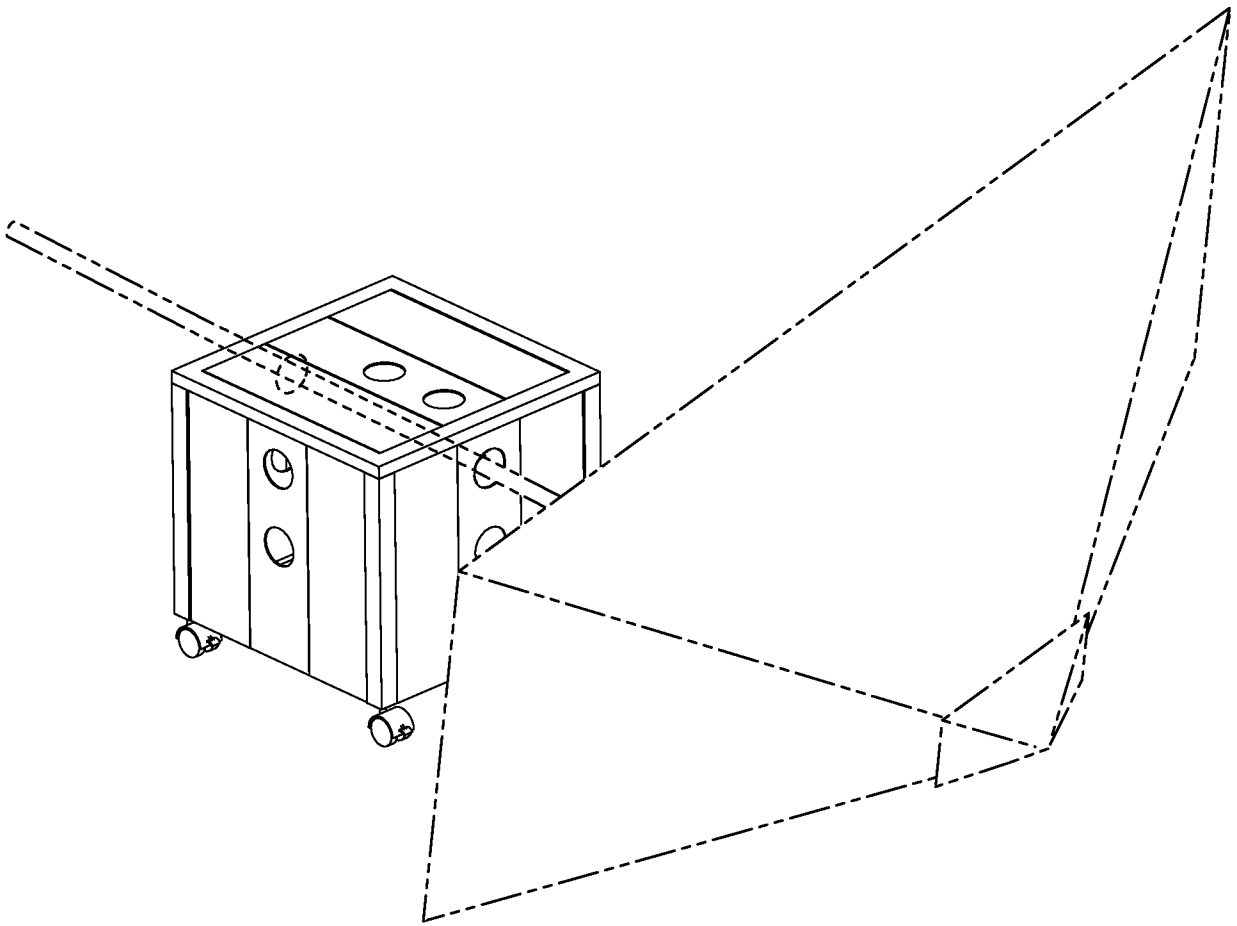
Figure 61A:
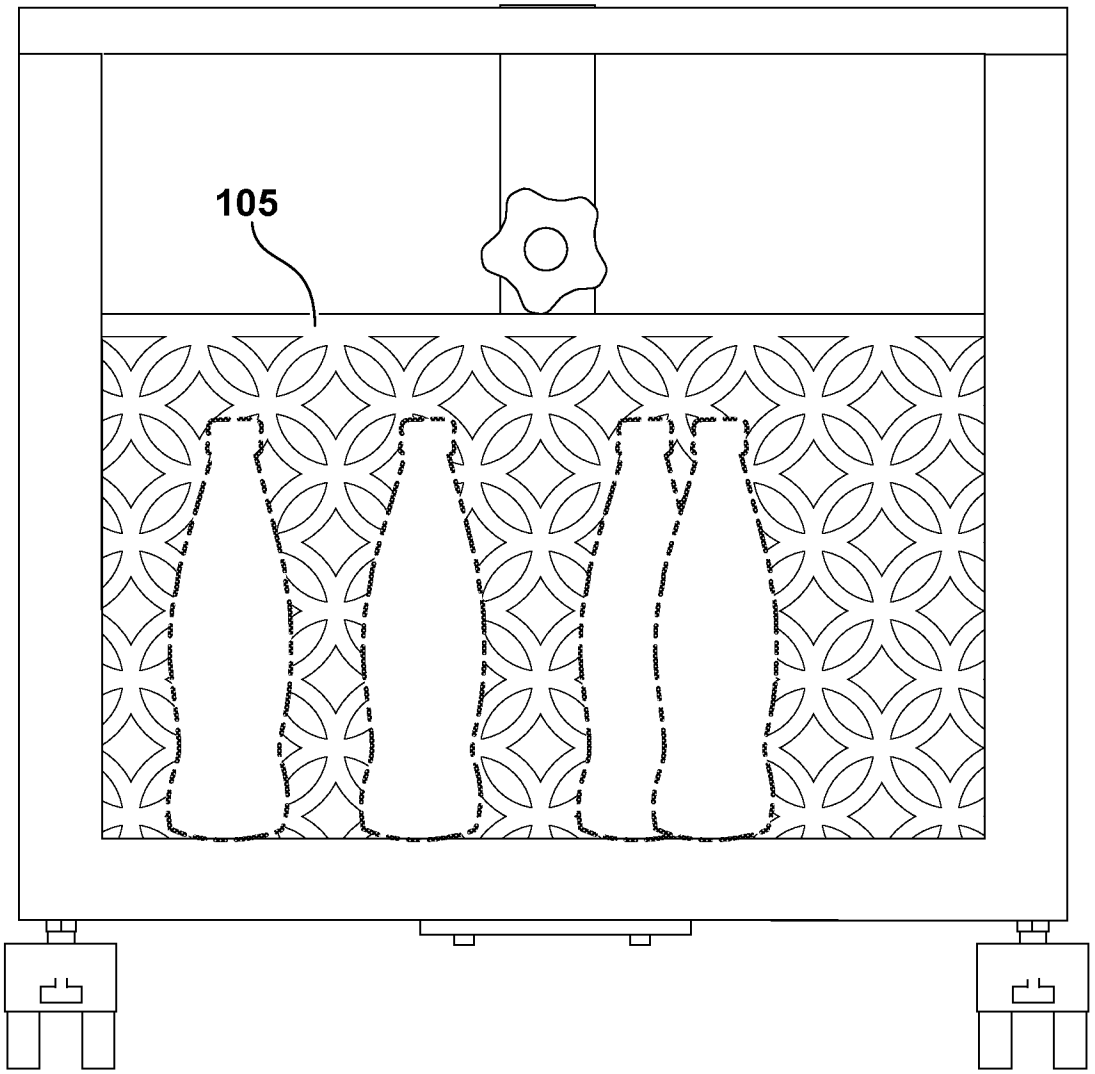
FIG. 61A illustrates a front view demonstrating how five-device-in-one multi-function multi-configurable hitch-mountable rollable rotatable collapsible tea table (capable of functioning as a pet kennel, a storage locker, a table, a cooler, and an umbrella base) can be a storage locker.
Figure 61B:
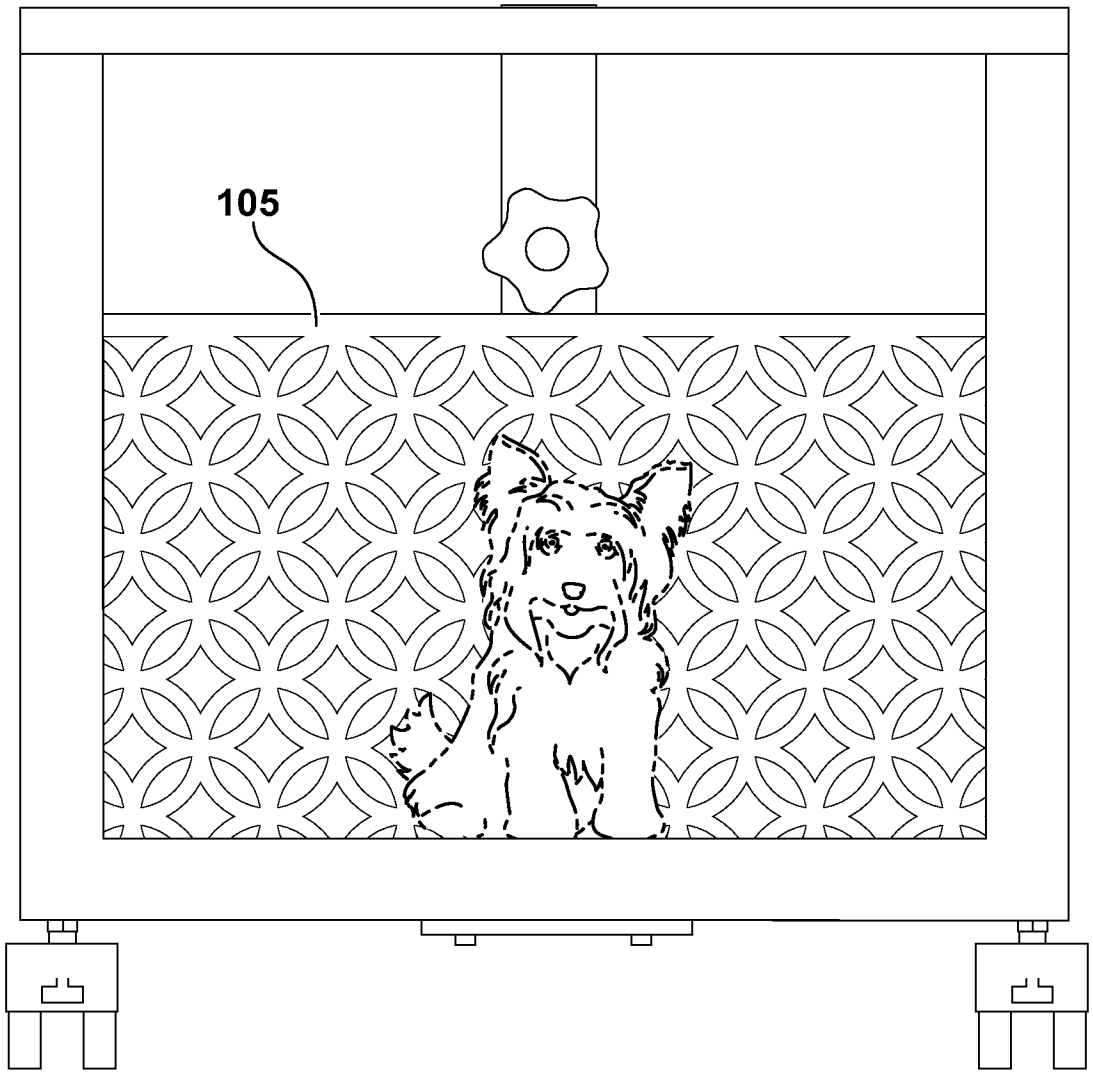
FIG. 61B illustrates a front view demonstrating how five-device-in-one multi-function multi-configurable hitch-mountable rollable rotatable collapsible tea table (capable of functioning as a pet kennel, a storage locker, a table, a cooler, and an umbrella base) can be a pet kennel.
Figure 62:
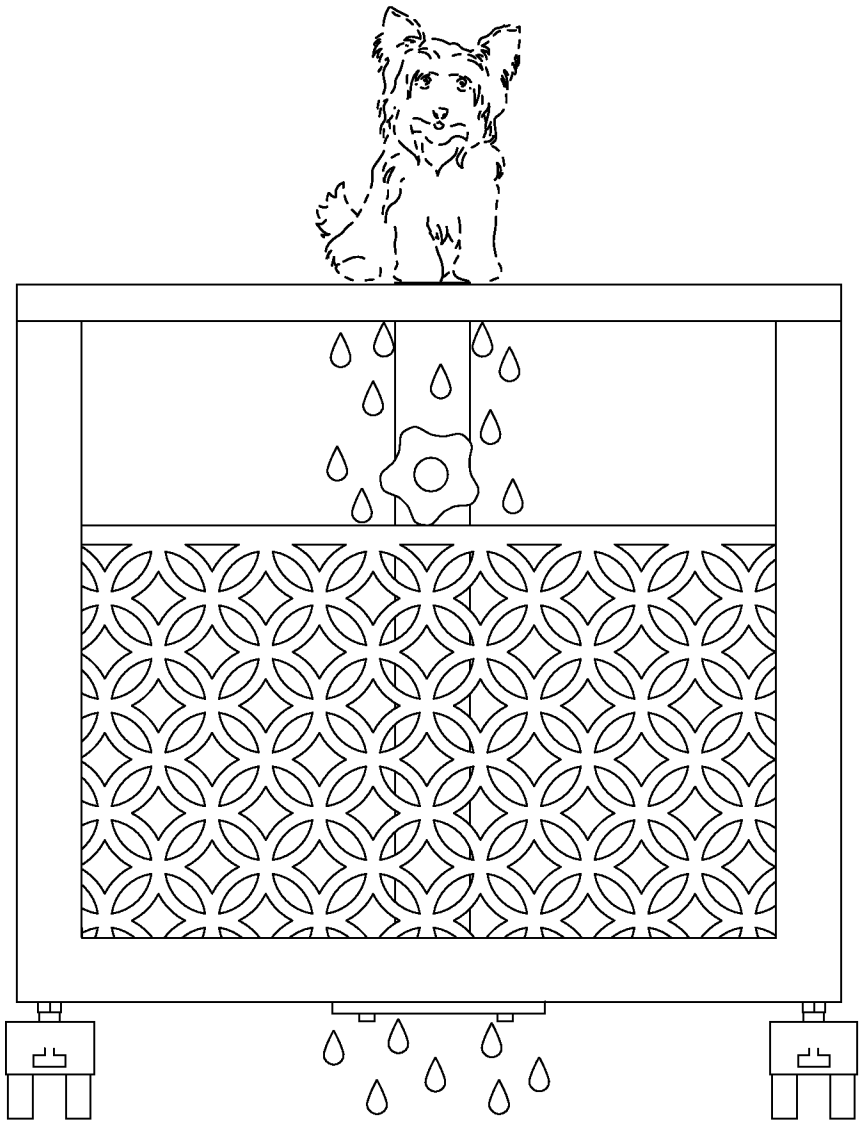
FIG. 62 illustrates a front view demonstrating how five-device-in-one multi-function multi-configurable hitch-mountable rollable rotatable collapsible tea table (capable of functioning as a pet kennel, a storage locker, a table, a cooler, and an umbrella base) can be a grooming station and/or drying platform.

2) Interchangeable multi-positionable slideable rotatable umbrella-pole-receiving panels 102 is (or are respectively) for:

a) Acting as an interchangeable surface for multi-positionable umbrella-pole-receiving holes 103 to allow at least one umbrella pole to be inserted therein
(See FIG. 1, FIG. 2, FIG. 3, FIG. 4, FIG. 23, FIG. 24, FIG. 25, FIG. 26, FIG. 27, FIG. 28, FIG. 29, FIG. 30, FIG. 31, FIG. 32, FIG. 33, FIG. 34, FIG. 35, FIG. 36, FIG. 37, FIG. 38, FIG. 39, FIG. 40, FIG. 41, FIG. 42, FIG. 43, FIG. 44, FIG. 45, FIG. 46, FIG. 47, FIG. 48, FIG. 49, FIG. 50, FIG. 51, FIG. 52, FIG. 53A, FIG. 53B, FIG. 53C, FIG. 54, FIG. 55. FIG. 56, FIG. 57, FIG. 63, FIG. 64, FIG. 65B, FIG. 66D, FIG. 67, FIG. 68, FIG. 69B, FIG. 70B, and FIG. 70C);

b) When the tea table is functioning as a kennel, providing an interchangeable surface to act as a top and/or wall in the directions of arrows 131, 132, and 133
(See FIG. 61B);

c) When the tea table is functioning as a grooming station, providing an interchangeable surface to act as a top and/or wall
in the directions of arrows 131, 132, and 133
(See FIG. 62);

d) When the tea table is functioning as a pet drying platform, providing an interchangeable surface to act as a top and/or wall
in the directions of arrows 131, 132, and 133
(See FIG. 62);

e) When the tea table is functioning as a storage locker, providing an interchangeable surface to act as a top and/or wall
in the directions of arrows 131, 132, and 133
(See FIG. 61A);

f) When the tea table is functioning as a table, providing an interchangeable surface to act as a top and/or wall in the directions of arrows 131, 132, and 133 (See FIG. 50, FIG. 51, FIG. 53B, FIG. 53C, FIG. 63, and FIG. 64); and g) When the tea table is functioning as a cooler, providing an interchangeable surface to act as a top and/or wall in the directions of arrows 131, 132, and 133 (See FIG. 20D).

Figure 53A:
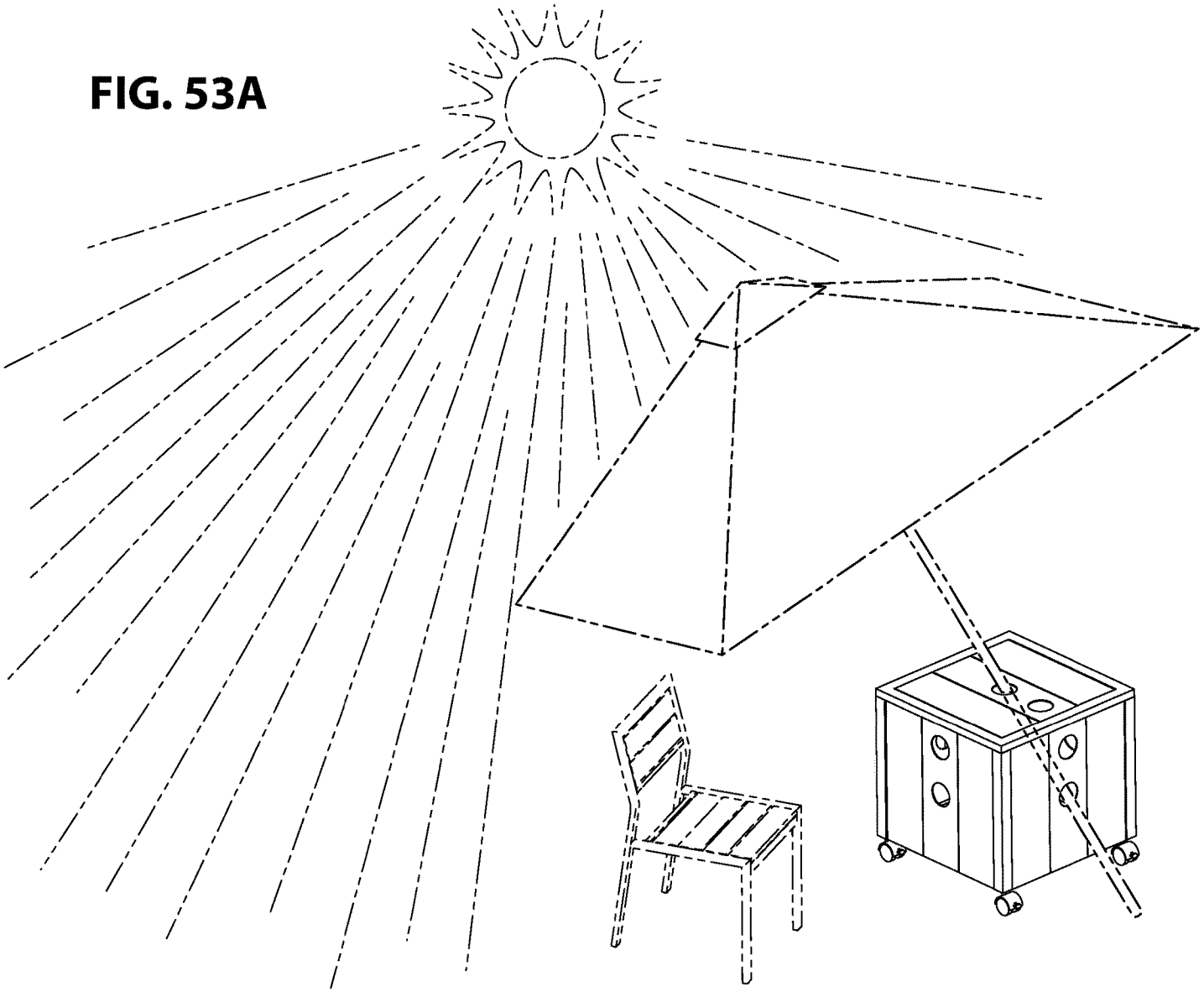
FIG. 53A illustrates a perspective view demonstrating how a half-umbrella can be installed through multiple multi-positionable umbrella-pole-receiving holes 103 to block the sun at multiple preferred angles of choice.
Figure 53B:
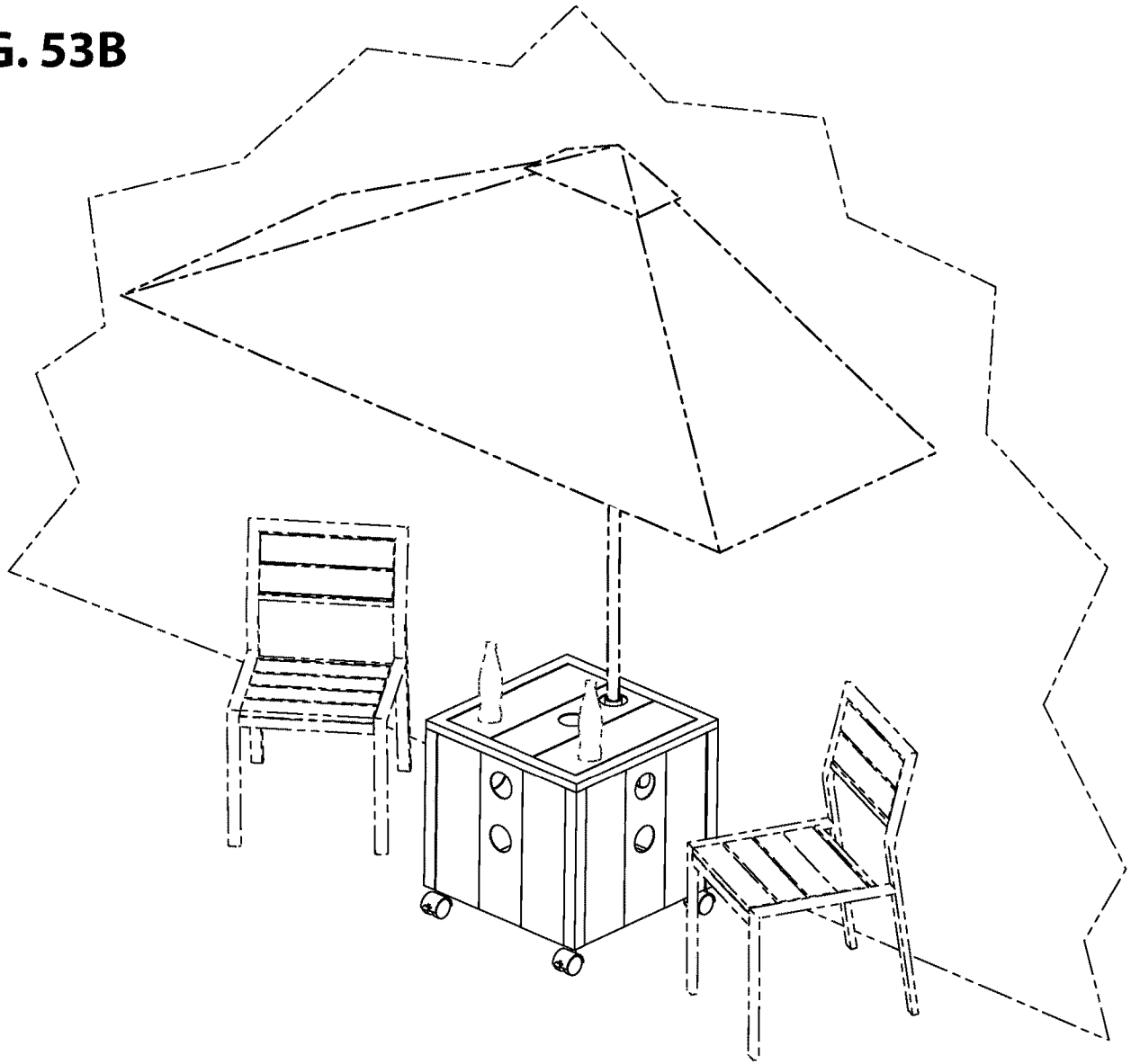
FIG. 53B illustrates a perspective view demonstrating how five-device-in-one multi-function multi-configurable hitch-mountable rollable rotatable collapsible tea table (capable of functioning as a pet kennel, a storage locker, a table, a cooler, and an umbrella base) and a half-umbrella can be positioned close to a wall.
Figure 53C:
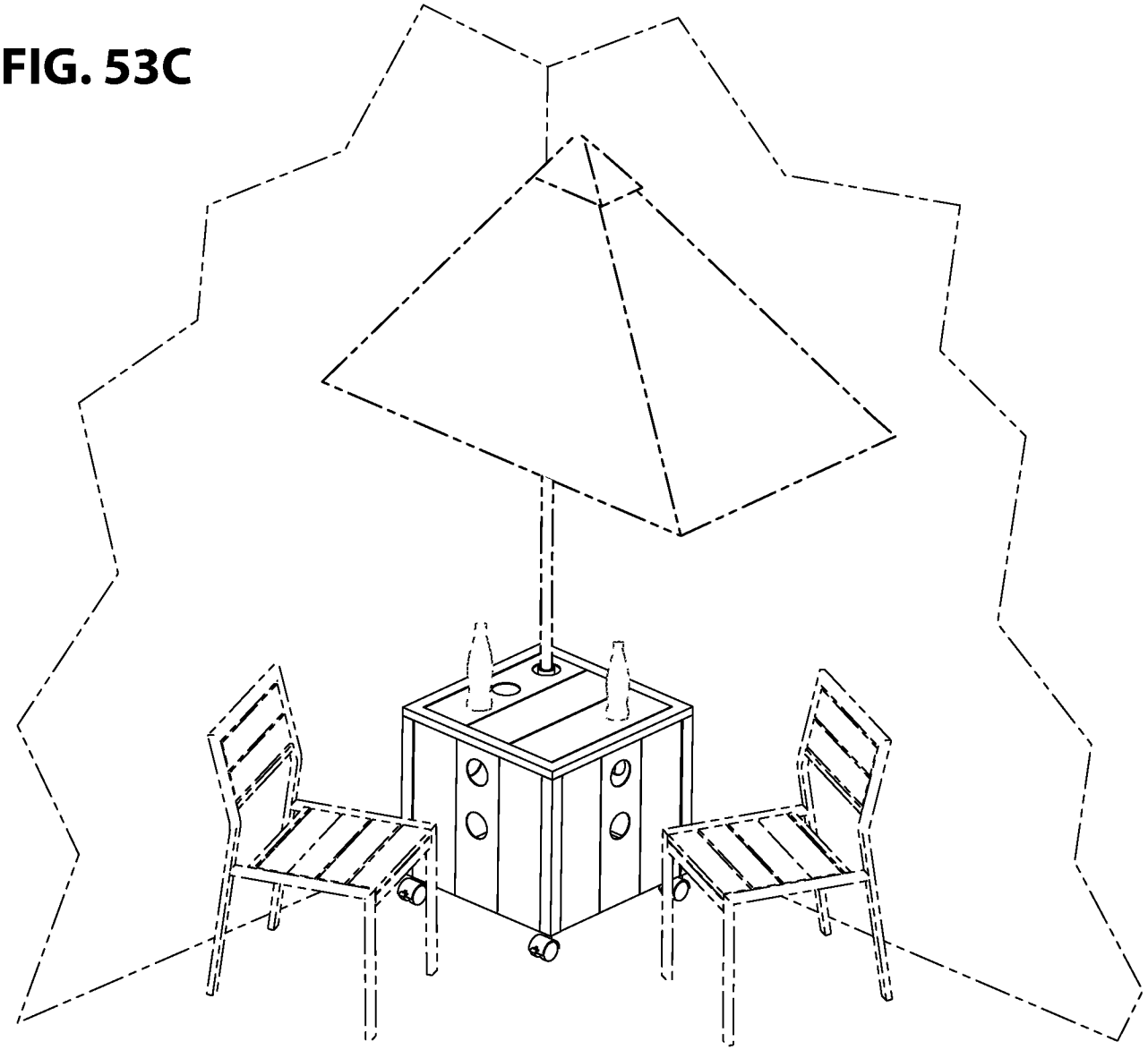
FIG. 53C illustrates a perspective view demonstrating how five-device-in-one multi-function multi-configurable hitch-mountable rollable rotatable collapsible tea table (capable of functioning as a pet kennel, a storage locker, a table, a cooler, and an umbrella base) and half-umbrella can be positioned in a 90-degree corner.
Figure 55:
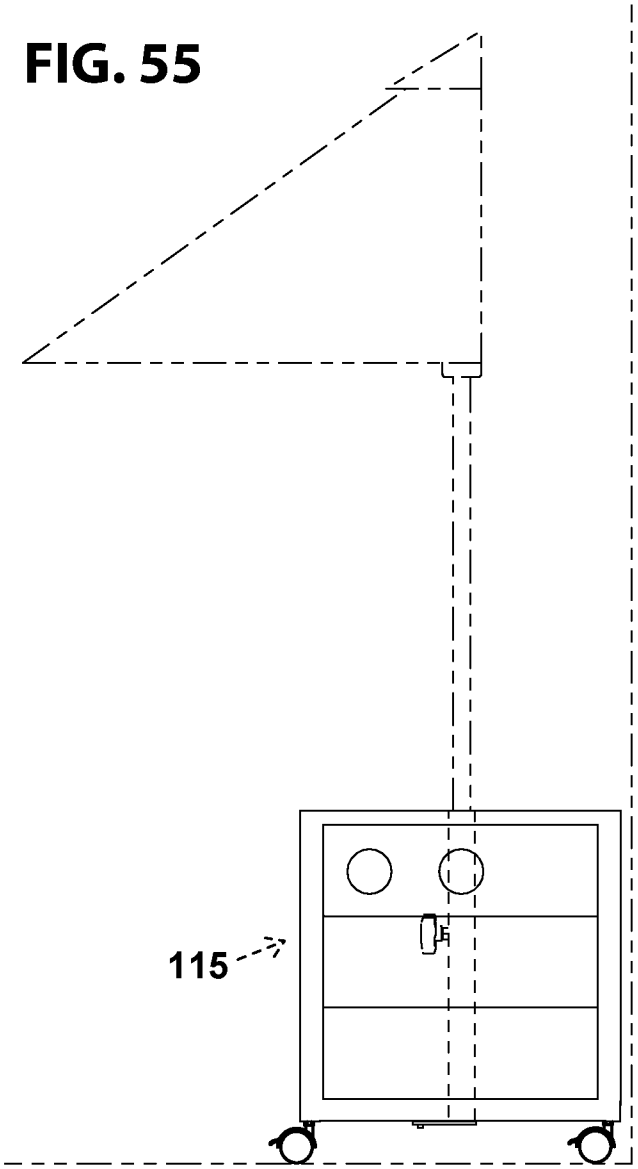
FIG. 54, FIG. 55, FIG. 56, and FIG. 57 illustrate side views demonstrating how interchangeable slideable rotatable breathable ornamental double-sized panels 105 can be configured.
Figure 65A:
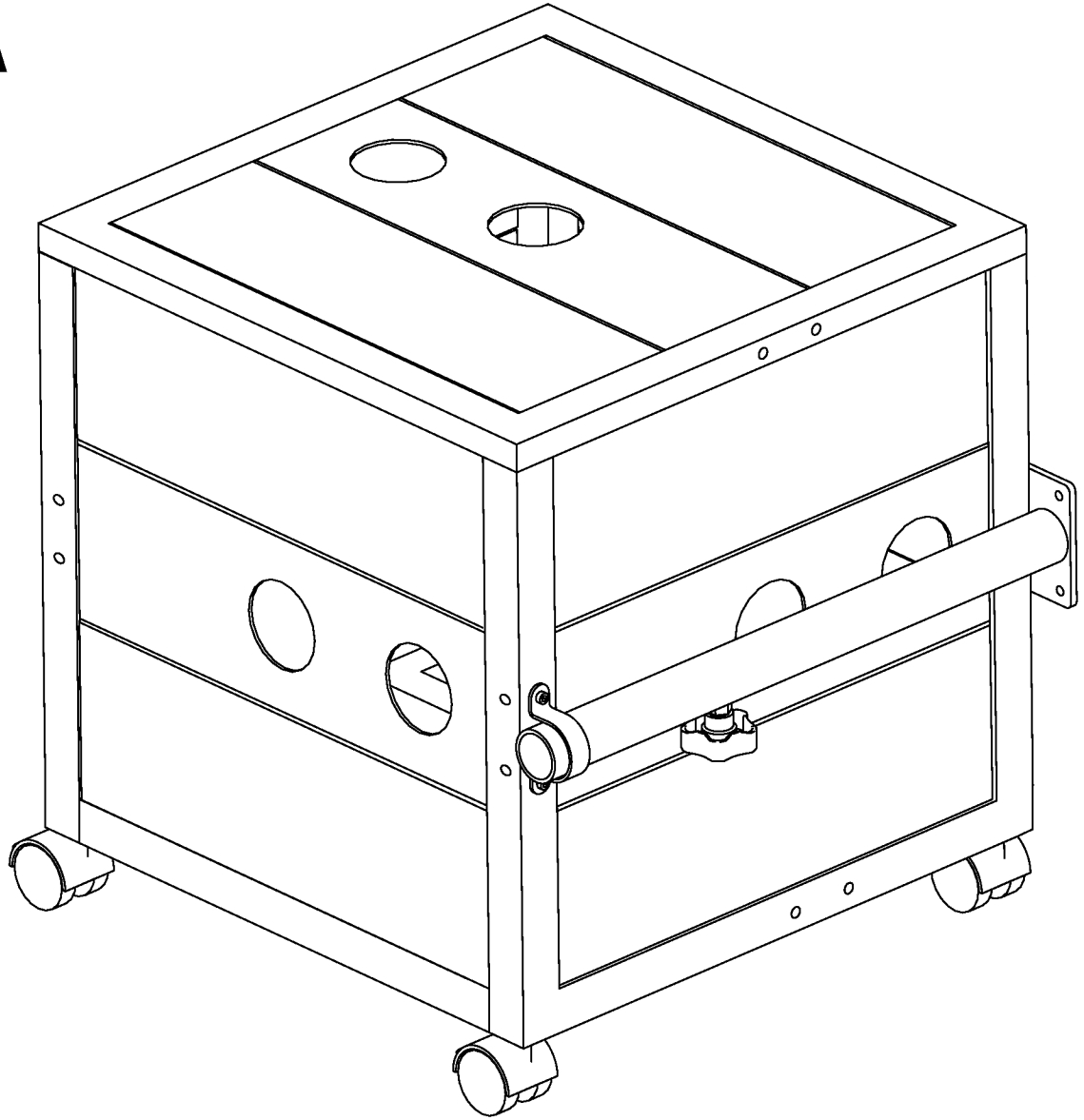
FIG. 65A illustrates a perspective view demonstrating how adjustable rotatable tow-hitch-attaching fence-post attaching umbrella-pole receiver system 115 can be mounted horizontally to side-panel-securing support frame 111.
Figure 65B:
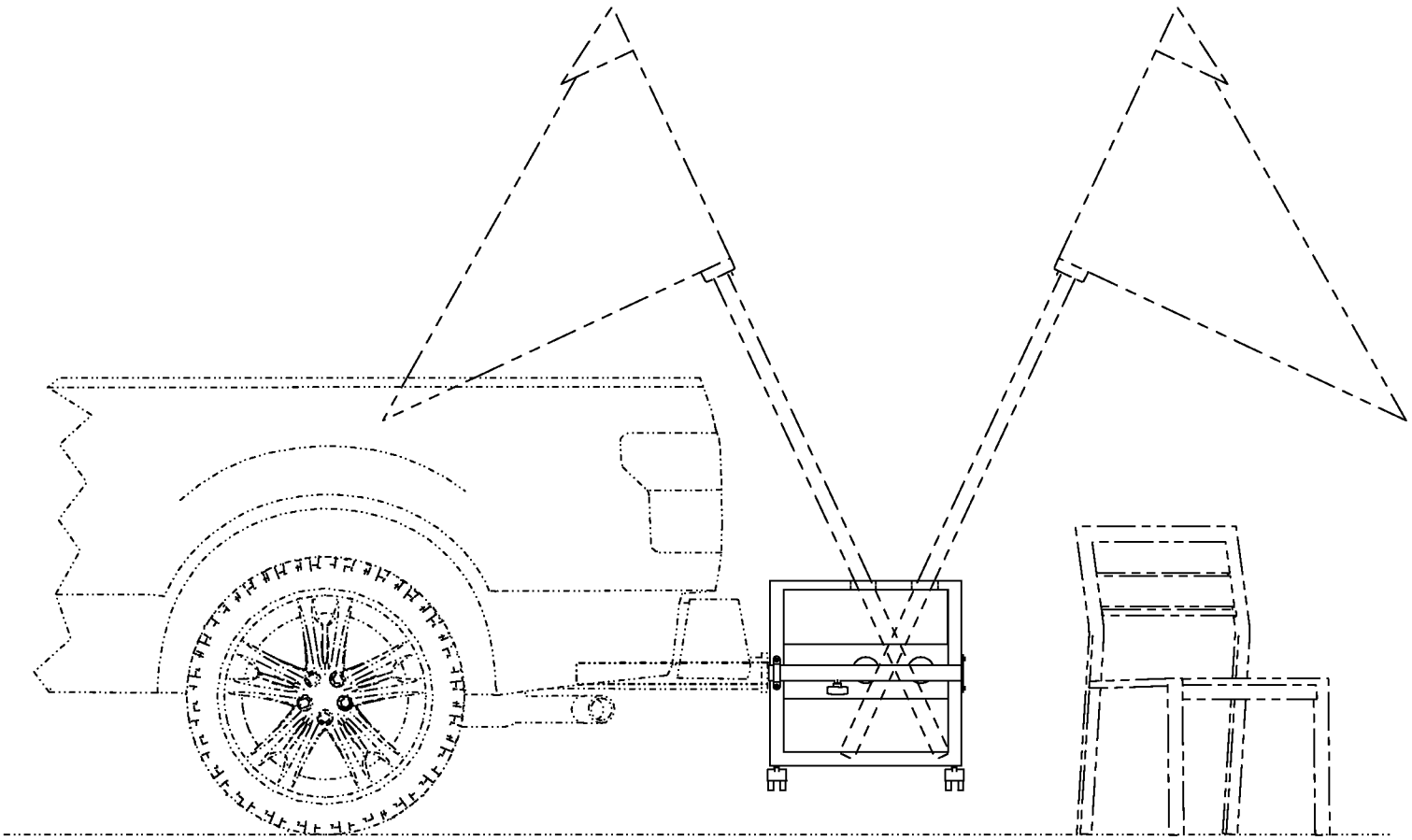
FIG. 65B illustrates a side view demonstrating how five-device-in-one multi-function multi-configurable hitch-mountable rollable rotatable collapsible tea table (capable of functioning as a pet kennel, a storage locker, a table, a cooler, and an umbrella base) can be attached to a trailer hitch with multiple half-umbrellas installed.
Figure 66B:
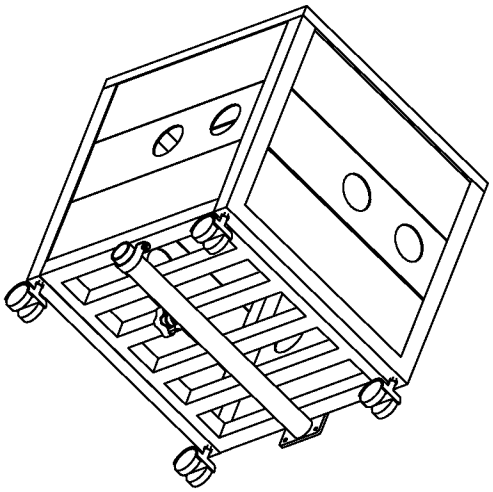
FIG. 66A, FIG. 66B, and FIG. 66C illustrate perspective views demonstrating how adjustable rotatable tow-hitch-attaching fence-post attaching umbrella-pole receiver system 115 can be mounted horizontally to breathable bottom support frame 112.
Figure 66C:
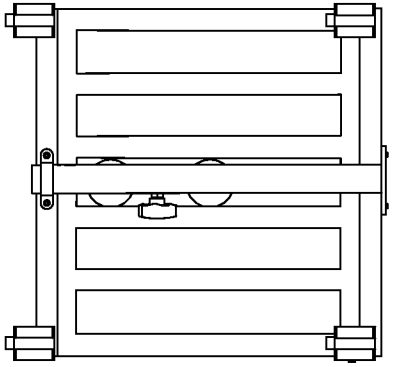
Figure 66A:
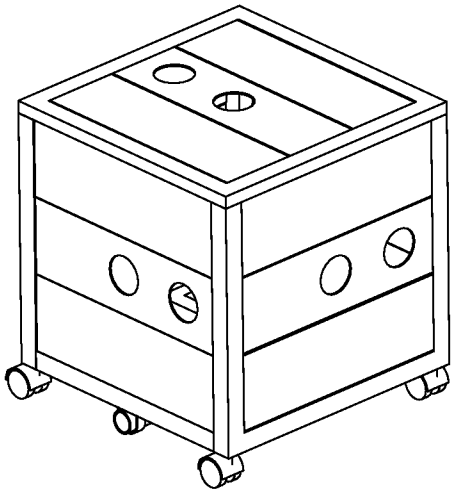
Figure 66D:
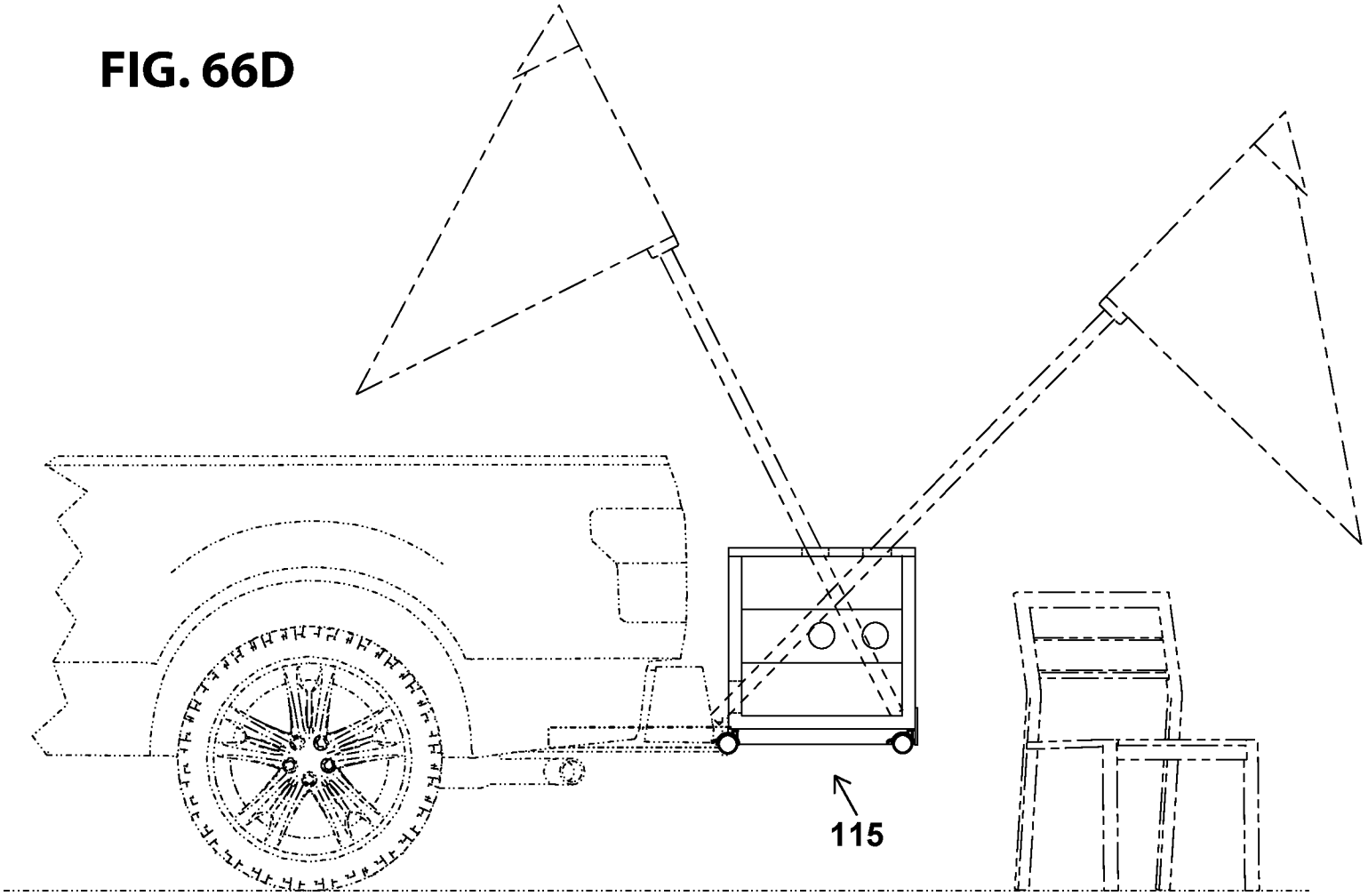
FIG. 66D illustrates a side view demonstrating how five-device-in-one multi-function multi-configurable hitch-mountable rollable rotatable collapsible tea table (capable of functioning as a pet kennel, a storage locker, a table, a cooler, and an umbrella base) can be attached to a trailer hitch.
Figure 67B:
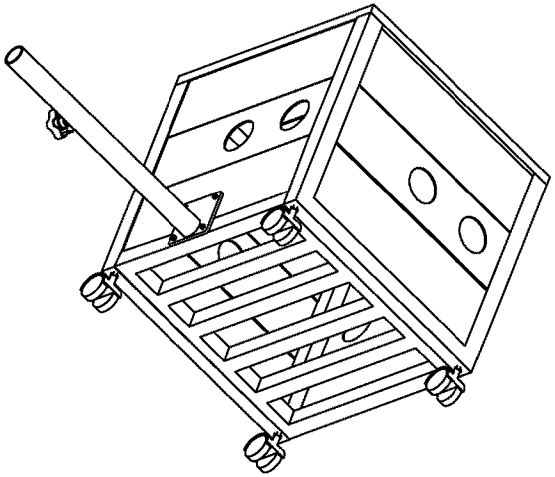
FIG. 67A, FIG. 67B, and FIG. 67C illustrate perspective views demonstrating how adjustable rotatable tow-hitch-attaching fence-post attaching umbrella-pole receiver system 115 can be mounted to and protruding horizontally from side-panel-securing support frame 111.
Figure 67C:
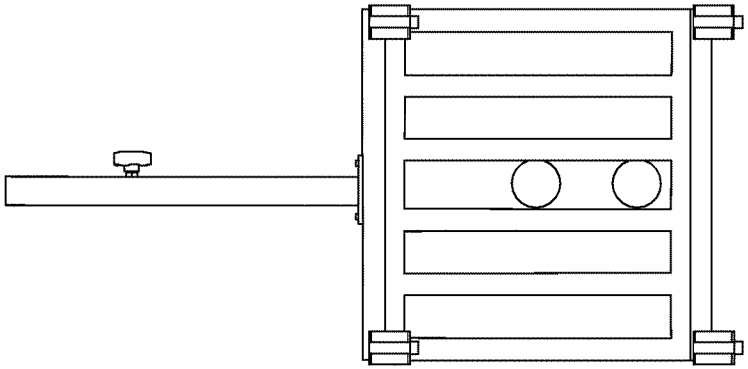
Figure 67A:
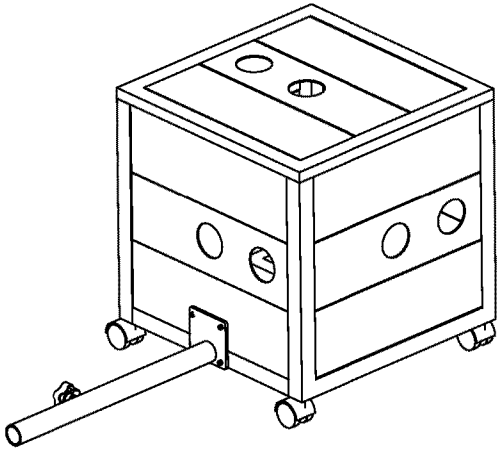
Figure 69A:
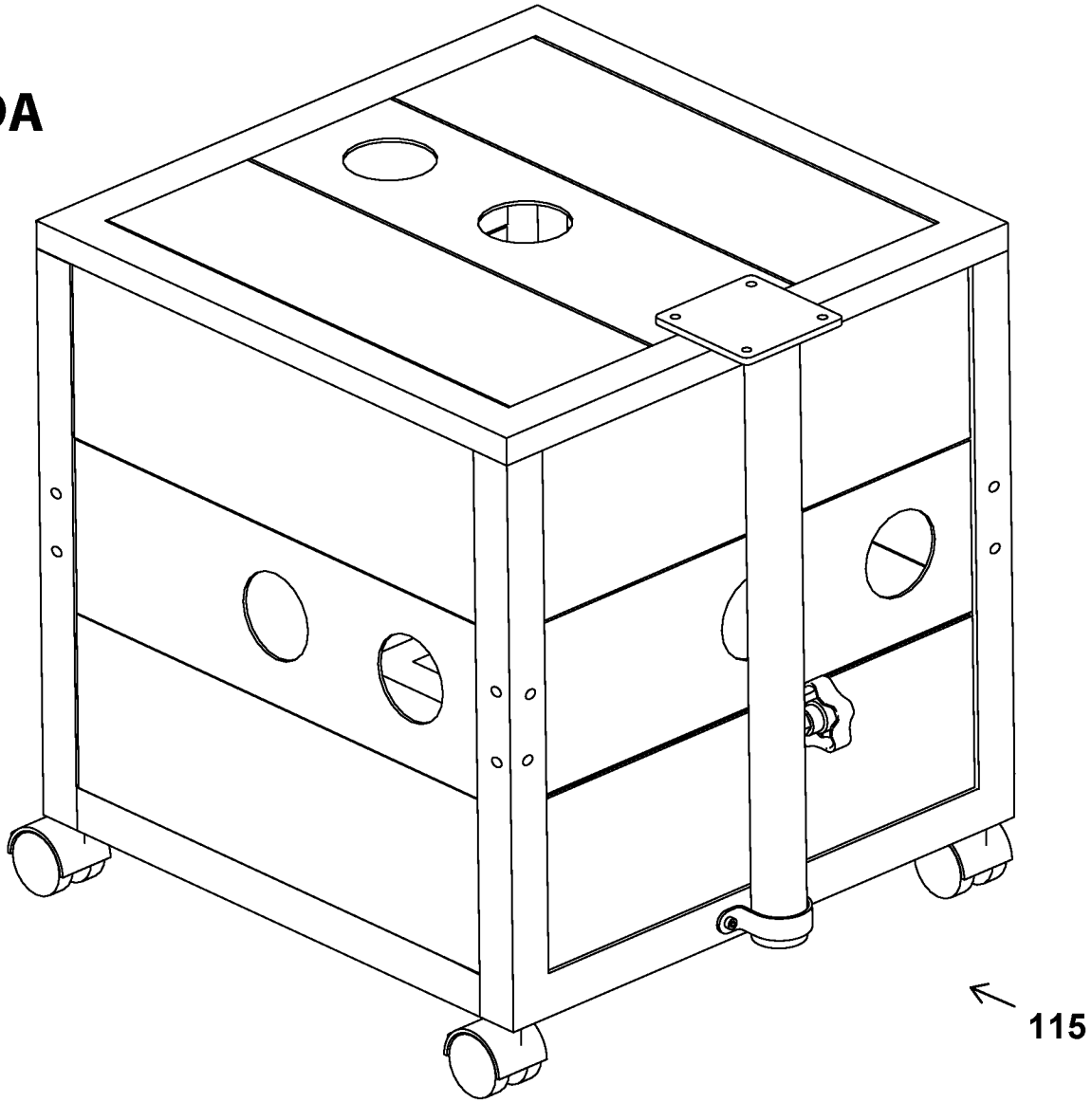
FIG. 69A illustrates a perspective view demonstrating how adjustable rotatable tow-hitch-attaching fence-post attaching umbrella-pole receiver system 115 can be mounted vertically inversed to side-panel-securing support frame 111.
Figure 69B:
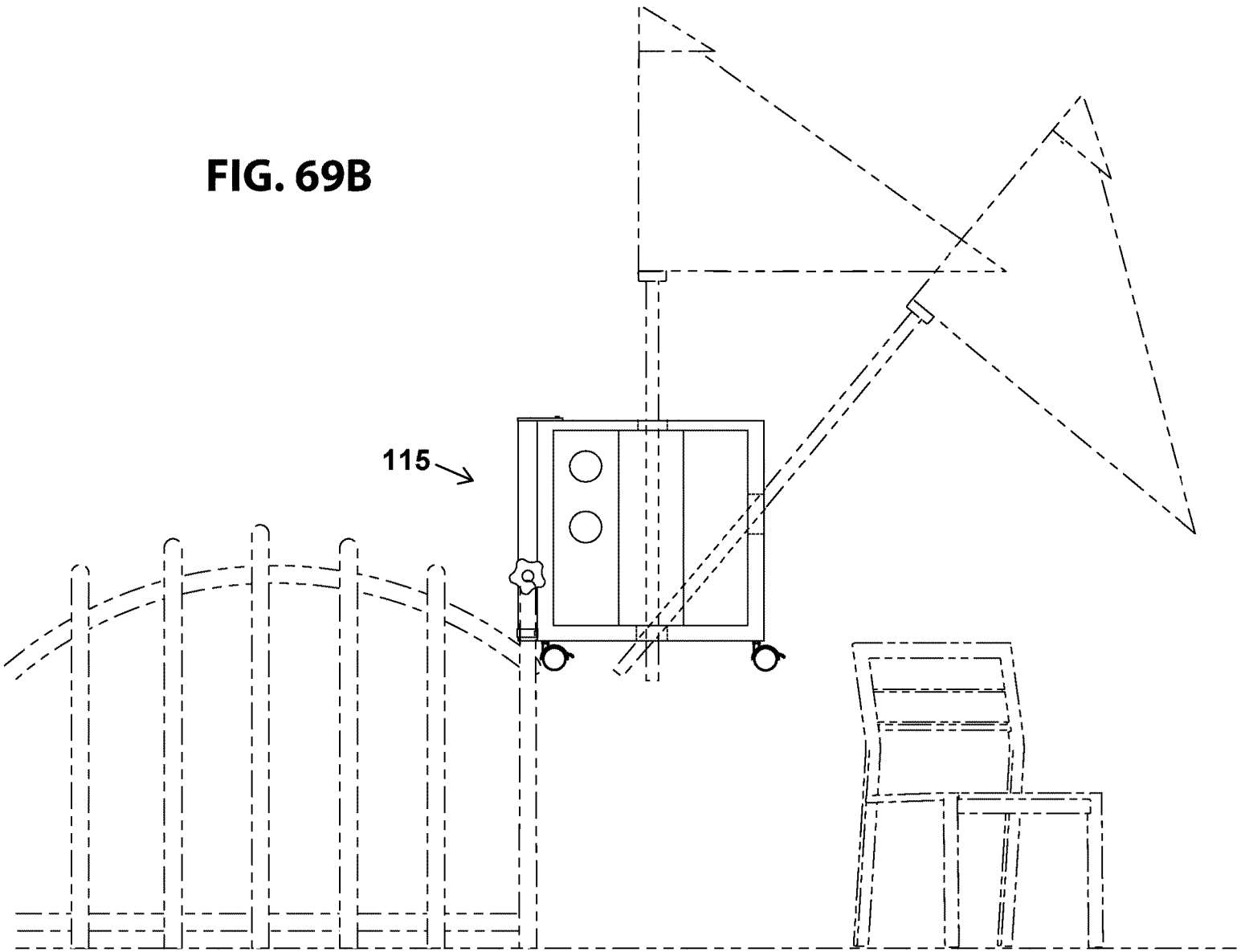
FIG. 69B illustrates a side view demonstrating how five-device-in-one multi-function multi-configurable hitch-mountable rollable rotatable collapsible tea table (capable of functioning as a pet kennel, a storage locker, a table, a cooler, and an umbrella base) can be mounted to a fence post with multiple half-umbrellas installed.

3) Multi-positionable umbrella-pole-receiving holes 103 is (or are respectively) for:

a) Providing multiple options for an umbrella pole to be inserted vertically (see FIG. 50, FIG. 51, FIG. 52, FIG. 53A, FIG. 53B, FIG. 53C, FIG. 55, FIG. 56, FIG. 57, FIG. 65B, FIG. 66D, FIG. 68, FIG. 69B, FIG. 70B, and FIG. 70C);

b) Providing multiple options for an umbrella pole to be inserted horizontally (see FIG. 52, FIG. 70B, and FIG. 70C); and c) Providing multiple options for an umbrella pole to be inserted diagonally (see FIG. 53A, FIG. 65B, and FIG. 69B).

4) Interchangeable slideable rotatable solid panels 104 is (or are respectively) for:

a) When the tea table is functioning as a kennel, providing an interchangeable surface to act as a top and/or wall in the directions of arrows 131, 132, and 133 (See FIG. 61B);

b) When the tea table is functioning as a grooming station, providing an interchangeable surface to act as a top and/or wall in the directions of arrows 131, 132, and 133 (See FIG. 62);

c) When the tea table is functioning as a pet drying platform, providing an interchangeable surface to act as a top and/or wall in the directions of arrows 131, 132, and 133 (See FIG. 62);

d) When the tea table is functioning as a storage locker, providing an interchangeable surface to act as a top and/or wall in the directions of arrows 131, 132, and 133 (See FIG. 61A);

e) When the tea table is functioning as a table, providing an interchangeable surface to act as a top and/or wall in the directions of arrows 131, 132, and 133 (See FIG. 50, FIG. 51, FIG. 53B, FIG. 53C, FIG. 63, and FIG. 64); and f) When the tea table is functioning as a cooler, providing an interchangeable surface to act as a top and/or wall in the directions of arrows 131, 132, and 133 (See FIG. 20D).

5) Interchangeable slideable rotatable breathable ornamental double-sized panels 105 is (or are respectively) for:

a) When the tea table is functioning as a kennel, providing an interchangeable surface to act as a top and/or wall in the directions of arrows 131, 132, and 133 (See FIG. 61B);

b) When the tea table is functioning as a grooming station, providing an interchangeable surface to act as a top and/or wall in the directions of arrows 131, 132, and 133 (See FIG. 62);

c) When the tea table is functioning as a pet drying platform, providing an interchangeable surface to act as a top and/or wall in the directions of arrows 131, 132, and 133 (See FIG. 62);

d) When the tea table is functioning as a storage locker, providing an interchangeable surface to act as a top and/or wall in the directions of arrows 131, 132, and 133 (See FIG. 61A);

e) When the tea table is functioning as a table, providing an interchangeable surface to act as a top and/or wall in the directions of arrows 131, 132, and 133 (See FIG. 50, FIG. 51, FIG. 53B, FIG. 53C, FIG. 63, and FIG. 64); and f) When the tea table is functioning as a cooler, providing an interchangeable surface to act as a top and/or wall in the directions of arrows 131, 132, and 133 (See FIG. 20D).

Figure 11:
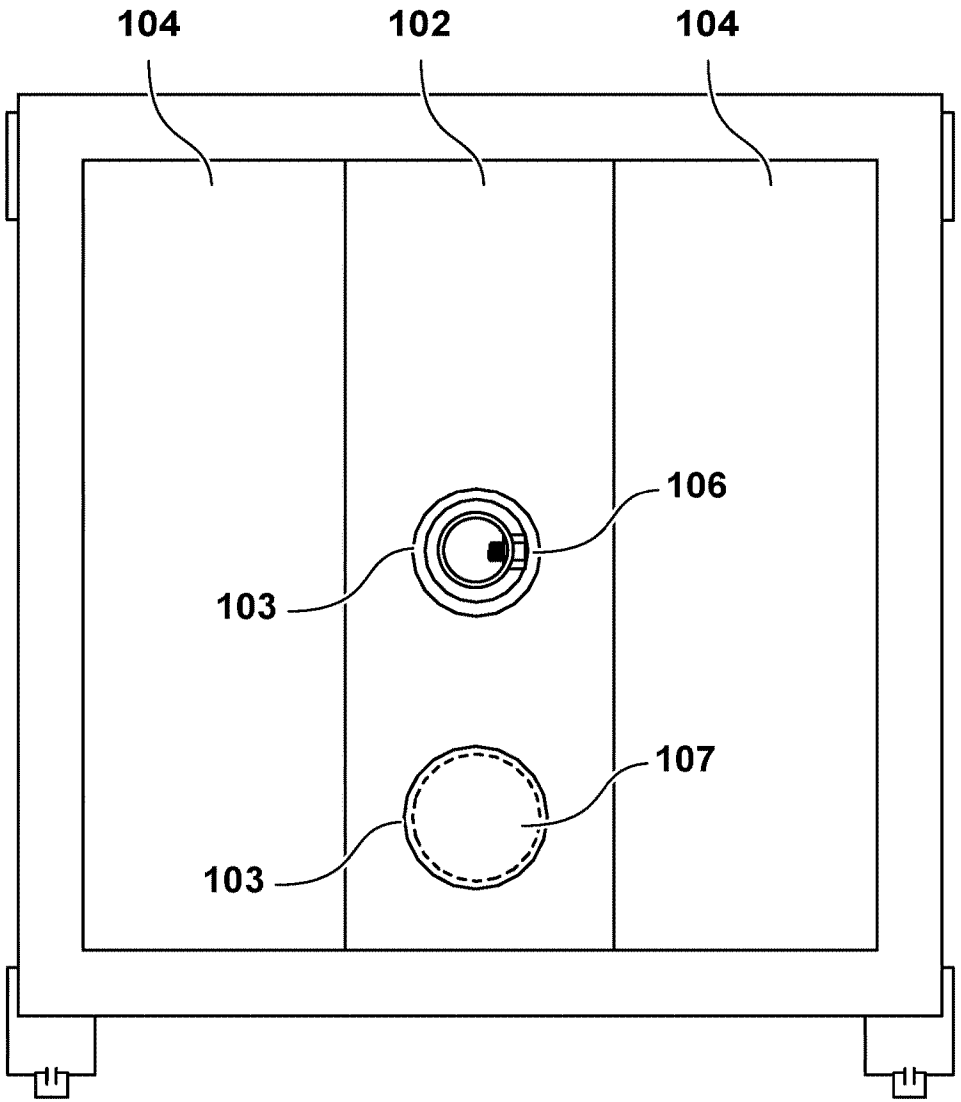
FIG. 11 and FIG. 12 illustrate top and perspective views of the panel securing tea-table umbrella-stand support frame system 109.
Figure 12:
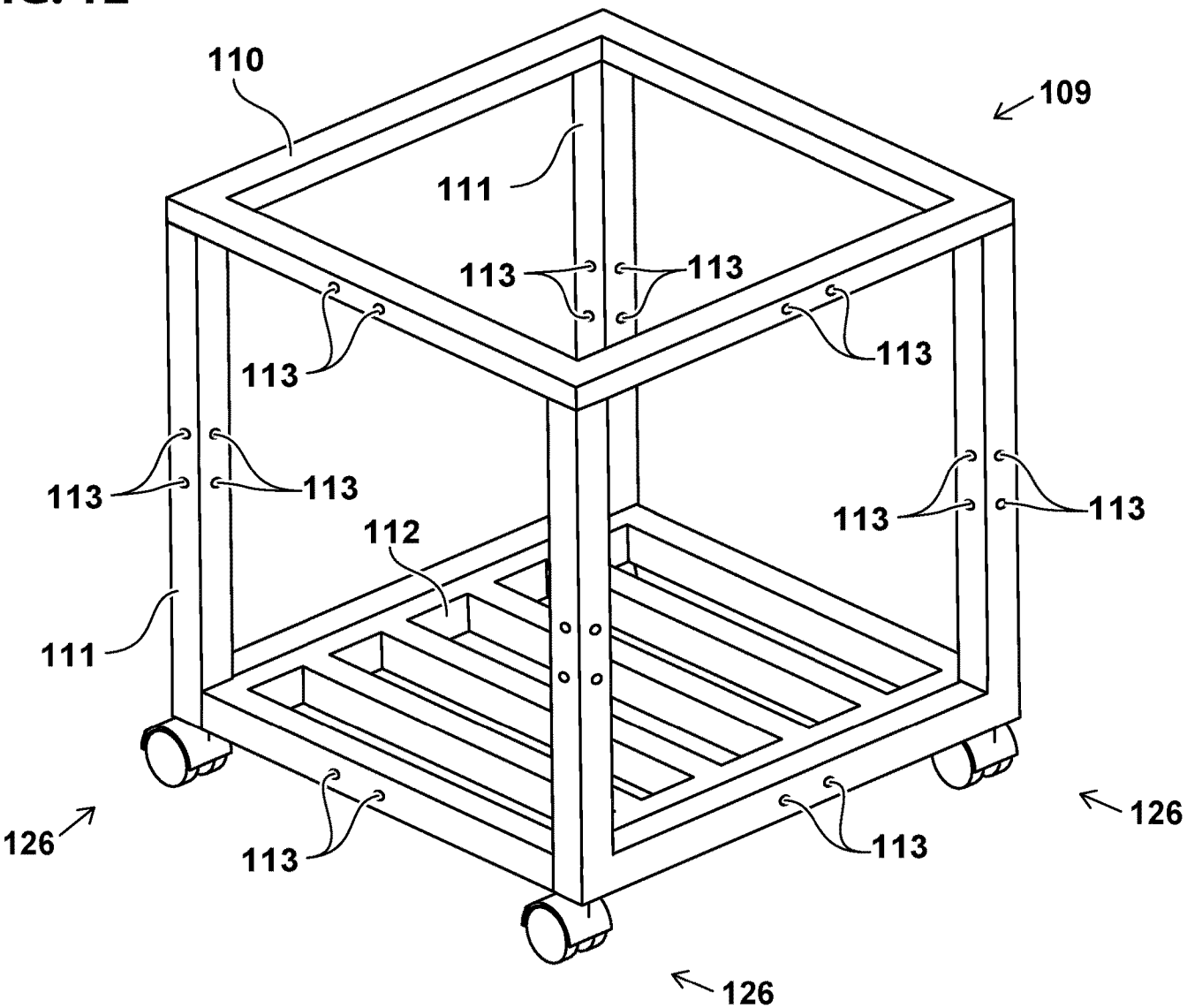
Figure 15:
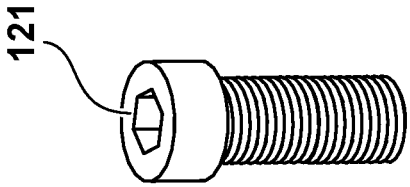
FIG. 13, FIG. 14, FIG. 15, and FIG. 16 illustrate perspective views of the panel-attaching bolts 108, frame-securing bolts 114, base-plate-securing bolts 121, and tow-hitch-attaching fence-post-attaching umbrella-pole-receiver-shaft-securing bracket 117.
Figure 14:
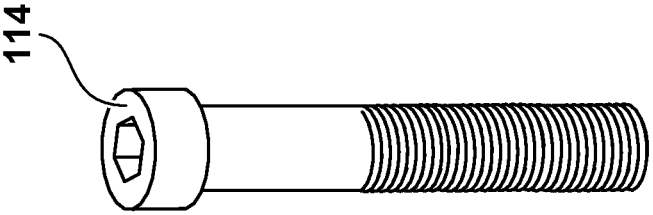
Figure 16:
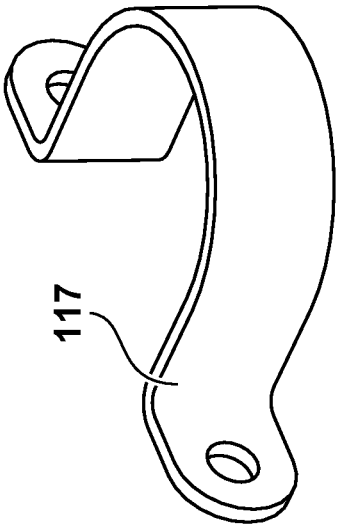
Figure 13:
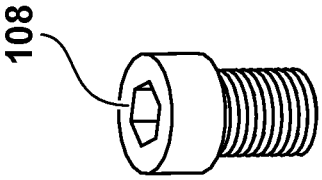
Figure 18:
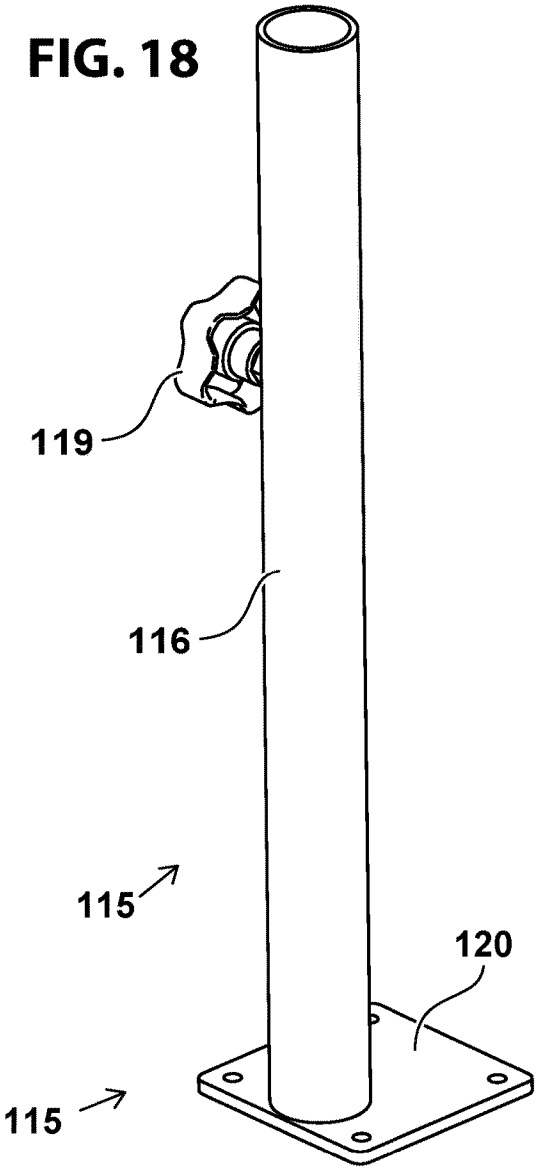
FIG. 17 and FIG. 18 illustrate perspective views of adjustable rotatable tow-hitch-attaching fence-post attaching umbrella-pole receiver system 115.
Figure 17:
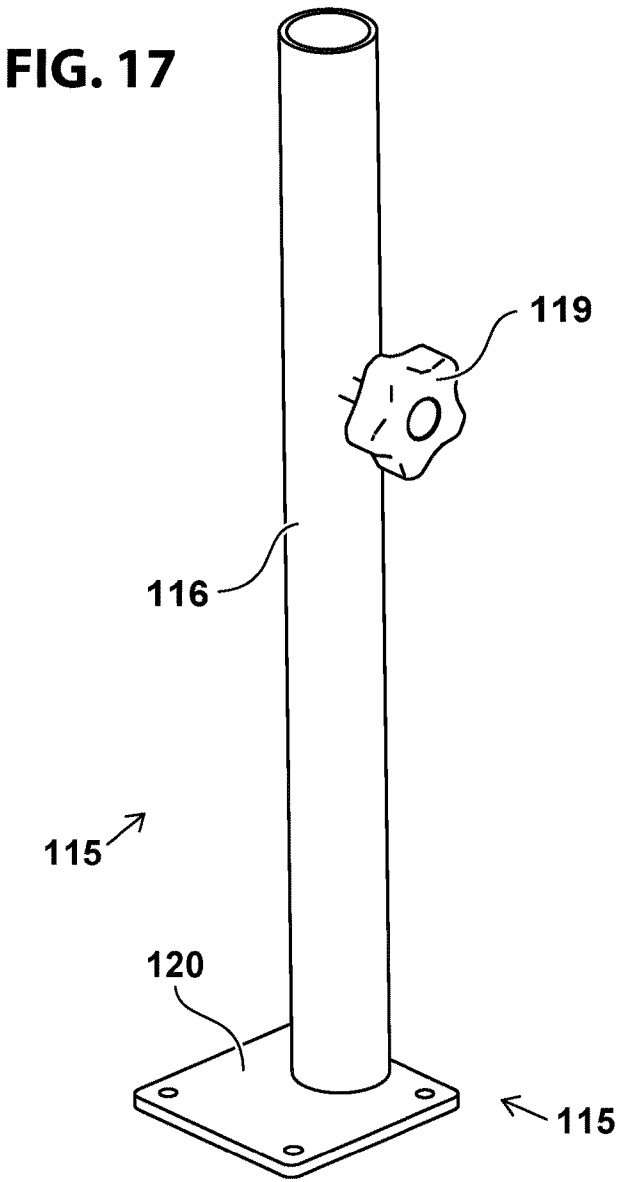
Figure 19:
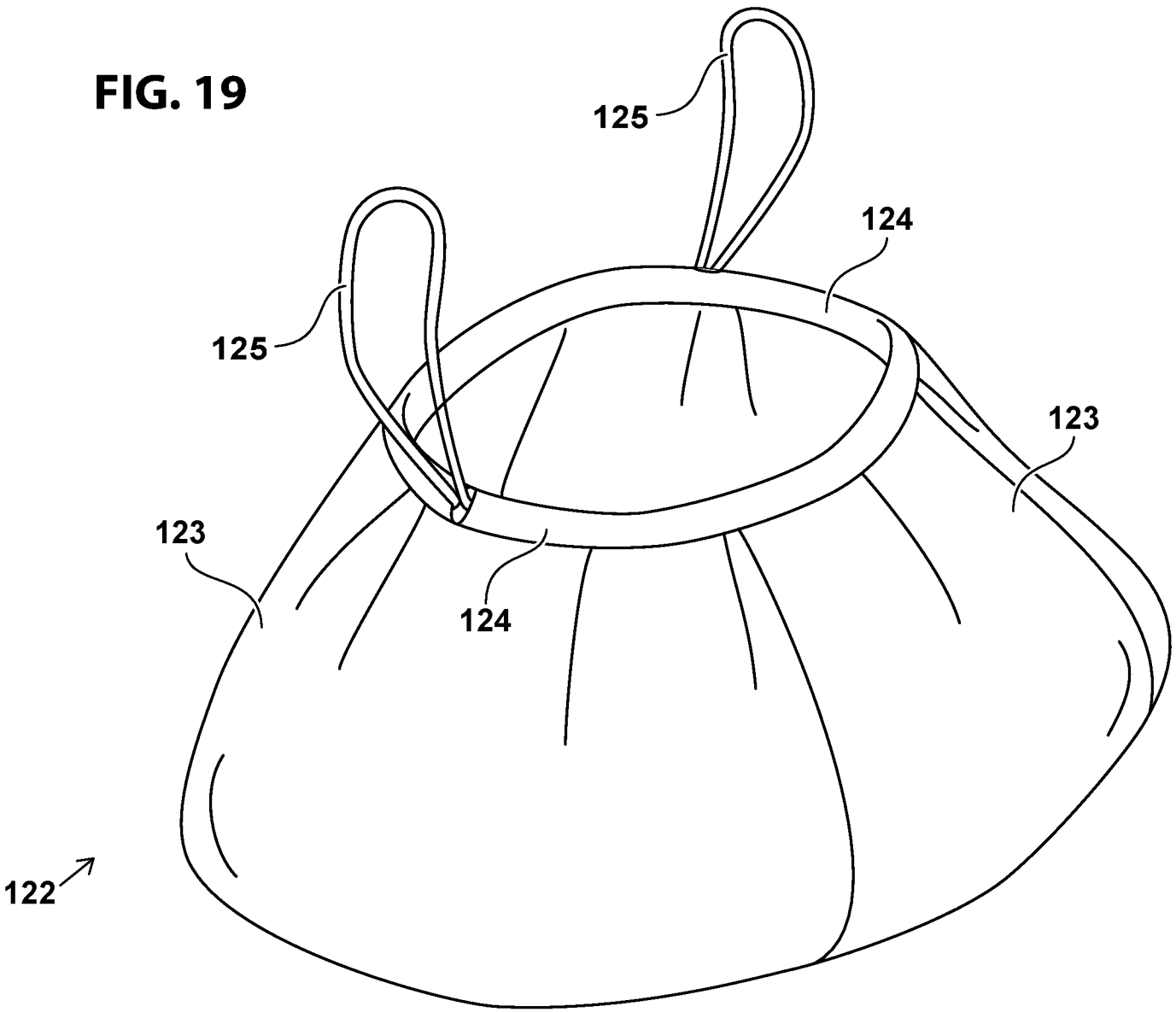
FIG. 19, FIG. 20A, FIG. 20B, FIG. 20C, and FIG. 20D illustrate perspective views of plastic-coated waterproof-fabric water-tight reinforce-stitched rock-fillable sand-fillable water-fillable ice-fillable cinchable backpack cinch-sack cooler ballast bag system 122.

6) Pole-receiving-hole sheaths 106 is (or are respectively) for:

Allowing a pole to be slideably inserted into multi-positionable umbrella-pole-receiving holes 103 without touching metal to metal to protect pole from damage (See FIG. 11).

7) Pole-receiving-hole caps 107 is (or are respectively) for:

Providing a cover for multi-positionable umbrella-pole-receiving holes 103 (See FIG. 11).

8) Panel-attaching bolts 108 is (or are respectively) for:

Attaching interchangeable multi-positionable slideable rotatable umbrella-pole-receiving panels 102, interchangeable slideable rotatable solid panels 104, and/or interchangeable slideable rotatable breathable ornamental double-sized panels 105 to side-panel-securing support frame 111.

9) Panel securing tea-table umbrella-stand support frame system 109 is (or are respectively) for performing the combined functions of its components.

10) Top-panel-securing support frame 110 is (or are respectively) for:

a) When the tea table is functioning as a kennel, providing support for interchangeable multi-positionable slideable rotatable umbrella-pole-receiving panels 102, interchangeable slideable rotatable solid panels 104, and interchangeable slideable rotatable breathable ornamental double-sized panels 105 in the directions of arrows 131, 132, and 133 (See FIG. 61B);

b) When the tea table is functioning as a grooming station, providing support for interchangeable multi-positionable slideable rotatable umbrella-pole-receiving panels 102, interchangeable slideable rotatable solid panels 104, and interchangeable slideable rotatable breathable ornamental double-sized panels 105 in the directions of arrows 131, 132, and 133 (See FIG. 62);

c) When the tea table is functioning as a drying platform, providing support for interchangeable multi-positionable slideable rotatable umbrella-pole-receiving panels 102, interchangeable slideable rotatable solid panels 104, and interchangeable slideable rotatable breathable ornamental double-sized panels 105 in the directions of arrows 131, 132, and 133 (See FIG. 62);

d) When the tea table is functioning as a storage locker, providing support for interchangeable multi-positionable slideable rotatable umbrella-pole-receiving panels 102, interchangeable slideable rotatable solid panels 104, and interchangeable slideable rotatable breathable ornamental double-sized panels 105
in the directions of arrows 131, 132, and 133
(See FIG. 61A);

e) When the tea table is functioning as a table, providing support for interchangeable multi-positionable slideable rotatable umbrella-pole-receiving panels 102, interchangeable slideable rotatable solid panels 104, and interchangeable slideable rotatable breathable ornamental double-sized panels 105
in the directions of arrows 131, 132, and 133
(See FIG. 50, FIG. 51, FIG. 53B, FIG. 53C, FIG. 63, and FIG. 64); and f) When the tea table is functioning as a cooler, providing support for interchangeable multi-positionable slideable rotatable umbrella-pole-receiving panels 102, interchangeable slideable rotatable solid panels 104, and interchangeable slideable rotatable breathable ornamental double-sized panels 105
in the directions of arrows 131, 132, and 133
(See FIG. 20D).

11) Side-panel-securing support frame 111 is (or are respectively) for:

a) When the tea table is functioning as a kennel, providing support for interchangeable multi-positionable slideable rotatable umbrella-pole-receiving panels 102, interchangeable slideable rotatable solid panels 104, and interchangeable slideable rotatable breathable ornamental double-sized panels 105
(See FIG. 61B);

b) When the tea table is functioning as a grooming station, providing support for interchangeable multi-positionable slideable rotatable umbrella-pole-receiving panels 102, interchangeable slideable rotatable solid panels 104, and interchangeable slideable rotatable breathable ornamental double-sized panels 105
(See FIG. 62);

c) When the tea table is functioning as a drying platform, providing support for interchangeable multi-positionable slideable rotatable umbrella-pole-receiving panels 102, interchangeable slideable rotatable solid panels 104, and interchangeable slideable rotatable breathable ornamental double-sized panels 105
(See FIG. 62);

d) When the tea table is functioning as a storage locker, providing support for interchangeable multi-positionable slideable rotatable umbrella-pole-receiving panels 102, interchangeable slideable rotatable solid panels 104, and interchangeable slideable rotatable breathable ornamental double-sized panels 105
(See FIG. 61A);

e) When the tea table is functioning as a table, providing support for interchangeable multi-positionable slideable rotatable umbrella-pole-receiving panels 102, interchangeable slideable rotatable solid panels 104, and interchangeable slideable rotatable breathable ornamental double-sized panels 105
(See FIG. 50, FIG. 51, FIG. 53B, FIG. 53C, FIG. 63, and FIG. 64); and f) When the tea table is functioning as a cooler, providing support for interchangeable multi-positionable slideable rotatable umbrella-pole-receiving panels 102, interchangeable slideable rotatable solid panels 104, and interchangeable slideable rotatable breathable ornamental double-sized panels 105
(See FIG. 20D).

12) Breathable bottom support frame 112 is (or are respectively) for:

a) When used as a kennel, providing structural rigidity to the tea table
(See FIG. 61B);

b) When used as a grooming station, providing structural rigidity to the tea table
(See FIG. 62);

c) When used as a drying platform, providing structural rigidity to the tea table
(See FIG. 62);

d) When used as a storage locker, providing structural rigidity to the tea table
(See FIG. 61A);

e) When used as a table, providing structural rigidity to the tea table
(See FIG. 50, FIG. 51, FIG. 53B, FIG. 53C, FIG. 63, and FIG. 64); and f) When used as a cooler, providing structural rigidity to the tea table
(See FIG. 20D).

13) Threaded bolt holes 113 is (or are respectively) for:
Providing a threaded hole for inserting panel-attaching bolts 108, frame-securing bolts 114, and/or base-plate-securing bolts 121.

14) Frame-securing bolts 114 is (or are respectively) for:
Attaching top-panel-securing support frame 110, side-panel-securing support frame 111, and/or breathable bottom support frame 112 to each other.

15) Adjustable rotatable tow-hitch-attaching fence-post attaching umbrella-pole receiver system 115 is (or are respectively) for performing the combined functions of its components.

Figure 54:
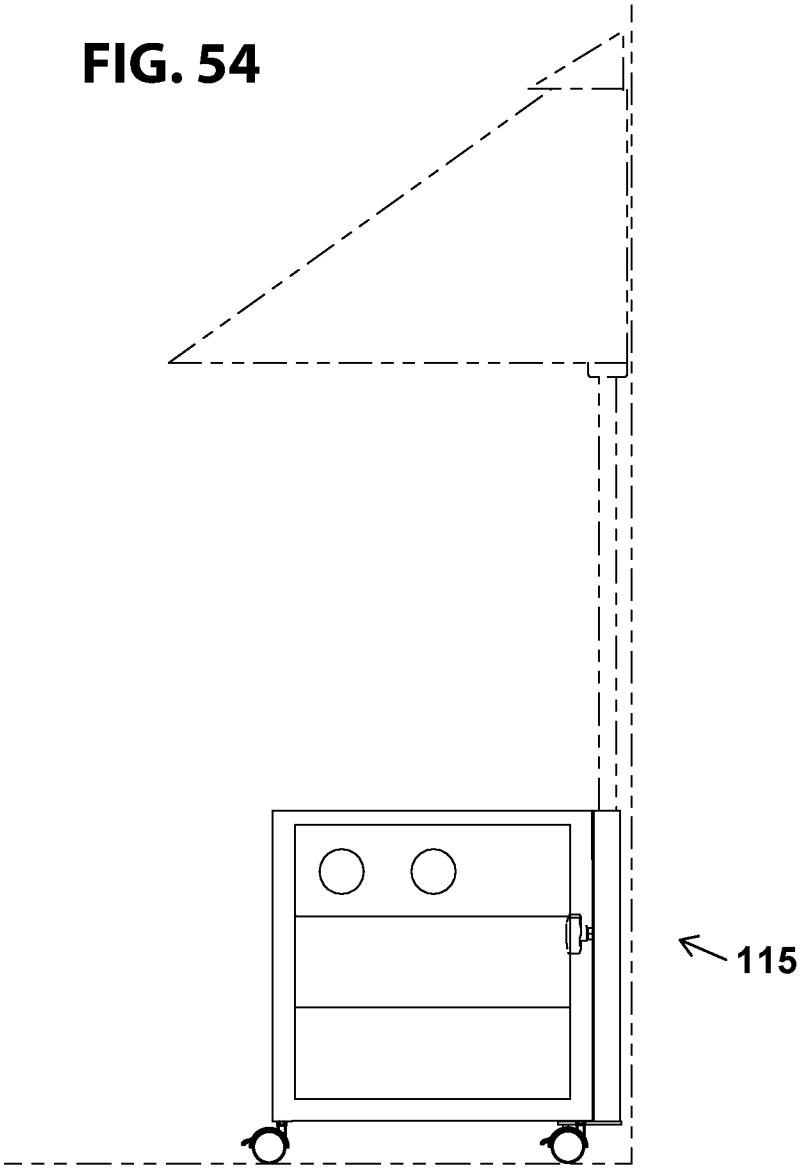
Figure 57:
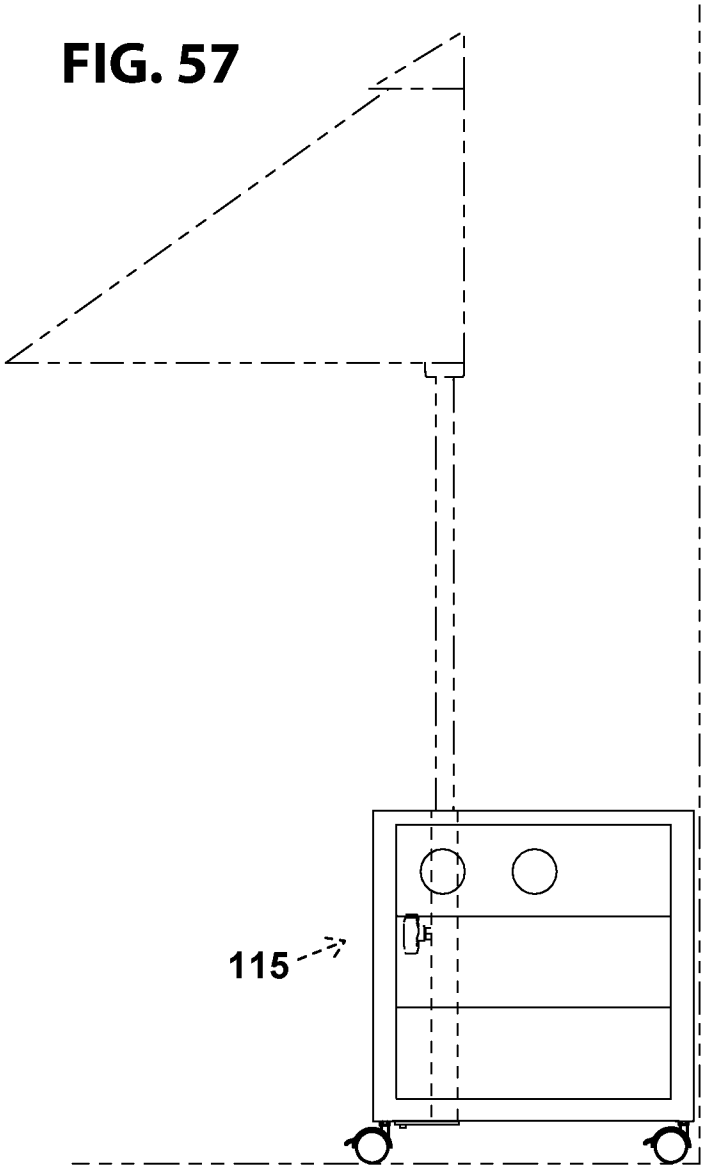
Figure 56:
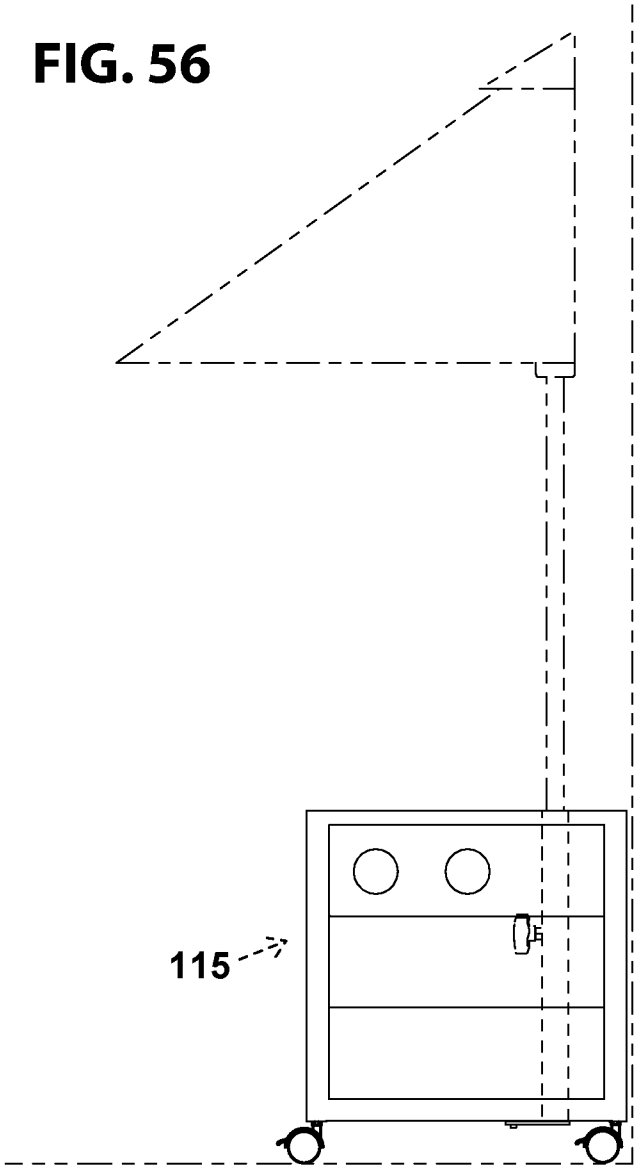
Figure 58:
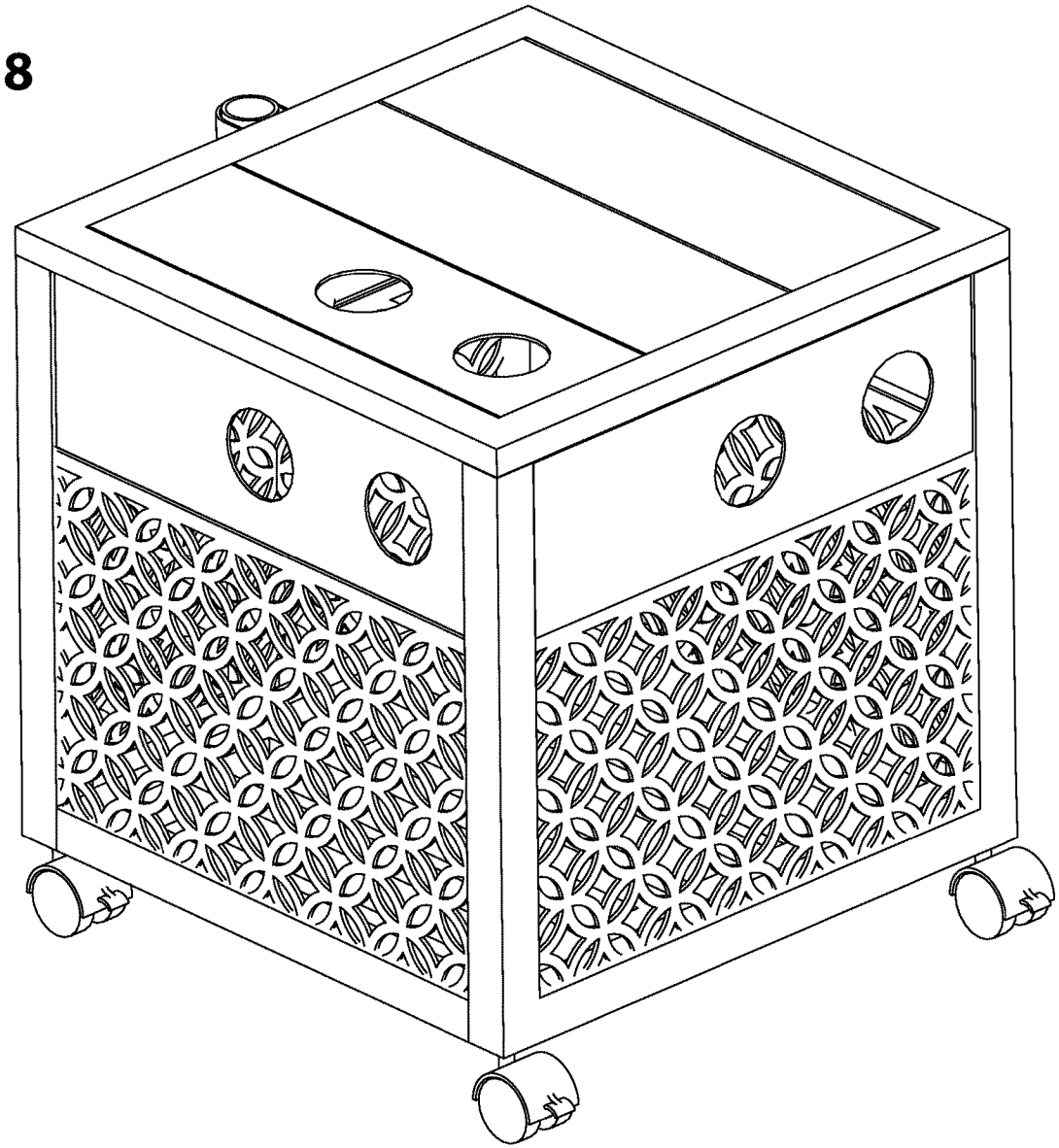
FIG. 58, FIG. 59, and FIG. 60 illustrate perspective views demonstrating how interchangeable slideable rotatable breathable ornamental double-sized panels 105 can be configured.
Figure 59:
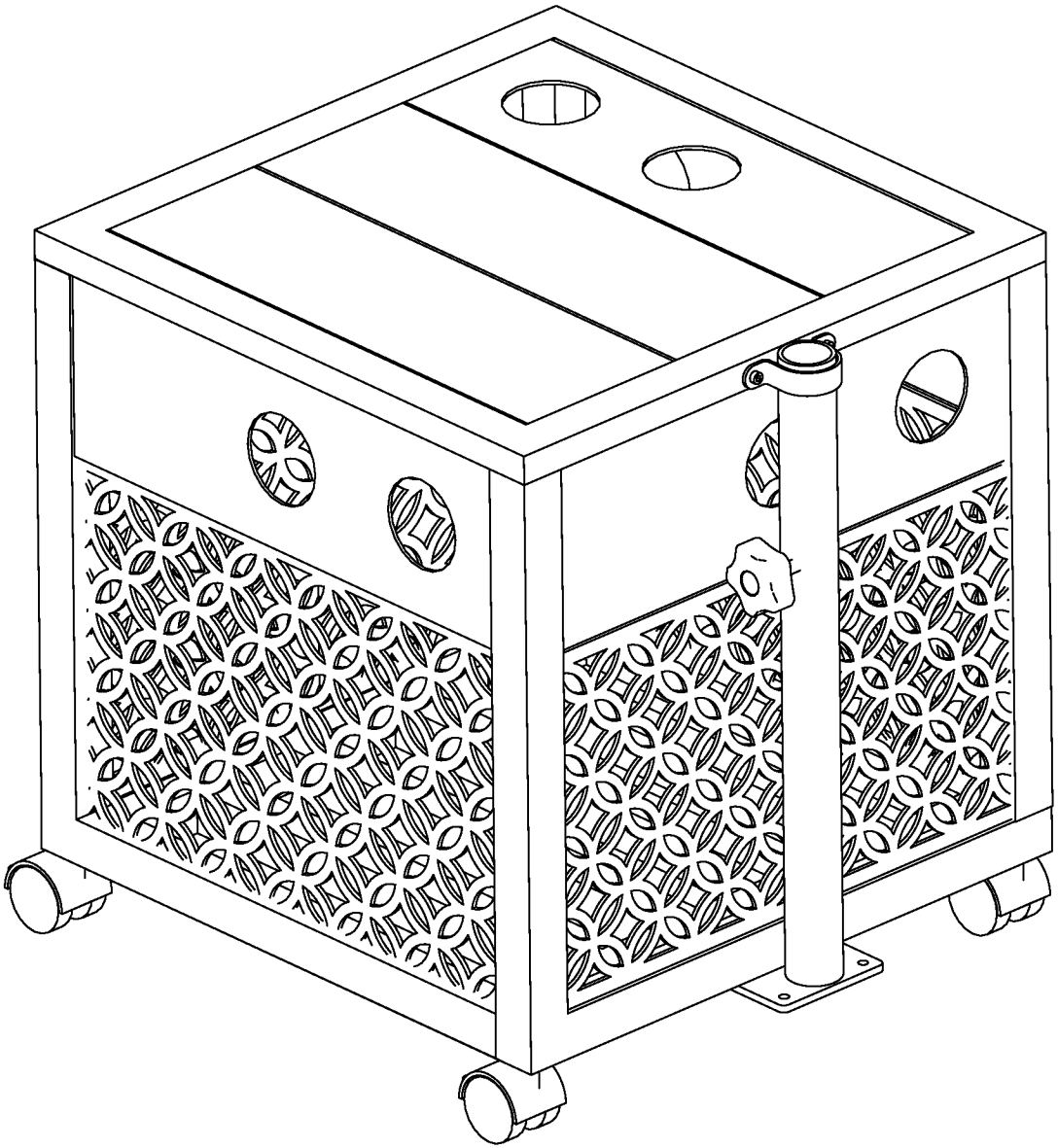
Figure 60:
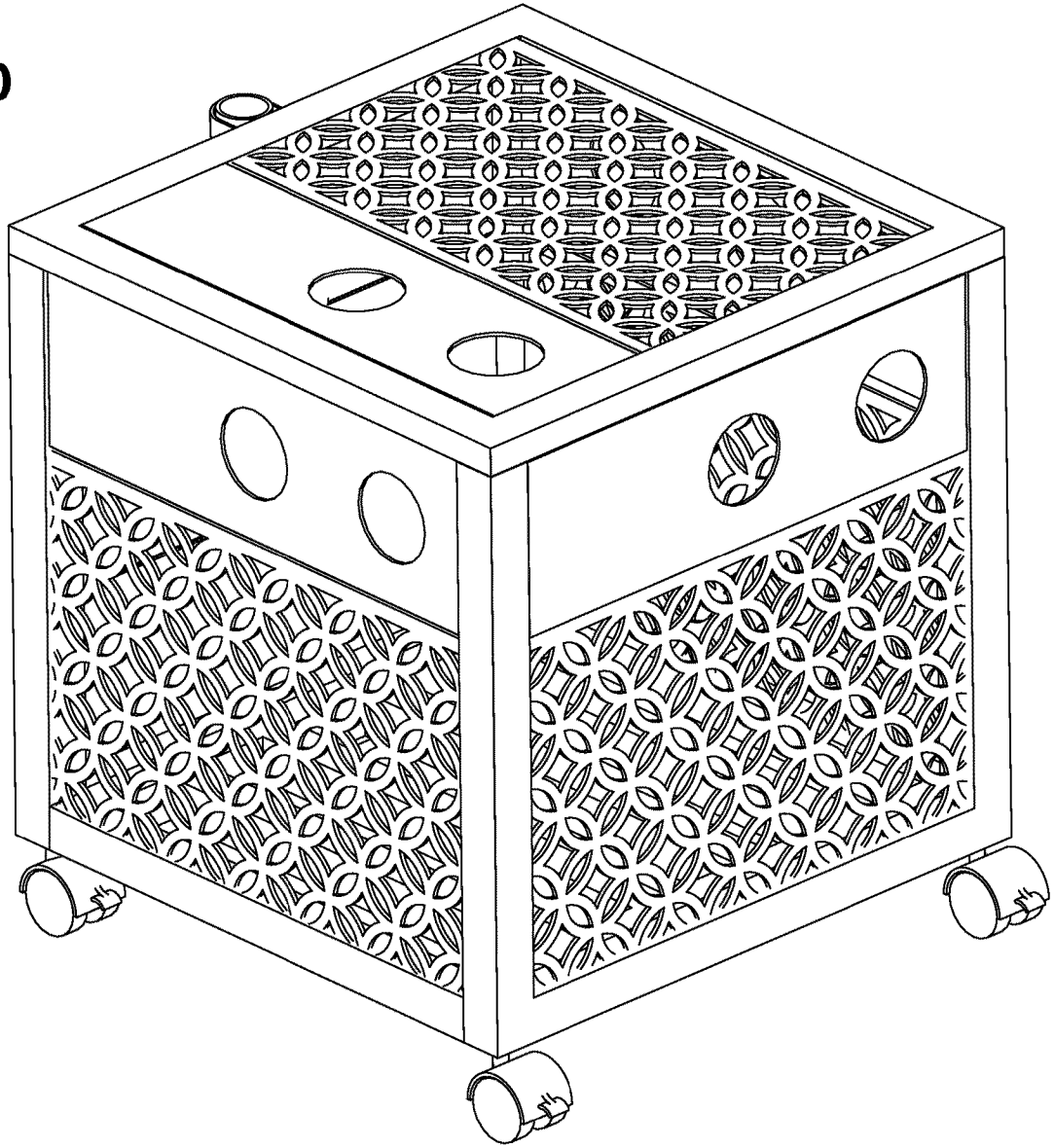
Figure 63:
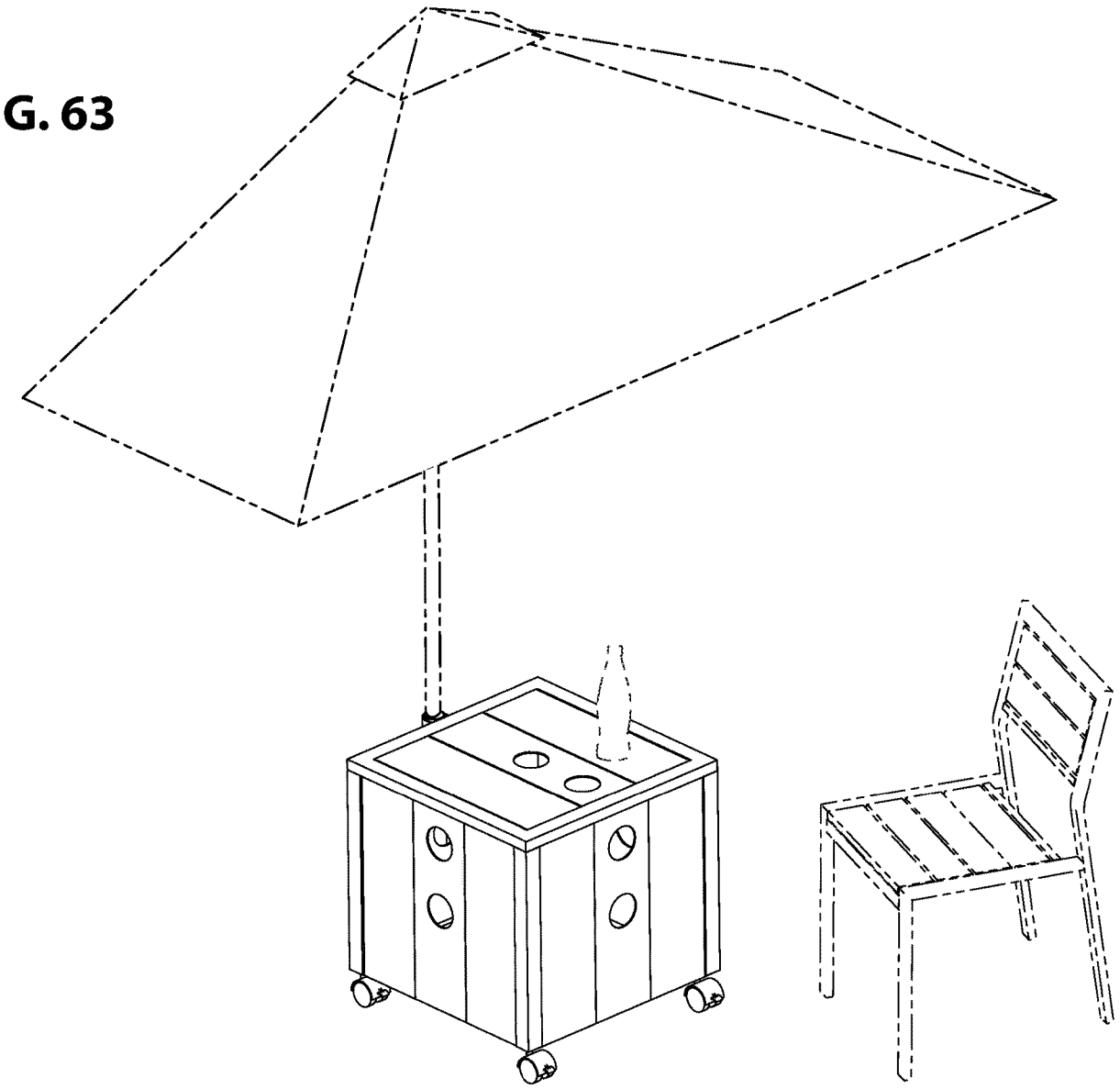
FIG. 63 and FIG. 64 illustrate perspective views demonstrating how a half-umbrella can be installed within adjustable rotatable tow-hitch-attaching fence-post attaching umbrella-pole receiver system 115.
Figure 68:
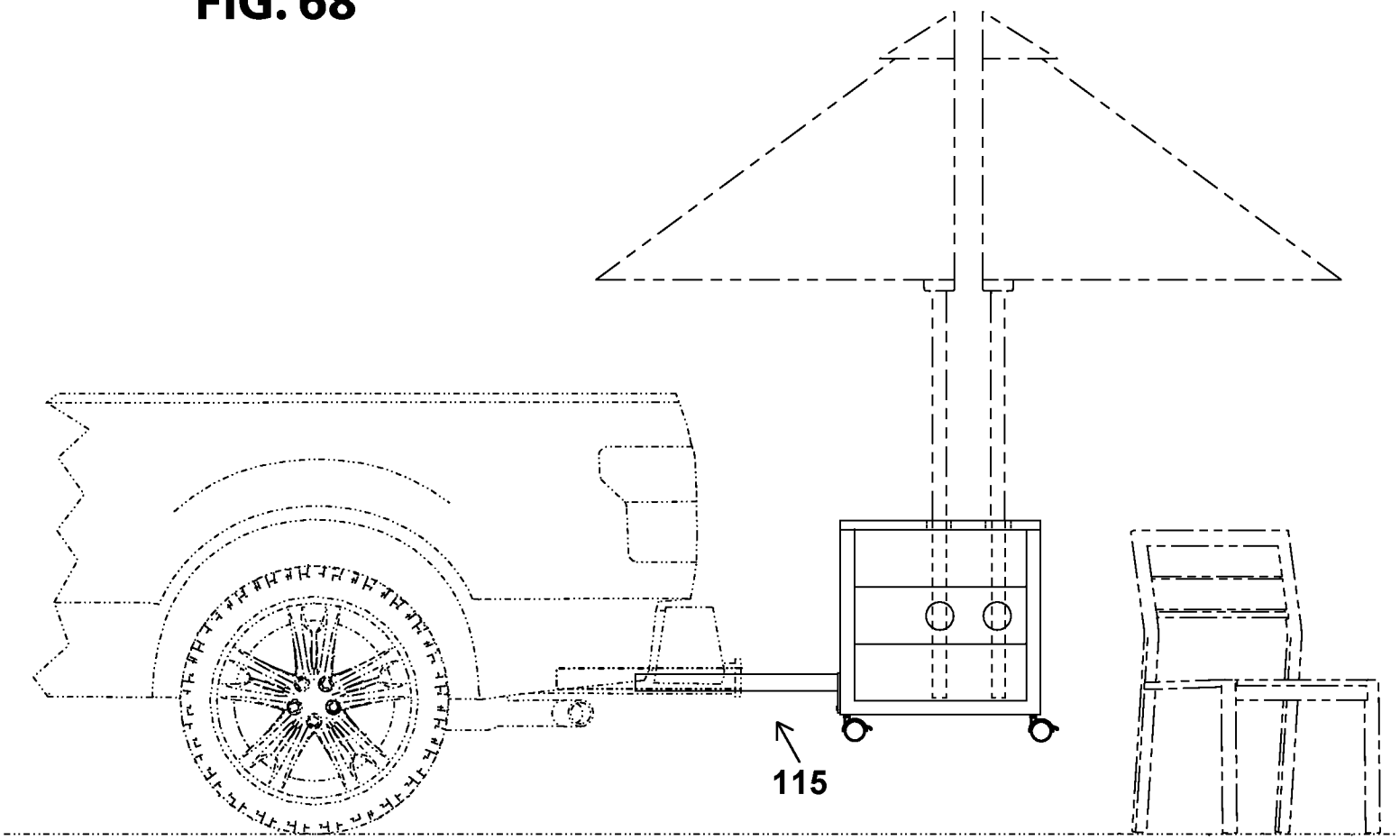
FIG. 68 illustrates a side view demonstrating how five-device-in-one multi-function multi-configurable hitch-mountable rollable rotatable collapsible tea table (capable of functioning as a pet kennel, a storage locker, a table, a cooler, and an umbrella base) can be attached to a trailer hitch with multiple half-umbrellas installed.
Figure 70A:
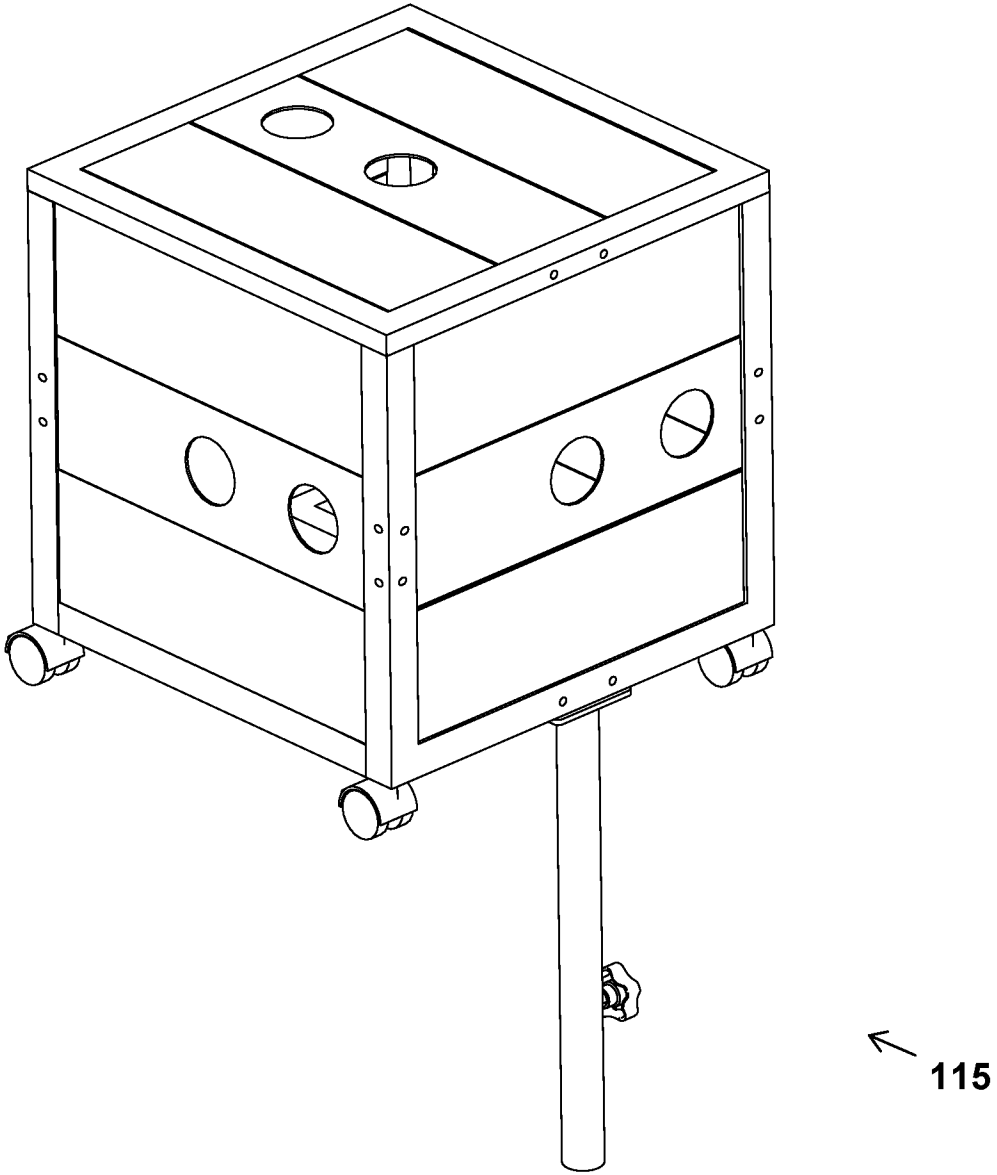
FIG. 70A illustrates a perspective view demonstrating how adjustable rotatable tow-hitch-attaching fence-post attaching umbrella-pole receiver system 115 can be mounted to and protruding vertically downward from side-panel-securing support frame 111.
Figure 70B:
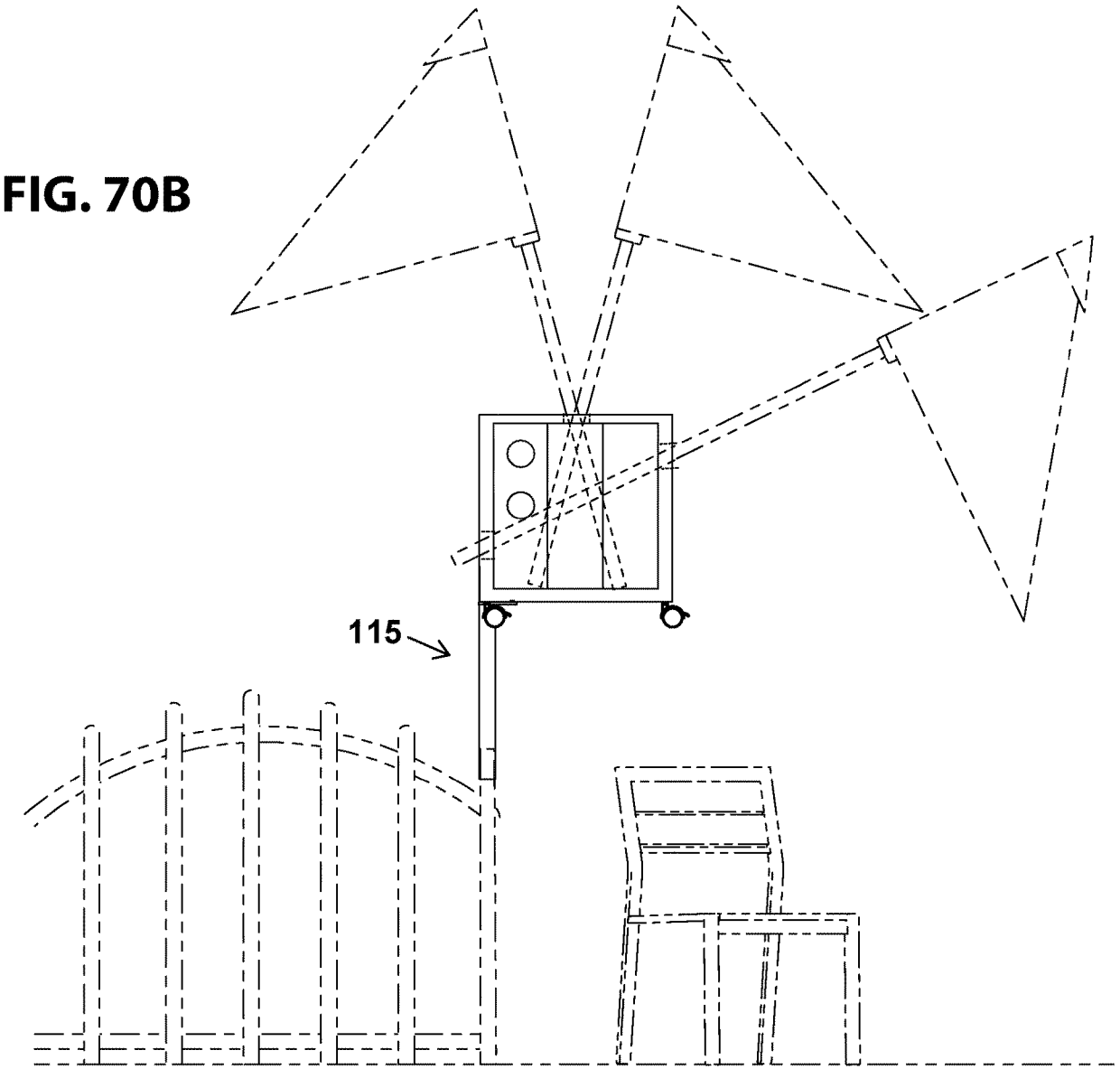
FIG. 70B illustrates a side view demonstrating how five-device-in-one multi-function multi-configurable hitch-mountable rollable rotatable collapsible tea table (capable of functioning as a pet kennel, a storage locker, a table, a cooler, and an umbrella base) can be mounted to a fence post with multiple half-umbrellas installed.
Figure 70C:
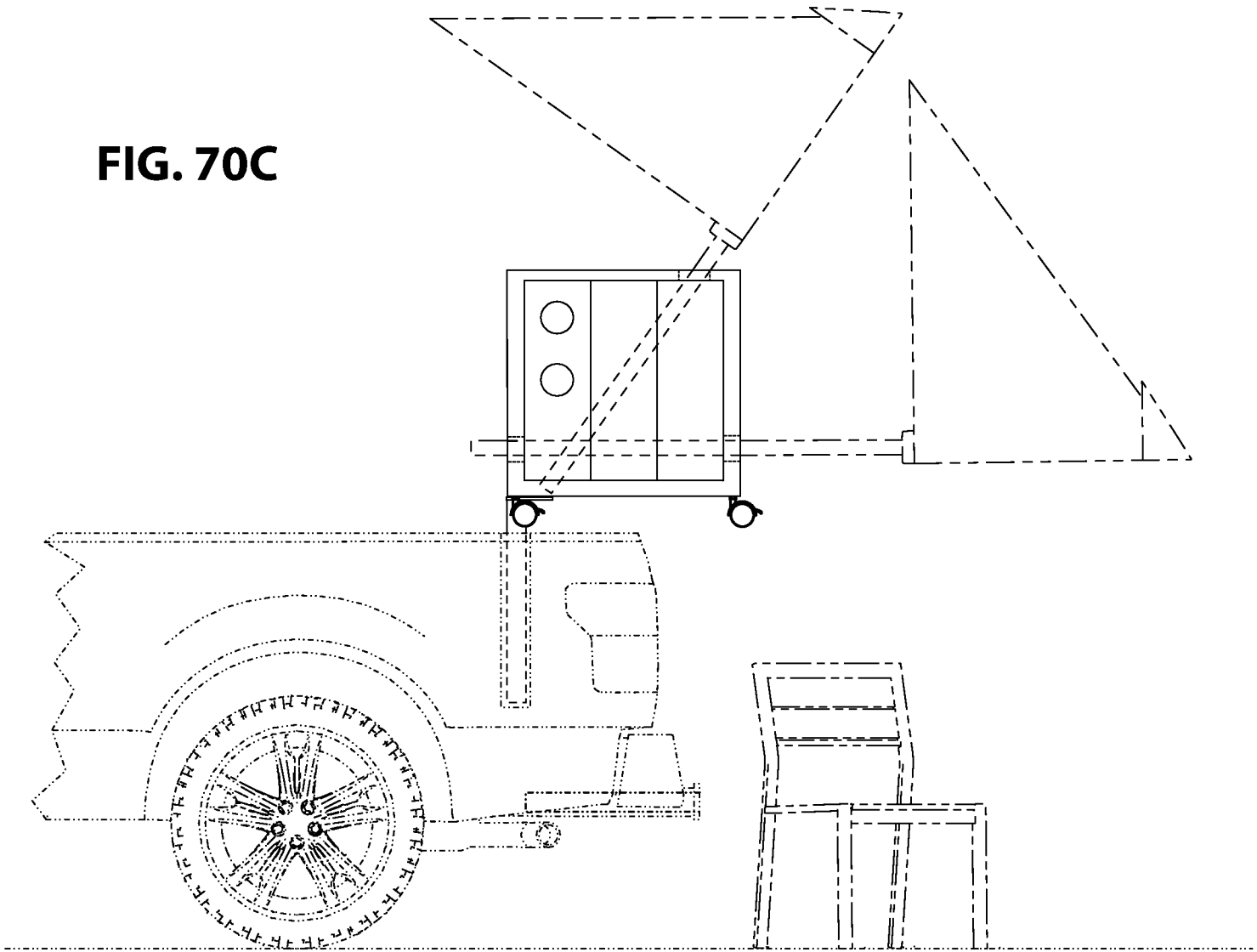
FIG. 70C illustrates a side view demonstrating how the five-device-in-one multi-function multi-configurable hitch-mountable rollable rotatable collapsible tea table (capable of functioning as a pet kennel, a storage locker, a table, a cooler, and an umbrella base) can be mounted to utility hole of a truck bed with multiple half-umbrellas installed.
Figure 72:
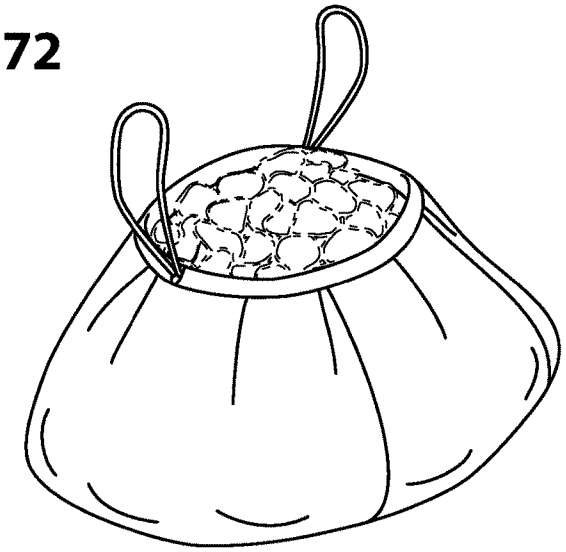
FIG. 71, FIG. 72, and FIG. 73 illustrate perspective views demonstrating how plastic-coated waterproof-fabric water-tight reinforce-stitched rock-fillable sand-fillable water-fillable ice-fillable cinchable backpack cinch-sack cooler ballast bag system 122 can be filled with sand, rocks, and/or water to act as a ballast.

16) Tow-hitch-attaching fence-post-attaching truck-utility-hole-inserting umbrella-pole-receiver shaft 116 is (or are respectively) for:

a) Vertically attaching an umbrella pole for shade and/or privacy
(see FIG. 54 and FIG. 63);

b) Horizontally attaching an umbrella pole to be used for shade and/or privacy
(see FIG. 65A and FIG. 68);

c) Slidably attaching to a fence post
(see FIG. 69A, FIG. 69B, and FIG. 70B);

d) Slidably attaching to a tow hitch receiver
(see FIG. 65B, FIG. 66D, and FIG. 68); and e) Slidably attaching to a utility hole of a pickup truck
(see FIG. 70C).

17) Tow-hitch-attaching fence-post-attaching umbrella-pole-receiver-shaft-securing bracket 117 is (or are respectively) for:
Securing tow-hitch-attaching fence-post-attaching truck-utility-hole-inserting umbrella-pole-receiver shaft 116 to top-panel-securing support frame 110, side-panel-securing support frame 111, or breathable bottom support frame 112
(see FIG. 1, FIG. 2, FIG. 3, FIG. 65, and FIG. 69).

18) Tow-hitch-attaching fence-post-attaching umbrella-pole-receiver-shaft-securing-bracket bolts 118 is (or are respectively) for:
Securing tow-hitch-attaching fence-post-attaching umbrella-pole-receiver-shaft-securing bracket 117 to top-panel-securing support frame 110, side-panel-securing support frame 111, or breathable bottom support frame 112.

19) Tow-hitch-attaching fence-post-attaching umbrella-pole-securing hand-screw 119 is (or are respectively) for:

Securing umbrella pole, tow-hitch receiver, and/or fence pole to tow-hitch-attaching fence-post-attaching truck-utility-hole-inserting umbrella-pole-receiver shaft 116 (see FIG. 54, FIG. 55, FIG. 56, FIG. 57, FIG. 64, FIG. 69B, and FIG. 70B).

20) Umbrella-pole-receiver-shaft-attaching base-plate 120 is (or are respectively) for:

Securing tow-hitch-attaching fence-post-attaching truck-utility-hole-inserting umbrella-pole-receiver shaft 116 to top-panel-securing support frame 110, side-panel-securing support frame 111, or breathable bottom support frame 112

Figure 64:
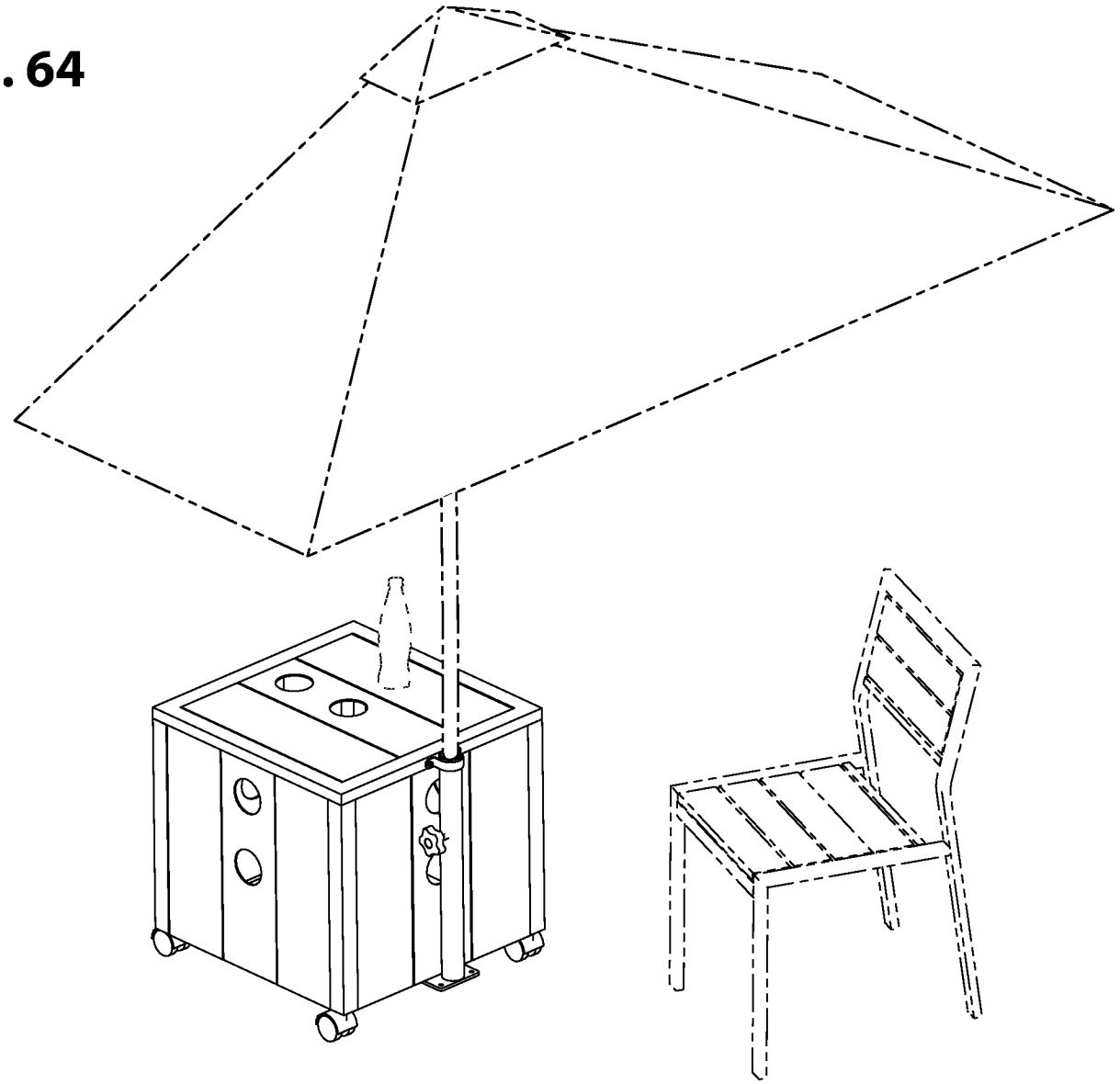

(see FIG. 64, FIG. 65B, and FIG. 69A).

21) Base-plate-securing bolts 121 is (or are respectively) for:

Securing umbrella-pole-receiver-shaft-attaching base-plate 120 to top-panel-securing support frame 110, side-panel-securing support frame 111, or breathable bottom support frame 112.

22) Plastic-coated waterproof-fabric water-tight reinforce-stitched rock-fillable sand-fillable water-fillable ice-fillable cinchable backpack cinch-sack cooler ballast bag system 122 is (or are respectively) for performing the combined functions of its components.

Figure 74:
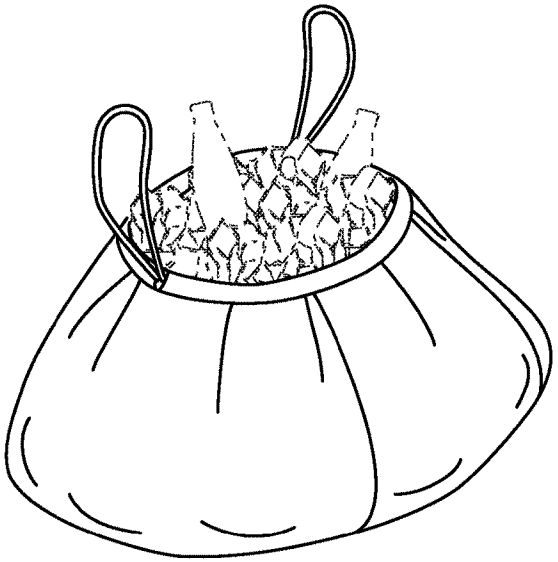
FIG. 74 illustrates a perspective view demonstrating how the plastic-coated waterproof-fabric water-tight reinforce-stitched rock-fillable sand-fillable water-fillable ice-fillable cinchable backpack cinch-sack cooler ballast bag system 122 can be filled with ice to act as a ballast and/or a cooler.
Figure 71:
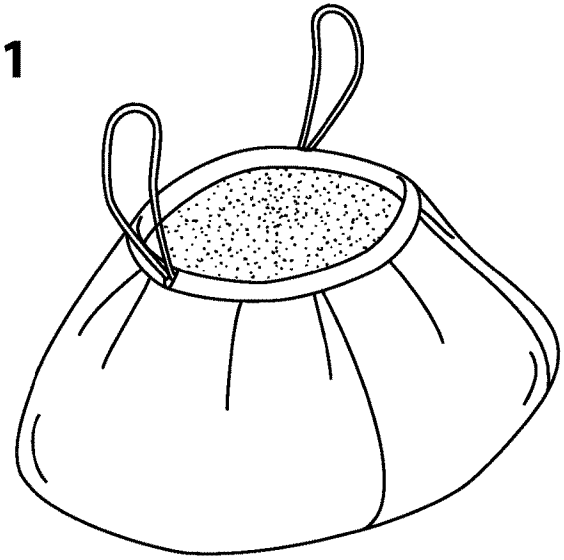
Figure 73:
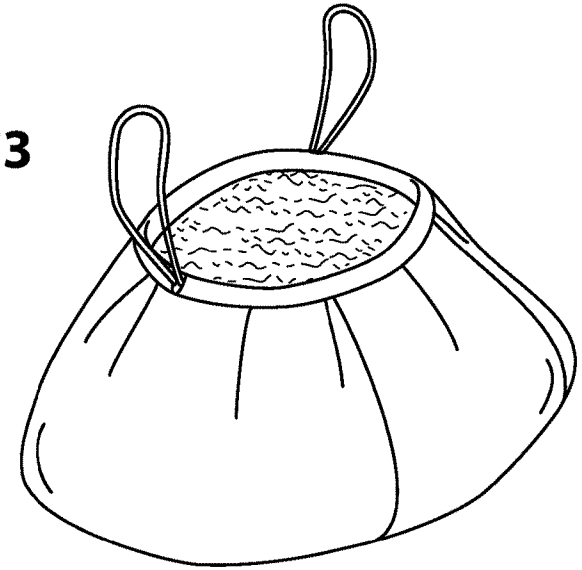
Figure 75:
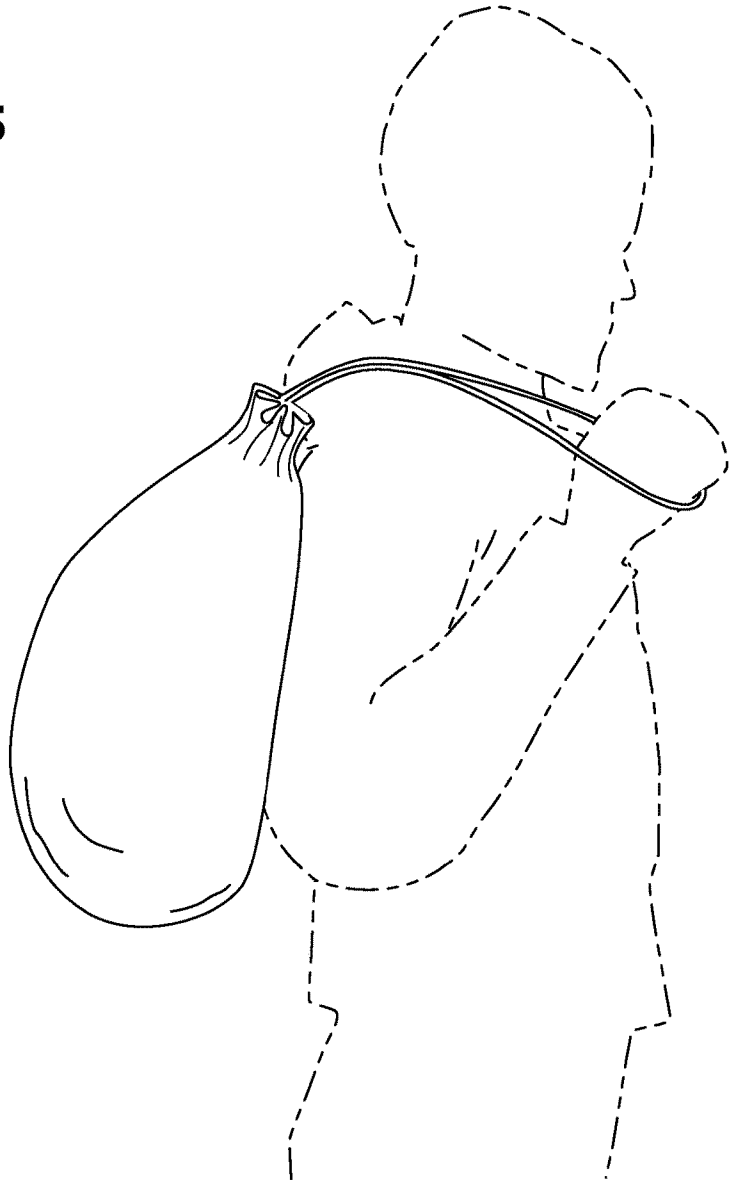
FIG. 75 illustrates a perspective view demonstrating how plastic-coated waterproof-fabric water-tight reinforce-stitched rock-fillable sand-fillable water-fillable ice-fillable cinchable backpack cinch-sack cooler ballast bag system 122 can be filled used as a cinch-sack.
Figure 76:
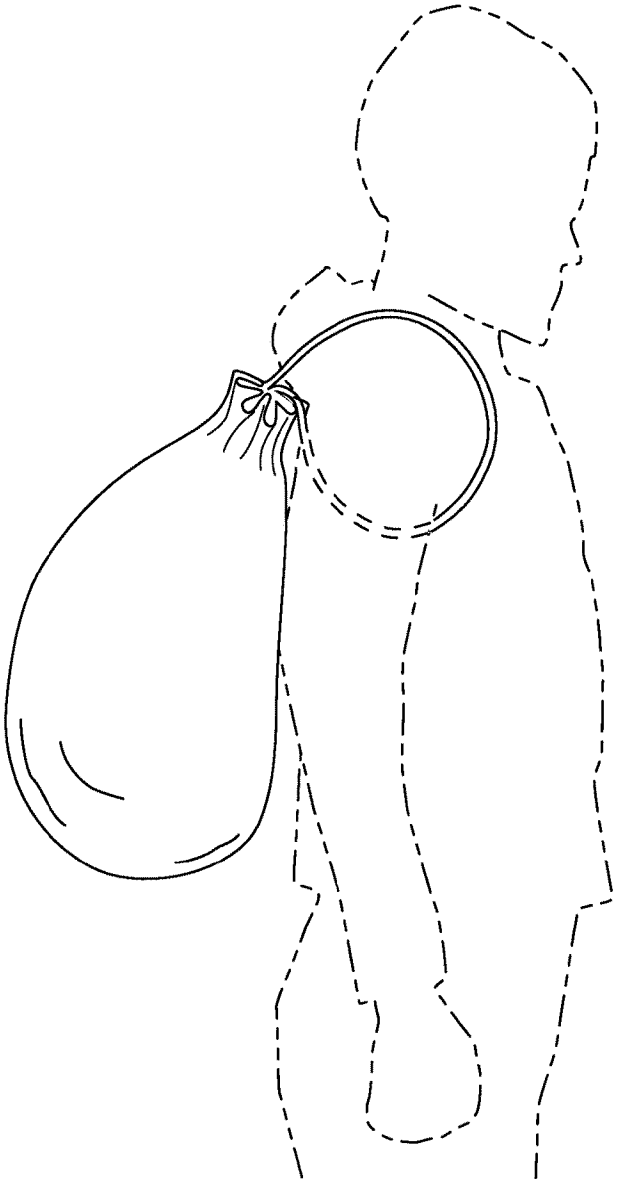
FIG. 76 illustrates a perspective view demonstrating how plastic-coated waterproof-fabric water-tight reinforce-stitched rock-fillable sand-fillable water-fillable ice-fillable cinchable backpack cinch-sack cooler ballast bag system 122 can be filled used as a backpack.
Figure 77:
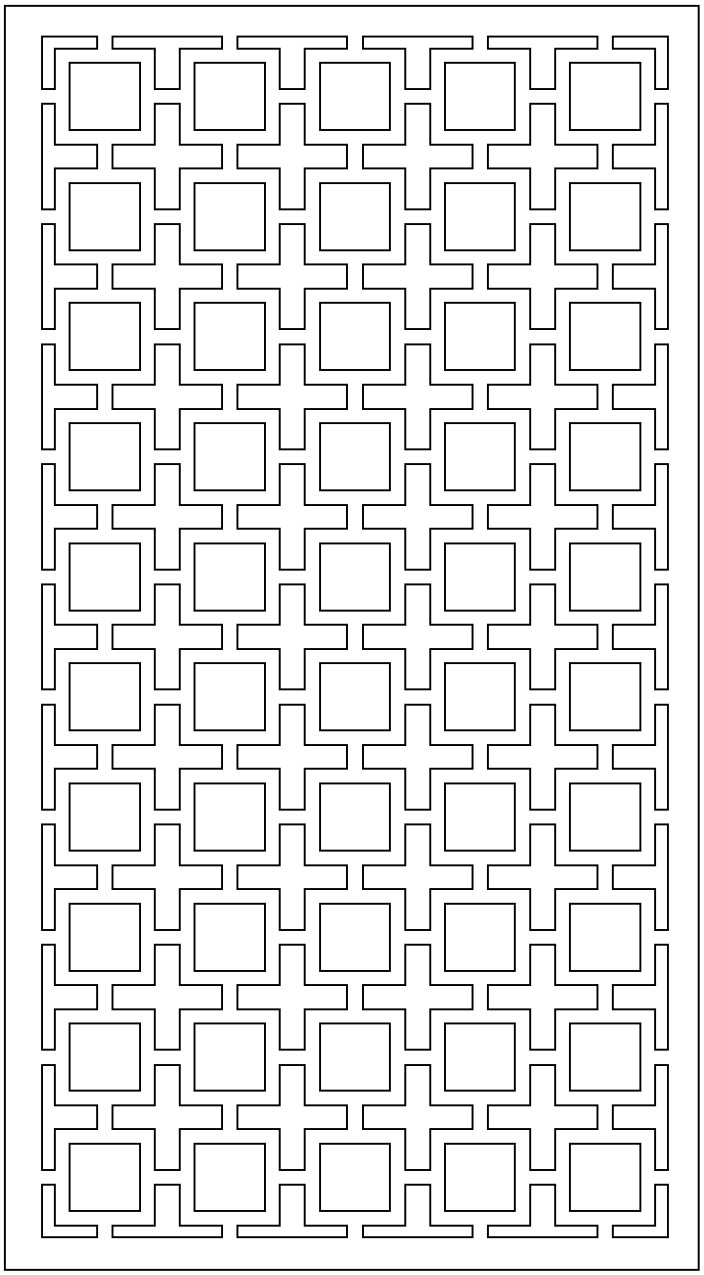
FIG. 77, FIG. 78, FIG. 79, FIG. 80, FIG. 81, FIG. 82, FIG. 83, FIG. 84, FIG. 85, FIG. 86, FIG. 87, FIG. 88A, and FIG. 88B illustrate front views of equivalent variations of interchangeable slideable rotatable breathable ornamental double-sized panels 105.
Figure 78:
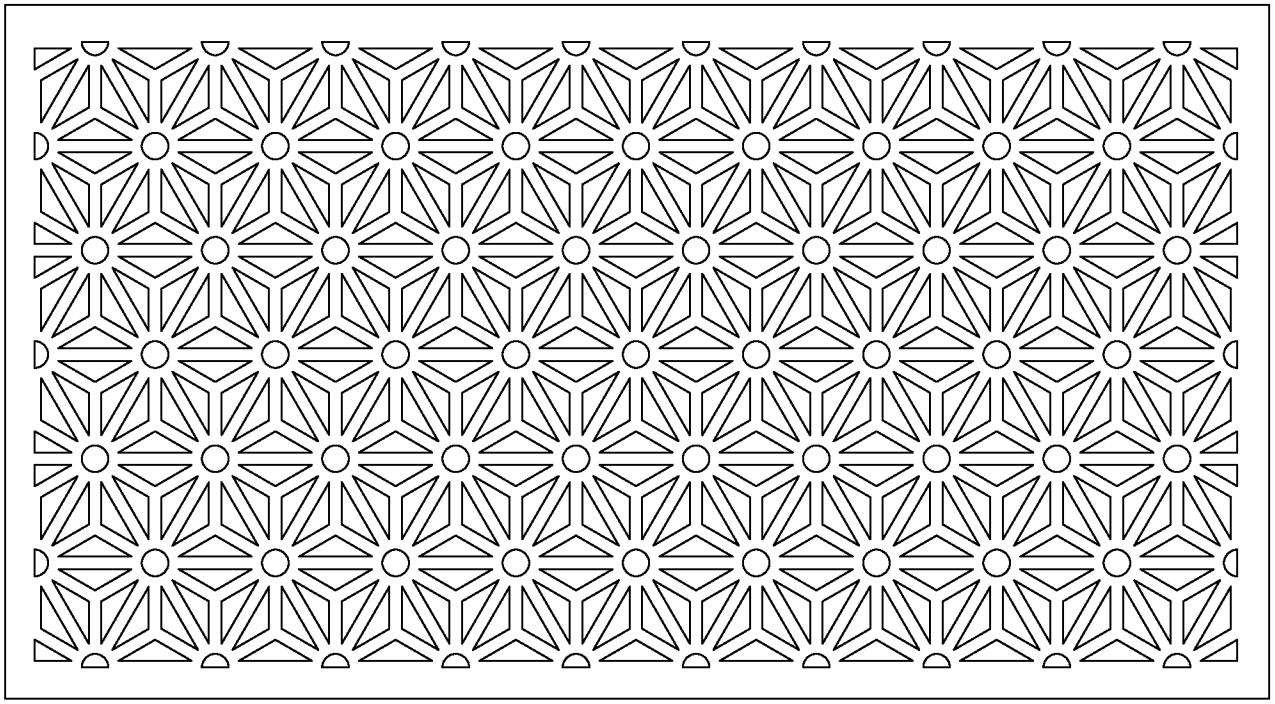
Figure 79:
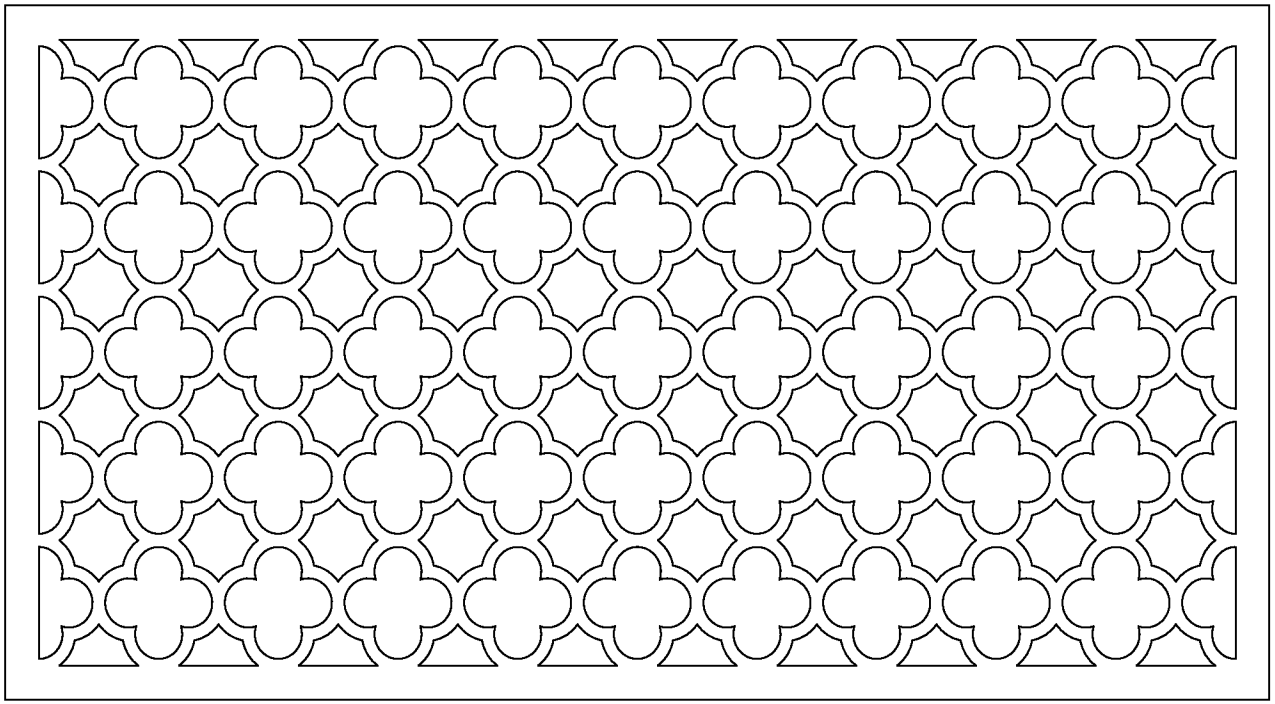
Figure 80:
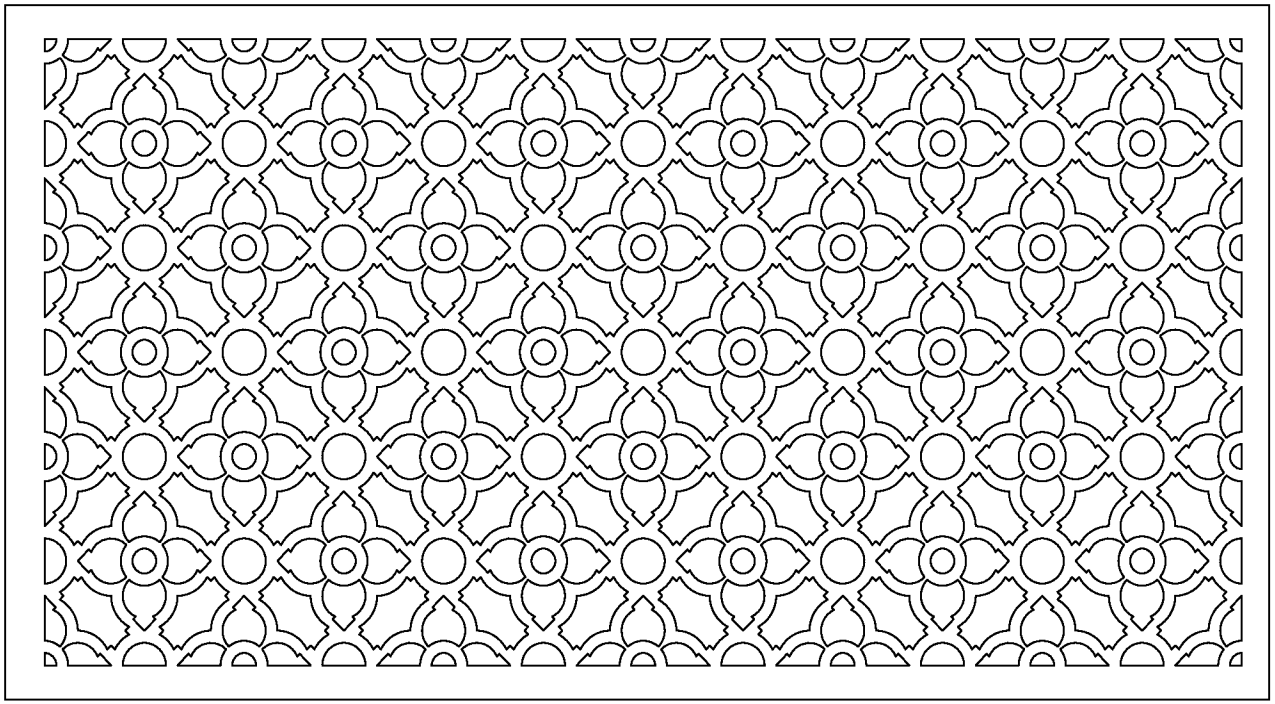
Figure 81:
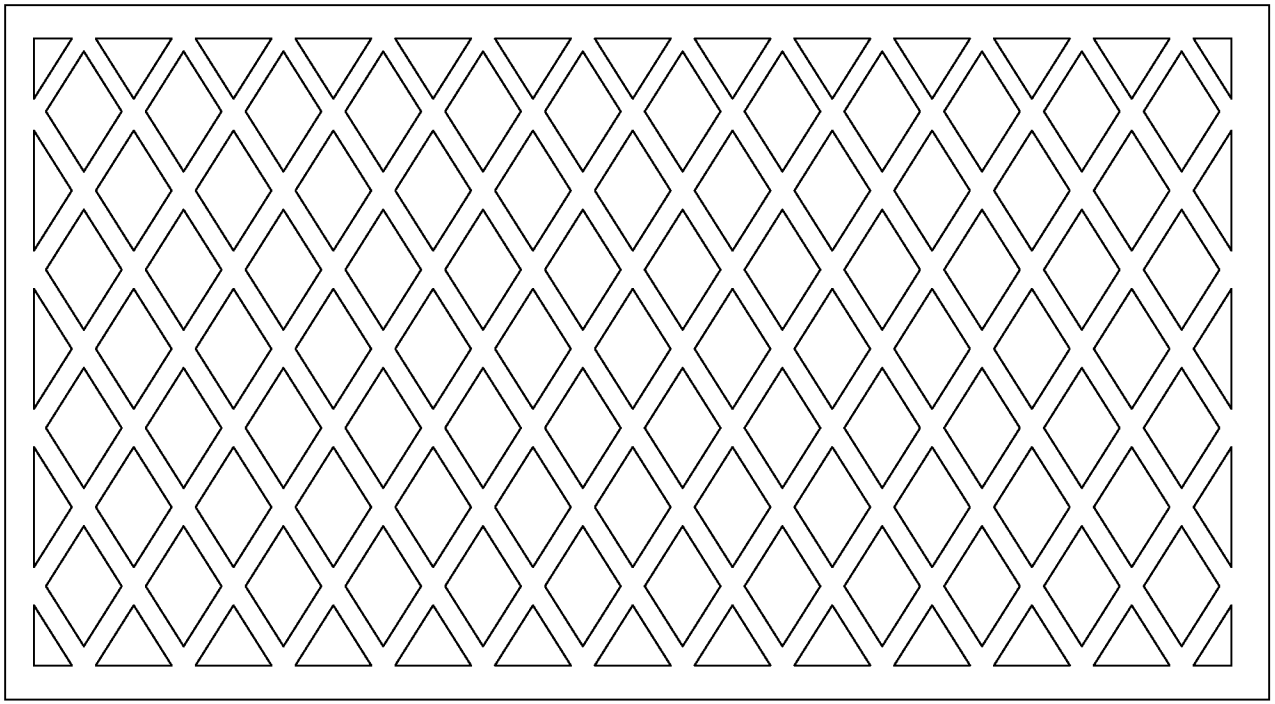
Figure 82:
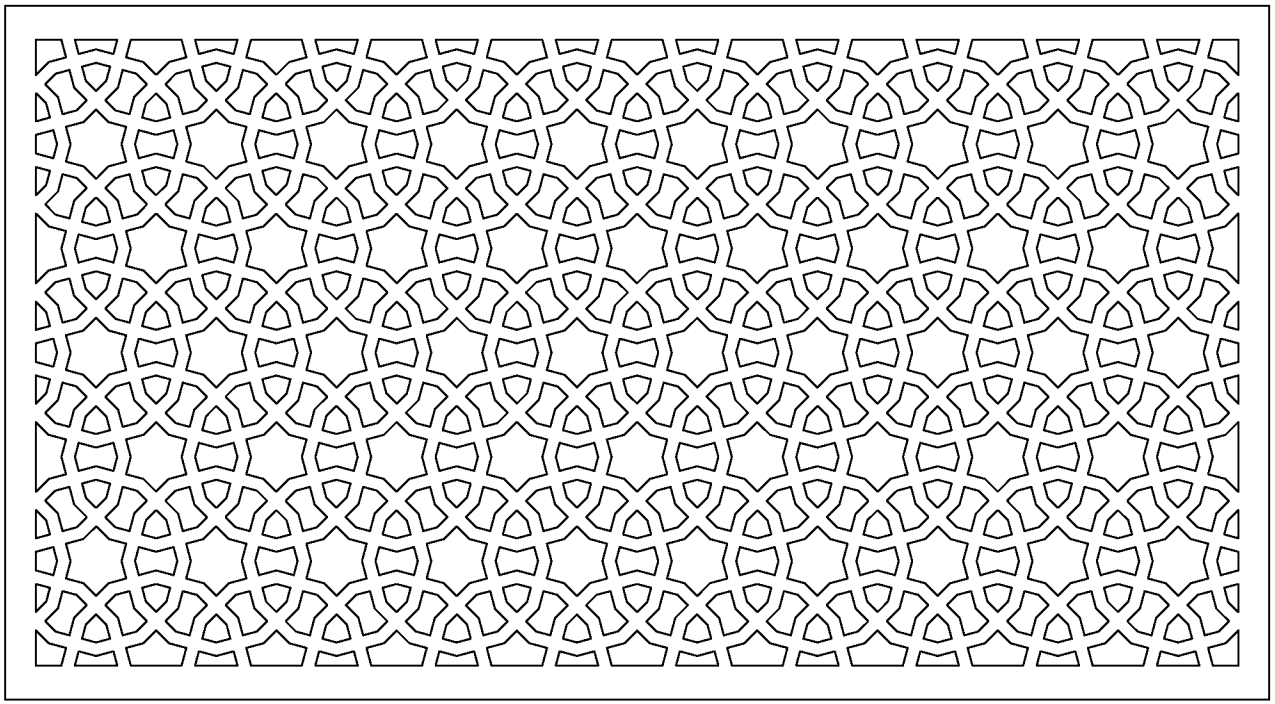
Figure 83:
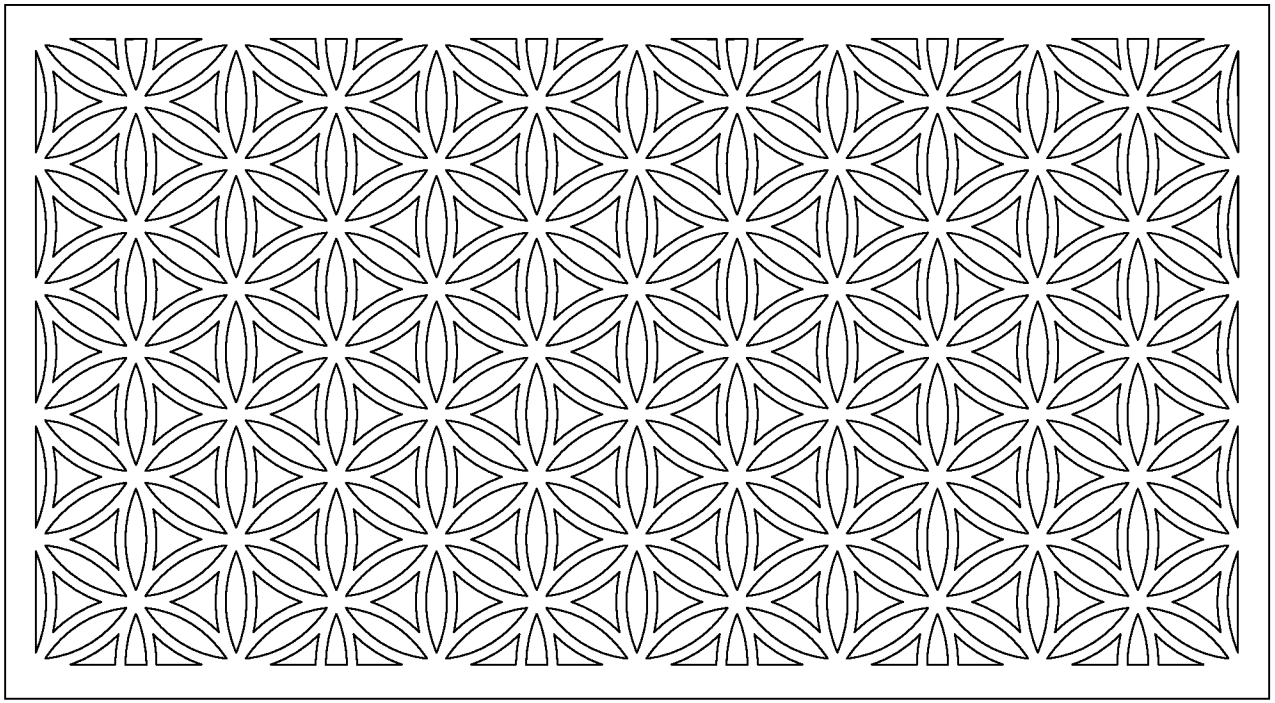
Figure 84:
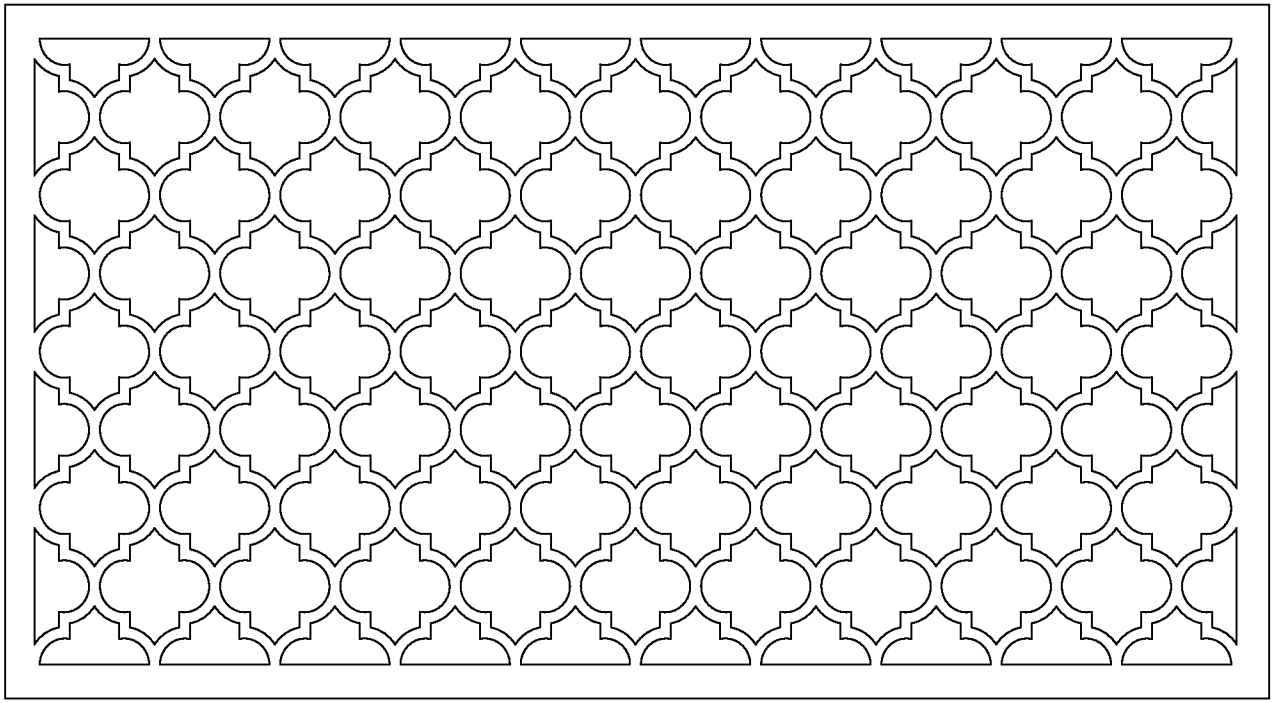
Figure 85:
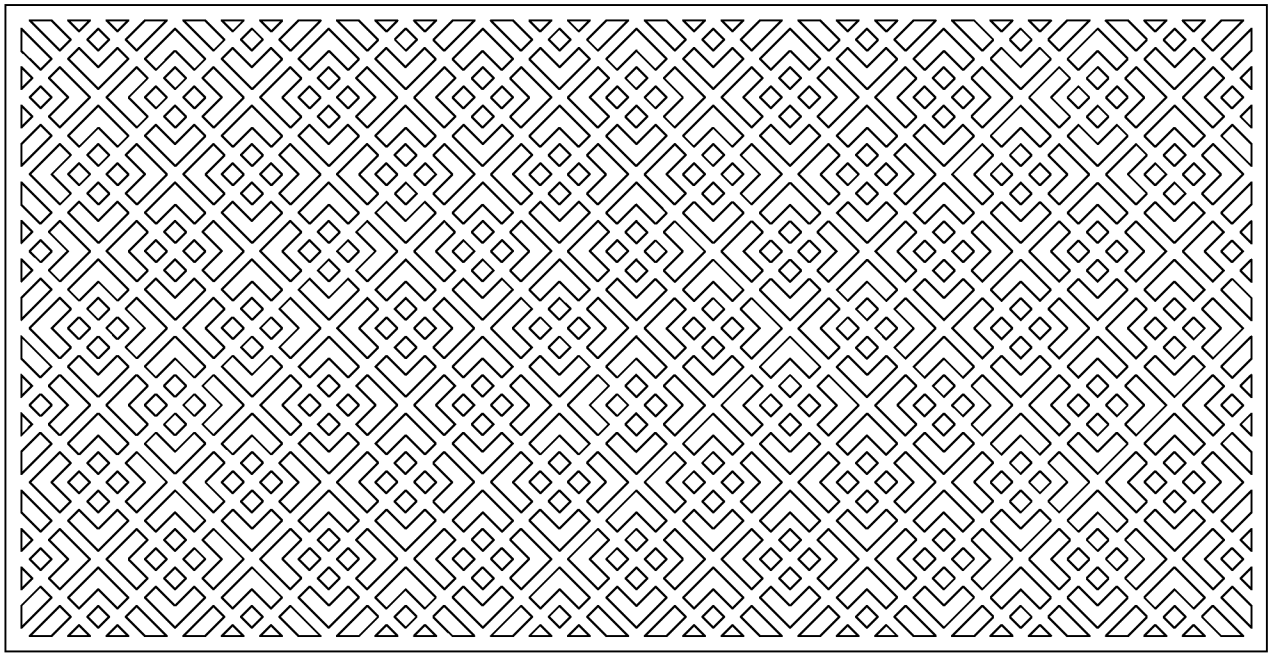
Figure 86:
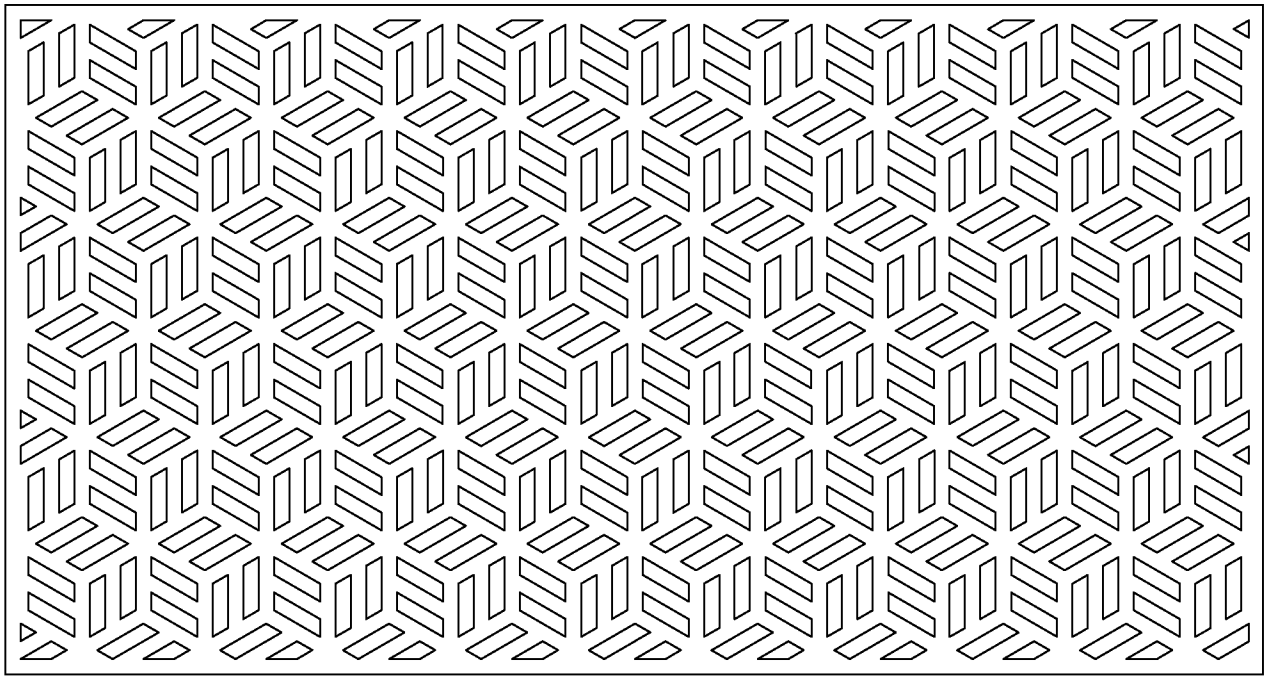
Figure 87:
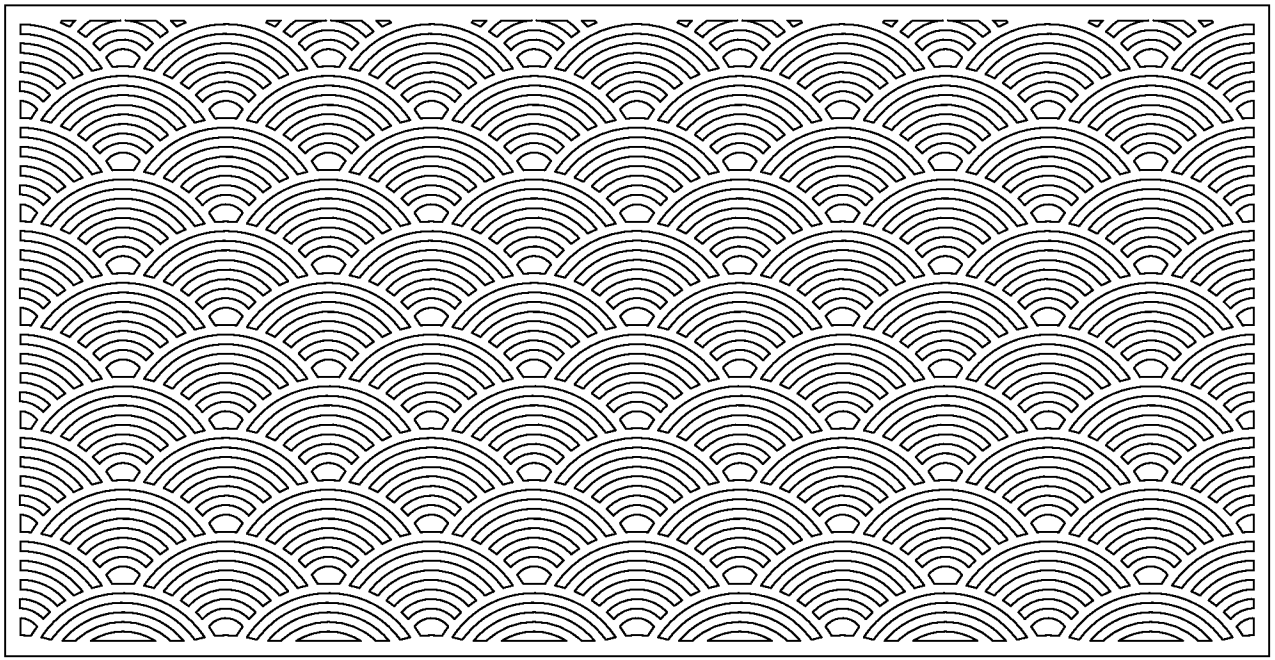
Figure 88A:
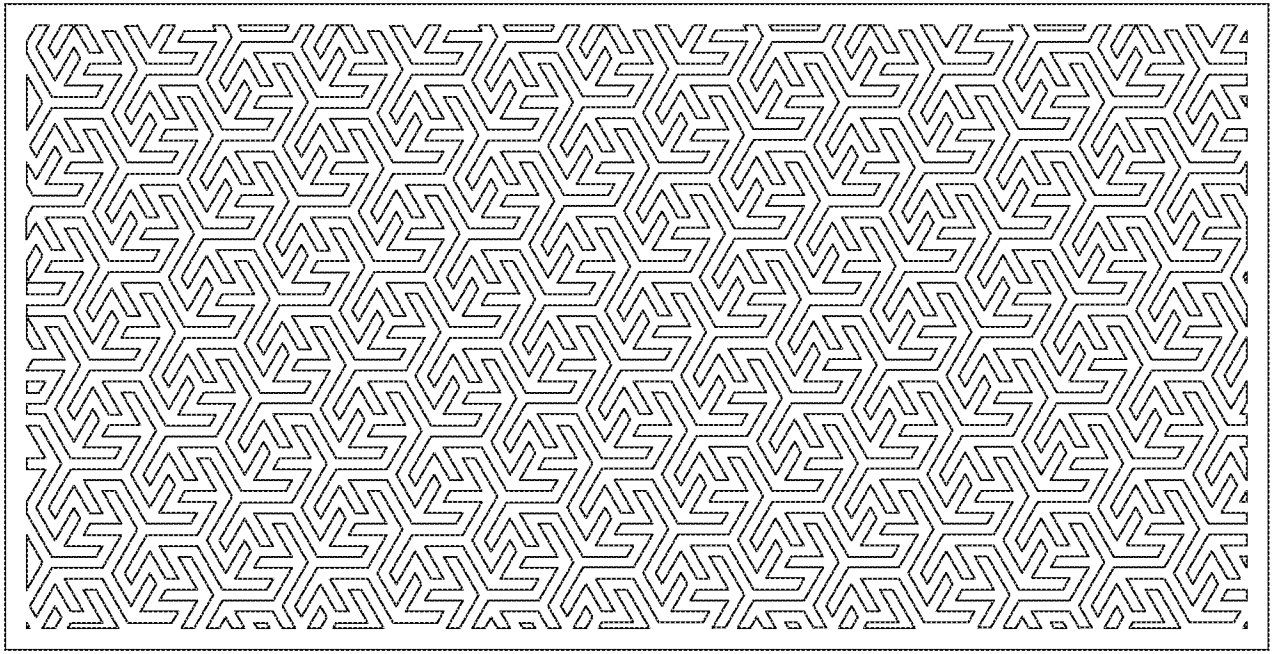
Figure 88B:
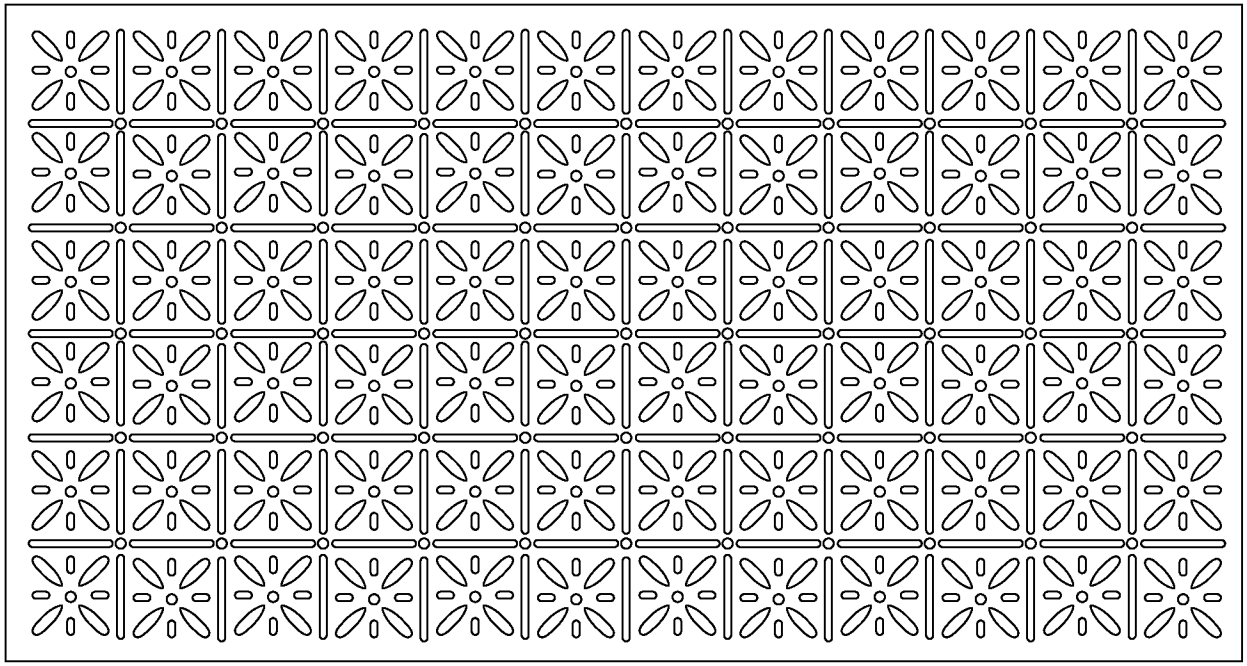
Figure 91:
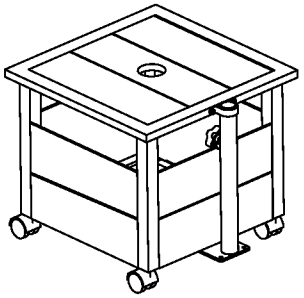
FIG. 89, FIG. 90, FIG. 91, FIG. 92, FIG. 93, and FIG. 94 illustrate top and perspective views of equivalent variations of five-device-in-one multi-function multi-configurable hitch-mountable rollable rotatable collapsible tea table (capable of functioning as a pet kennel, a storage locker, a table, a cooler, and an umbrella base).
Figure 94:
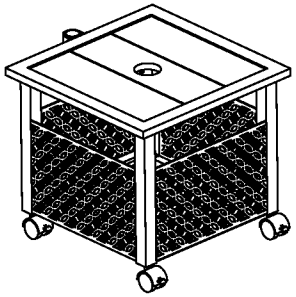
Figure 90:
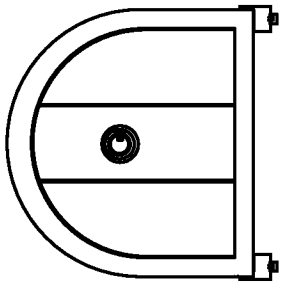
Figure 93:
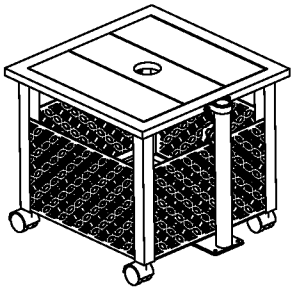
Figure 89:
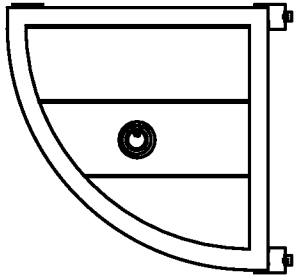
Figure 92:
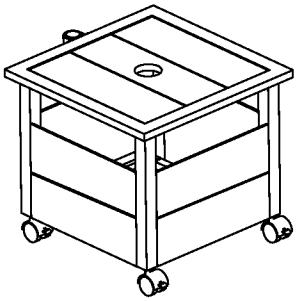

23) Plastic-coated waterproof-fabric water-tight reinforce-stitched walls 123 is (or are respectively) for:

a) Securely holding rocks, sand, and/or water to be a ballast to provide added stability to the tea table (see FIG. 20A, FIG. 20B, FIG. 20C, FIG. 20D, FIG. 71, FIG. 72, FIG. 73, and FIG. 74);

b) Waterproofedly and insulatedly holding ice to function as a cooler (see FIG. 20D and FIG. 74);

c) Securing contents when functioning as a cinch-sack (see FIG. 75); and d) Protecting contents when functioning as a backpack (see FIG. 76).

24) Plastic-coated waterproof-fabric reinforce-stitched cord tunnels 124 is (or are respectively) for:

Providing a tunnel where cinchable tieable backpack cinch-sack shoulder-strap content-securing cord 125 can be cinched to secure contents inside (see FIG. 20A, FIG. 20B, FIG. 20C, FIG. 20D, FIG. 71, FIG. 72, FIG. 73, FIG. 74, FIG. 74, FIG. 75, and FIG. 76).

25) Cinchable tieable backpack cinch-sack shoulder-strap content-securing cord 125 is (or are respectively) for:

a) Cinchably securing contents inside (see FIG. 20A, FIG. 20B, FIG. 20C, FIG. 20D, FIG. 71, FIG. 72, FIG. 73, FIG. 74, FIG. 75, and FIG. 76);

b) Acting as cinching-straps when functioning as cinch-sack (see FIG. 75); and c) Wearably providing shoulder straps when functioning as a backpack (see FIG. 76).

26) Lockable pivotable caster system 126 is (or are respectively) for performing the combined functions of its components.

27) Pivoting locking frame-connecting caster pins 127 is (or are respectively) for:

Rotatably connecting lockable pivotable caster system 126 to side-panel-securing support frame 111.

28) Caster-wheel shields 128 is (or are respectively) for:

Protecting caster wheels 130.

29) Caster-wheel-locking switches 129 is (or are respectively) for:

Locking caster wheels 130.

30) Caster wheels 130 is (or are respectively) for:

Rollably allowing five-device-in-one multi-function multi-configurable hitch-mountable rollable rotatable collapsible pet-kennel storage-locker table cooler umbrella base to be moved along a ground surface.

Variation

FIG. 77, FIG. 78, FIG. 79, FIG. 80, FIG. 81, FIG. 82, FIG. 83, FIG. 84, FIG. 85, FIG. 86, FIG. 87, FIG. 88A, and FIG. 88B illustrate front views showing variations of interchangeable slideable rotatable breathable ornamental double-sized panels 105. FIG. 89, FIG. 90, FIG. 91, FIG. 92, FIG. 93, and FIG. 94 illustrate top and perspective views of equivalent variations of the five-device-in-one multi-function multi-configurable hitch-mountable rollable rotatable collapsible tea table (capable of functioning as a pet kennel, a storage locker, a table, a cooler, and an umbrella base).

Major Advantages of the Inventions

The new invention substantially departs from the conventional concepts and designs of the prior art. In doing so, the new invention provides (a or an) five-device-in-one multi-function multi-configurable hitch-mountable rollable rotatable collapsible tea table (capable of functioning as a pet kennel, a storage locker, a table, a cooler, and an umbrella base), having many unique and significant features, functions, and advantages, which overcome all the disadvantages of the prior art, as follows:

1) It is an object of the new invention to provide (a or an) five-device-in-one multi-function multi-configurable hitch-mountable rollable rotatable collapsible tea table, having interchangeable multi-positionable slideable rotatable umbrella-pole-receiving panels 102.

Therefore, the five-device-in-one multi-function multi-configurable hitch-mountable rollable rotatable collapsible tea table is (or are each):

a) Capable of acting as an interchangeable surface for multi-positionable umbrella-pole-receiving holes 103 to allow at least one umbrella pole to be inserted therein (See FIG. 1, FIG. 2, FIG. 3, FIG. 4, FIG. 23, FIG. 24, FIG. 25, FIG. 26, FIG. 27, FIG. 28, FIG. 29, FIG. 30, FIG. 31, FIG. 32, FIG. 33, FIG. 34, FIG. 35, FIG. 36, FIG. 37, FIG. 38, FIG. 39, FIG. 40, FIG. 41, FIG. 42, FIG. 43, FIG. 44, FIG. 45, FIG. 46, FIG. 47, FIG. 48, FIG. 49, FIG. 50, FIG. 51, FIG. 52, FIG. 53A, FIG. 53B, FIG. 53C, FIG. 54, FIG. 55. FIG. 56, FIG. 57, FIG. 63, FIG. 64, FIG. 65B, FIG. 66D, FIG. 67, FIG. 68, FIG. 69B, FIG. 70B, and FIG. 70C);

b) When the tea table is functioning as a kennel, capable of acting providing an interchangeable surface to act as a top and/or wall in the directions of arrows 131, 132, and 133 (See FIG. 61B);

c) When the tea table is functioning as a grooming station, capable of providing an interchangeable surface to act as a top and/or wall in the directions of arrows 131, 132, and 133 (See FIG. 62);

d) When the tea table is functioning as a pet drying platform, capable of providing an interchangeable surface to act as a top and/or wall in the directions of arrows 131, 132, and 133 (See FIG. 62);

e) When the tea table is functioning as a storage locker, capable of providing an interchangeable surface to act as a top and/or wall
in the directions of arrows 131, 132, and 133
(See FIG. 61A);

f) When the tea table is functioning as a table, capable of providing an interchangeable surface to act as a top and/or wall
in the directions of arrows 131, 132, and 133
(See FIG. 50, FIG. 51, FIG. 53B, FIG. 53C, FIG. 63, and FIG. 64); and g) When the tea table is functioning as a cooler, capable of providing an interchangeable surface to act as a top and/or wall
in the directions of arrows 131, 132, and 133
(See FIG. 20D).

2) It is another object of the new invention to provide (a or an) five-device-in-one multi-function multi-configurable hitch-mountable rollable rotatable collapsible tea table, having
multi-positionable umbrella-pole-receiving holes 103.
Therefore, the five-device-in-one multi-function multi-configurable hitch-mountable rollable rotatable collapsible tea table is (or are each):

a) Capable of providing multiple options for an umbrella pole to be inserted vertically
(see FIG. 50, FIG. 51, FIG. 52, FIG. 53A, FIG. 53B, FIG. 53C, FIG. 55, FIG. 56, FIG. 57, FIG. 65B, FIG. 66D, FIG. 68, FIG. 69B, FIG. 70B, and FIG. 70C);

b) Capable of providing multiple options for an umbrella pole to be inserted horizontally
(see FIG. 52, FIG. 70B, and FIG. 70C); and c) Capable of providing multiple options for an umbrella pole to be inserted diagonally
(see FIG. 53A, FIG. 65B, and FIG. 69B).

3) It is still another object of the new invention to provide (a or an) five-device-in-one multi-function multi-configurable hitch-mountable rollable rotatable collapsible tea table, having
interchangeable slideable rotatable solid panels 104.
Therefore, the five-device-in-one multi-function multi-configurable hitch-mountable rollable rotatable collapsible tea table is (or are each):

a) When the tea table is functioning as a kennel, capable of providing an interchangeable surface to act as a top and/or wall
in the directions of arrows 131, 132, and 133
(See FIG. 61B);

b) When the tea table is functioning as a grooming station, capable of providing an interchangeable surface to act as a top and/or wall
in the directions of arrows 131, 132, and 133
(See FIG. 62);

c) When the tea table is functioning as a pet drying platform, capable of providing an interchangeable surface to act as a top and/or wall
in the directions of arrows 131, 132, and 133
(See FIG. 62);

d) When the tea table is functioning as a storage locker, capable of providing an interchangeable surface to act as a top and/or wall
in the directions of arrows 131, 132, and 133
(See FIG. 61A);

e) When the tea table is functioning as a table, capable of providing an interchangeable surface to act as a top and/or wall
in the directions of arrows 131, 132, and 133
(See FIG. 50, FIG. 51, FIG. 53B, FIG. 53C, FIG. 63, and FIG. 64); and f) When the tea table is functioning as a cooler, capable of providing an interchangeable surface to act as a top and/or wall
in the directions of arrows 131, 132, and 133
(See FIG. 20D).

4) It is yet still another object of the new invention to provide (a or an) five-device-in-one multi-function multi-configurable hitch-mountable rollable rotatable collapsible tea table, having
interchangeable slideable rotatable breathable ornamental double-sized panels 105.
Therefore, the five-device-in-one multi-function multi-configurable hitch-mountable rollable rotatable collapsible tea table is (or are each):

a) When the tea table is functioning as a kennel, capable of providing an interchangeable surface to act as a top and/or wall
in the directions of arrows 131, 132, and 133
(See FIG. 61B);

b) When the tea table is functioning as a grooming station, capable of providing an interchangeable surface to act as a top and/or wall
in the directions of arrows 131, 132, and 133
(See FIG. 62);

c) When the tea table is functioning as a pet drying platform, capable of providing an interchangeable surface to act as a top and/or wall
in the directions of arrows 131, 132, and 133
(See FIG. 62);

d) When the tea table is functioning as a storage locker, capable of providing an interchangeable surface to act as a top and/or wall
in the directions of arrows 131, 132, and 133
(See FIG. 61A);

e) When the tea table is functioning as a table, capable of providing an interchangeable surface to act as a top and/or wall
in the directions of arrows 131, 132, and 133
(See FIG. 50, FIG. 51, FIG. 53B, FIG. 53C, FIG. 63, and FIG. 64); and f) When the tea table is functioning as a cooler, capable of providing an interchangeable surface to act as a top and/or wall
in the directions of arrows 131, 132, and 133
(See FIG. 20D).

5) It is a further object of the new invention to provide (a or an) five-device-in-one multi-function multi-configurable hitch-mountable rollable rotatable collapsible tea table, having
top-panel-securing support frame 110.
Therefore, the five-device-in-one multi-function multi-configurable hitch-mountable rollable rotatable collapsible tea table is (or are each):

a) When the tea table is functioning as a kennel, capable of providing support for interchangeable multi-positionable slideable rotatable umbrella-pole-receiving panels 102, interchangeable slideable rotatable solid panels 104, and interchangeable slideable rotatable breathable ornamental double-sized panels 105
in the directions of arrows 131, 132, and 133
(See FIG. 61B);

b) When the tea table is functioning as a grooming station, capable of providing support for interchangeable multi-positionable slideable rotatable umbrella-pole-receiving panels 102, interchangeable slideable rotatable solid panels 104, and interchangeable slideable rotatable breathable ornamental double-sized panels 105
in the directions of arrows 131, 132, and 133
(See FIG. 62);

c) When the tea table is functioning as a drying platform, capable of providing support for interchangeable multi-positionable slideable rotatable umbrella-pole-receiving panels 102, interchangeable slideable rotatable solid panels 104, and interchangeable slideable rotatable breathable ornamental double-sized panels 105
in the directions of arrows 131, 132, and 133
(See FIG. 62);

d) When the tea table is functioning as a storage locker, capable of providing support for interchangeable multi-positionable slideable rotatable umbrella-pole-receiving panels 102, interchangeable slideable rotatable solid panels 104, and interchangeable slideable rotatable breathable ornamental double-sized panels 105
in the directions of arrows 131, 132, and 133
(See FIG. 61A);

e) When the tea table is functioning as a table, capable of providing support for interchangeable multi-positionable slideable rotatable umbrella-pole-receiving panels 102, interchangeable slideable rotatable solid panels 104, and interchangeable slideable rotatable breathable ornamental double-sized panels 105
in the directions of arrows 131, 132, and 133
(See FIG. 50, FIG. 51, FIG. 53B, FIG. 53C, FIG. 63, and FIG. 64); and f) When the tea table is functioning as a cooler, capable of providing support for interchangeable multi-positionable slideable rotatable umbrella-pole-receiving panels 102, interchangeable slideable rotatable solid panels 104, and interchangeable slideable rotatable breathable ornamental double-sized panels 105
in the directions of arrows 131, 132, and 133
(See FIG. 20D).

6) It is an even further object of the new invention to provide (a or an) five-device-in-one multi-function multi-configurable hitch-mountable rollable rotatable collapsible tea table, having
side-panel-securing support frame 111.
Therefore, the five-device-in-one multi-function multi-configurable hitch-mountable rollable rotatable collapsible tea table is (or are each):

a) When the tea table is functioning as a kennel, capable of providing support for interchangeable multi-positionable slideable rotatable umbrella-pole-receiving panels 102, interchangeable slideable rotatable solid panels 104, and interchangeable slideable rotatable breathable ornamental double-sized panels 105
(See FIG. 61B);

b) When the tea table is functioning as a grooming station, capable of providing support for interchangeable multi-positionable slideable rotatable umbrella-pole-receiving panels 102, interchangeable slideable rotatable solid panels 104, and interchangeable slideable rotatable breathable ornamental double-sized panels 105
(See FIG. 62);

c) When the tea table is functioning as a drying platform, capable of providing support for interchangeable multi-positionable slideable rotatable umbrella-pole-receiving panels 102, interchangeable slideable rotatable solid panels 104, and interchangeable slideable rotatable breathable ornamental double-sized panels 105
(See FIG. 62);

d) When the tea table is functioning as a storage locker, capable of providing support for interchangeable multi-positionable slideable rotatable umbrella-pole-receiving panels 102, interchangeable slideable rotatable solid panels 104, and interchangeable slideable rotatable breathable ornamental double-sized panels 105
(See FIG. 61A);

e) When the tea table is functioning as a table, capable of providing support for interchangeable multi-positionable slideable rotatable umbrella-pole-receiving panels 102, interchangeable slideable rotatable solid panels 104, and interchangeable slideable rotatable breathable ornamental double-sized panels 105
(See FIG. 50, FIG. 51, FIG. 53B, FIG. 53C, FIG. 63, and FIG. 64); and f) When the tea table is functioning as a cooler, capable of providing support for interchangeable multi-positionable slideable rotatable umbrella-pole-receiving panels 102, interchangeable slideable rotatable solid panels 104, and interchangeable slideable rotatable breathable ornamental double-sized panels 105
(See FIG. 20D).

7) It is still an even further object of the new invention to provide (a or an) five-device-in-one multi-function multi-configurable hitch-mountable rollable rotatable collapsible tea table, having
breathable bottom support frame 112.
Therefore, the five-device-in-one multi-function multi-configurable hitch-mountable rollable rotatable collapsible tea table is (or are each):

a) When used as a kennel, capable of providing structural rigidity to the tea table
(See FIG. 61B);

b) When used as a grooming station, capable of providing structural rigidity to the tea table
(See FIG. 62);

c) When used as a drying platform, capable of providing structural rigidity to the tea table
(See FIG. 62);

d) When used as a storage locker, capable of providing structural rigidity to the tea table
(See FIG. 61A);

e) When used as a table, capable of providing structural rigidity to the tea table
(See FIG. 50, FIG. 51, FIG. 53B, FIG. 53C, FIG. 63, and FIG. 64); and f) When used as a cooler, capable of providing structural rigidity to the tea table
(See FIG. 20D).

8) It is yet still an even further object of the new invention to provide (a or an) five-device-in-one multi-function multi-configurable hitch-mountable rollable rotatable collapsible tea table, having
tow-hitch-attaching fence-post-attaching truck-utility-hole-inserting umbrella-pole-receiver shaft 116.
Therefore, the five-device-in-one multi-function multi-configurable hitch-mountable rollable rotatable collapsible tea table is (or are each):

a) Capable of vertically attaching an umbrella pole for shade and/or privacy
(see FIG. 54 and FIG. 63);

b) Capable of horizontally attaching an umbrella pole to be used for shade and/or privacy (see FIG. 65A and FIG. 68);

c) Capable of slidably attaching to a fence post (see FIG. 69A, FIG. 69B, and FIG. 70B);

d) Capable of slidably attaching to a tow hitch receiver (see FIG. 65B, FIG. 66D, and FIG. 68); and e) Capable of slidably attaching to a utility hole of a pickup truck (see FIG. 70C).

9) It is yet still an even further object of the new invention to provide (a or an) five-device-in-one multi-function multi-configurable hitch-mountable rollable rotatable collapsible tea table, having plastic-coated waterproof-fabric water-tight reinforce-stitched walls 123.

Therefore, the five-device-in-one multi-function multi-configurable hitch-mountable rollable rotatable collapsible tea table is (or are each):

a) Capable of securely holding rocks, sand, and/or water to be a ballast to provide added stability to the tea table (see FIG. 20A, FIG. 20B, FIG. 20C, FIG. 20D, FIG. 71, FIG. 72, FIG. 73, and FIG. 74);

b) Capable of waterproofedly and insulatedly holding ice to function as a cooler (see FIG. 20D and FIG. 74);

c) Capable of securing contents when functioning as a cinch-sack (see FIG. 75); and d) Capable of protecting contents when functioning as a backpack (see FIG. 76).

10) It is yet still an even further object of the new invention to provide (a or an) five-device-in-one multi-function multi-configurable hitch-mountable rollable rotatable collapsible tea table, having cinchable tieable backpack cinch-sack shoulder-strap content-securing cord 125.

Therefore, the five-device-in-one multi-function multi-configurable hitch-mountable rollable rotatable collapsible tea table is (or are each):

a) Capable of cinchably securing contents inside (see FIG. 20A, FIG. 20B, FIG. 20C, FIG. 20D, FIG. 71, FIG. 72, FIG. 73, FIG. 74, FIG. 75, and FIG. 76);

b) Capable of acting as cinching-straps when functioning as cinch-sack (see FIG. 75); and c) Capable of wearably providing shoulder straps when functioning as a backpack (see FIG. 76).

What is claimed is:

1. A five-device-in-one multi-function multi-configurable hitch-mountable rollable rotatable collapsible tea table, capable of functioning as a pet kennel, a storage locker, a table, a cooler, and an umbrella base, comprising:

a top-panel-securing support frame;

a side-panel-securing support frame
having a support-frame bottom,
said side-panel-securing support frame attached to said top-panel-securing support frame;

a breathable bottom support frame
attached to said side-panel-securing support frame;

a plurality of threaded bolt holes
respectively drilled into said top-panel-securing support frame, said side-panel-securing support frame, and said breathable bottom support frame;

a plurality of frame-securing bolts
respectively screwed into said threaded bolt holes;

a plurality of interchangeable multi-positionable slideable rotatable umbrella-pole-receiving panels
respectively slidably inserted into said top-panel-securing support frame or said side-panel-securing support frame
for, when said tea table is functioning as a kennel, providing an interchangeable surface to act as a top or wall,
for, when said tea table is functioning as a grooming station, providing an interchangeable surface to act as a top or wall,
for, when said tea table is functioning as a pet drying platform, providing an interchangeable surface to act as a top or wall,
for, when said tea table is functioning as a storage locker, providing an interchangeable surface to act as a top or wall,
for, when said tea table is functioning as a table, providing an interchangeable surface to act as a top or wall, and
for, when said tea table is functioning as a cooler, providing an interchangeable surface to act as a top or wall;

a plurality of multi-positionable umbrella-pole-receiving holes
respectively drilled into said interchangeable multi-positionable slideable rotatable umbrella-pole-receiving panels
for vertically inserting at least one umbrella pole in multiple different locations through said tea table,
for horizontally inserting at least one umbrella pole in multiple different locations through said tea table, and
for diagonally inserting at least one umbrella pole in multiple different locations through said tea table;

a plurality of interchangeable slideable rotatable solid panels
respectively slidably inserted into said top-panel-securing support frame or said side-panel-securing support frame
for, when said tea table is functioning as a kennel, providing an interchangeable surface to act as a top or wall,
for, when said tea table is functioning as a grooming station, providing an interchangeable surface to act as a top or wall,
for, when said tea table is functioning as a pet drying platform, providing an interchangeable surface to act as a top or wall,
for, when said tea table is functioning as a storage locker, providing an interchangeable surface to act as a top or wall,
for, when said tea table is functioning as a table, providing an interchangeable surface to act as a top or wall, and
for, when said tea table is functioning as a cooler, providing an interchangeable surface to act as a top or wall;

a plurality of interchangeable slideable rotatable breathable ornamental double-sized panels respectively slidably inserted into said top-panel-securing support frame or said side-panel-securing support frame for, when said tea table is functioning as a kennel, providing an interchangeable surface to act as a top or wall, for, when said tea table is functioning as a grooming station, providing an interchangeable surface to act as a top or wall, for, when said tea table is functioning as a pet drying platform, providing an interchangeable surface to act as a top or wall, for, when said tea table is functioning as a storage locker, providing an interchangeable surface to act as a top or wall, for, when said tea table is functioning as a table, providing an interchangeable surface to act as a top or wall, and for, when said tea table is functioning as a cooler, providing an interchangeable surface to act as a top or wall;

a plurality of pole-receiving-hole sheaths respectively inserted into said multi-positionable umbrella-pole-receiving holes;

a plurality of pole-receiving-hole caps respectively inserted into said pole-receiving-hole sheaths;

a plurality of panel-attaching bolts respectively screwed into said threaded bolt holes;

a tow-hitch-attaching fence-post-attaching truck-utility-hole-inserting umbrella-pole-receiver shaft for vertically attaching an umbrella pole for shade or privacy, for horizontally attaching an umbrella pole for shade or privacy, for horizontally mounting a half umbrella directly against a wall, for slidably attaching to a fence post, and for slidably attaching to a tow hitch receiver;

a tow-hitch-attaching fence-post-attaching umbrella-pole-receiver-shaft-securing bracket attached around said tow-hitch-attaching fence-post-attaching truck-utility-hole-inserting umbrella-pole-receiver shaft, screwed to said top-panel-securing support frame, said side-panel-securing support frame, or said breathable bottom support frame;

a plurality of tow-hitch-attaching-fence-post-attaching-umbrella-pole-receiver-shaft-securing-bracket bolts respectively screwed into said threaded bolt holes;

a tow-hitch-attaching fence-post-attaching umbrella-pole-securing hand-screw screwed into said tow-hitch-attaching fence-post-attaching truck-utility-hole-inserting umbrella-pole-receiver shaft;

a pole-receiver-attaching base plate welded to said tow-hitch-attaching fence-post-attaching truck-utility-hole-inserting umbrella-pole-receiver shaft; and a plurality of base-plate-securing bolts respectively screwed through said pole-receiver-attaching base plate into said threaded bolt holes.

2. The five-device-in-one multi-function multi-configurable hitch-mountable rollable rotatable collapsible tea table, capable of functioning as a pet kennel, a storage locker, a table, a cooler, and an umbrella base of claim 1, further comprising:

a plurality of plastic-coated waterproof-fabric water-tight reinforce-stitched walls respectively sewn to each other;

a plurality of plastic-coated waterproof-fabric reinforce-stitched cord tunnels respectively sewn into said plastic-coated waterproof-fabric water-tight reinforce-stitched walls; and a cinchable tieable backpack cinch-sack shoulder-strap content-securing cord inserted into said plastic-coated waterproof-fabric reinforce-stitched cord tunnels, wherein:

said plastic-coated waterproof-fabric water-tight reinforce-stitched walls are each for securely holding rocks, sand, or water to act as a ballast to provide added stability for said tea table, for waterproofedly and insulatedly holding ice to function as a cooler, for securing contents when functioning as a cinch-sack, for protecting contents when functioning as a backpack, said plastic-coated waterproof-fabric reinforce-stitched cord tunnels are each for providing a tunnel where said cinchable tieable backpack cinch-sack shoulder-strap content-securing cord can be cinched to secure contents inside, and said cinchable tieable backpack cinch-sack shoulder-strap content-securing cord is for cinchably securing contents inside said plastic-coated waterproof-fabric water-tight reinforce-stitched walls, for acting as cinching-straps when used as a cinch-sack, and for wearably providing shoulder straps when used as a backpack.

3. The five-device-in-one multi-function multi-configurable hitch-mountable rollable rotatable collapsible tea table, capable of functioning as a pet kennel, a storage locker, a table, a cooler, and an umbrella base of claim 1, further comprising:

a plurality of pivoting locking frame-connecting caster pins respectively lockably inserted into said support-frame bottom of said side-panel-securing support frame; and a plurality of caster wheels respectively rotatably attached to said pivoting locking frame-connecting caster pins, wherein:

said plurality of pivoting locking frame-connecting caster pins each are for rotatably connecting said caster wheels to said side-support frame, and said plurality of caster wheels each are for rollably allowing said tea table to be moved along a ground surface.

4. The five-device-in-one multi-function multi-configurable hitch-mountable rollable rotatable collapsible tea table, capable of functioning as a pet kennel, a storage locker, a table, a cooler, and an umbrella base of claim 1, wherein:

said interchangeable multi-positionable slideable rotatable umbrella-pole-receiving panels are each made of metal or plastic.

5. The five-device-in-one multi-function multi-configurable hitch-mountable rollable rotatable collapsible tea table, capable of functioning as a pet kennel, a storage locker, a table, a cooler, and an umbrella base of claim 1, wherein:

said interchangeable slideable rotatable solid panels are each made of metal or plastic.

6. The five-device-in-one multi-function multi-configurable hitch-mountable rollable rotatable collapsible tea table, capable of functioning as a pet kennel, a storage locker, a table, a cooler, and an umbrella base of claim 1, wherein:

said interchangeable slideable rotatable breathable ornamental double-sized panels is are each made of metal or plastic.

7. The five-device-in-one multi-function multi-configurable hitch-mountable rollable rotatable collapsible tea table, capable of functioning as a pet kennel, a storage locker, a table, a cooler, and an umbrella base of claim 1, wherein:

said tow-hitch-attaching fence-post-attaching truck-utility-hole-inserting umbrella-pole-receiver shaft is formed into a pipe with round cross-sectional shape.

8. The five-device-in-one multi-function multi-configurable hitch-mountable rollable rotatable collapsible tea table, capable of functioning as a pet kennel, a storage locker, a table, a cooler, and an umbrella base of claim 1, wherein:

said interchangeable multi-positionable slideable rotatable umbrella-pole-receiving panels, said interchangeable slideable rotatable solid panels, and said interchangeable slideable rotatable breathable ornamental double-sized panels are each formed into a rectangular shape.

9. The five-device-in-one multi-function multi-configurable hitch-mountable rollable rotatable collapsible tea table, capable of functioning as a pet kennel, a storage locker, a table, a cooler, and an umbrella base of claim 1, wherein:

said pole-receiver-attaching base plate is formed into a rectangular shape.

10. A five-device-in-one tea table, capable of functioning as a pet kennel, a storage locker, a table, a cooler, and an umbrella base, comprising:

a top-support frame;

a side-support frame having a support-frame bottom, said side-support frame attached to said top-support frame;

a bottom-support frame attached to said side-support frame;

a plurality of interchangeable umbrella-pole-receiving panels respectively slidably inserted into said top-support frame or said side-support frame for, when said tea table is functioning as a kennel, providing an interchangeable surface to act as a top or wall, for, when said tea table is functioning as a grooming station, providing an interchangeable surface to act as a top or wall, for, when said tea table is functioning as a pet drying platform, providing an interchangeable surface to act as a top or wall, for, when said tea table is functioning as a storage locker, providing an interchangeable surface to act as a top or wall, for, when said tea table is functioning as a table, providing an interchangeable surface to act as a top or wall, and for, when said tea table is functioning as a cooler, providing an interchangeable surface to act as a top or wall;

a plurality of umbrella-pole-receiving holes respectively drilled into said interchangeable umbrella-pole-receiving panels for vertically inserting at least one umbrella pole in multiple different locations through said tea table, for horizontally inserting at least one umbrella pole in multiple different locations through said tea table, and for diagonally inserting at least one umbrella pole in multiple different locations through said tea table;

a plurality of interchangeable solid panels respectively slidably inserted into said top-support frame or said side-support frame for, when said tea table is functioning as a kennel, providing an interchangeable surface to act as a top or wall, for, when said tea table is functioning as a grooming station, providing an interchangeable surface to act as a top or wall, for, when said tea table is functioning as a pet drying platform, providing an interchangeable surface to act as a top or wall, for, when said tea table is functioning as a storage locker, providing an interchangeable surface to act as a top or wall, for, when said tea table is functioning as a table, providing an interchangeable surface to act as a top or wall, and for, when said tea table is functioning as a cooler, providing an interchangeable surface to act as a top or wall;

a plurality of interchangeable double-sized panels respectively slidably inserted into said top-support frame or said side-support frame for, when said tea table is functioning as a kennel, providing an interchangeable surface to act as a top or wall, for, when said tea table is functioning as a grooming station, providing an interchangeable surface to act as a top or wall, for, when said tea table is functioning as a pet drying platform, providing an interchangeable surface to act as a top or wall, for, when said tea table is functioning as a storage locker, providing an interchangeable surface to act as a top or wall, for, when said tea table is functioning as a table, providing an interchangeable surface to act as a top or wall, and for, when said tea table is functioning as a cooler, providing an interchangeable surface to act as a top or wall;

an umbrella-pole-receiver shaft for vertically attaching an umbrella pole for shade or privacy, for horizontally attaching an umbrella pole for shade or privacy,
for horizontally mounting a half umbrella directly against a wall,
for slidably attaching to a fence post, and
for slidably attaching to a tow hitch receiver;
an umbrella-pole-receiver-shaft-securing bracket
attached around said umbrella-pole-receiver shaft, screwed to said top-support frame, said side-support frame, or said bottom-support frame;
an umbrella-pole-securing hand-screw
screwed into said umbrella-pole-receiver shaft; and
an umbrella-pole-receiver-shaft-attaching base-plate
welded to said umbrella-pole-receiver shaft.

11. The five-device-in-one tea table, capable of functioning as a pet kennel, a storage locker, a table, a cooler, and an umbrella base of claim 10,
further comprising:
a plurality of waterproof-fabric walls
respectively sewn to each other;
a plurality of reinforce-stitched cord tunnels
respectively sewn into said waterproof-fabric walls; and
a cinchable securing cord
inserted into said reinforce-stitched cord tunnels,
wherein:
said waterproof-fabric walls are each
for securely holding rocks, sand, or water to act as a ballast to provide added stability for said tea table,
for waterproofingly and insulatedly holding ice to function as a cooler,
for securing contents when functioning as a cinch-sack,
for protecting contents when functioning as a backpack,
said reinforce-stitched cord tunnels are each
for providing a tunnel where said cinchable securing cord can be cinched to secure contents inside, and
said cinchable securing cord is
for cinchably securing contents inside said waterproof-fabric walls,
for acting as cinching-straps when used as a cinch-sack, and
for wearably providing shoulder straps when used as a backpack.

12. The five-device-in-one tea table, capable of functioning as a pet kennel, a storage locker, a table, a cooler, and an umbrella base of claim 10,
further comprising:
a plurality of pivoting caster pins
respectively lockably inserted into said support-frame bottom of said side-support frame; and
a plurality of caster wheels
respectively rotatably attached to said pivoting caster pins,
wherein:
said pivoting caster pins each are
for rotatably connecting said caster wheels to said side-support frame, and
said caster wheels each are
for rollably allowing said tea table to be moved along a ground surface.

13. The five-device-in-one tea table, capable of functioning as a pet kennel, a storage locker, a table, a cooler, and an umbrella base of claim 10,
wherein:
said interchangeable umbrella-pole-receiving panels are each made of metal or plastic.

14. The five-device-in-one tea table, capable of functioning as a pet kennel, a storage locker, a table, a cooler, and an umbrella base of claim 10,
wherein:
said interchangeable solid panels are each made of metal or plastic.

15. The five-device-in-one tea table, capable of functioning as a pet kennel, a storage locker, a table, a cooler, and an umbrella base of claim 10,
wherein:
said interchangeable double-sized panels is are each made of metal or plastic.

16. The five-device-in-one tea table, capable of functioning as a pet kennel, a storage locker, a table, a cooler, and an umbrella base of claim 10,
wherein:
said umbrella-pole-receiver shaft is formed into a pipe with round cross-sectional shape.

17. The five-device-in-one tea table, capable of functioning as a pet kennel, a storage locker, a table, a cooler, and an umbrella base of claim 10,
wherein:
said interchangeable umbrella-pole-receiving panels,
said interchangeable solid panels, and
said interchangeable double-sized panels are each formed into a rectangular shape.

18. The five-device-in-one tea table, capable of functioning as a pet kennel, a storage locker, a table, a cooler, and an umbrella base of claim 10,
wherein:
said umbrella-pole-receiver-shaft-attaching base-plate is formed into a rectangular shape.

19. A five-device-in-one tea table, comprising:
a top frame;
a side frame
attached to said top frame;
a bottom frame
attached to said side frame;
a plurality of pole-receiving panels
respectively slidably inserted into said top frame or said side frame
for, when said tea table is functioning as a kennel, providing an interchangeable surface to act as a top or wall,
for, when said tea table is functioning as a grooming station, providing an interchangeable surface to act as a top or wall,
for, when said tea table is functioning as a pet drying platform, providing an interchangeable surface to act as a top or wall,
for, when said tea table is functioning as a storage locker, providing an interchangeable surface to act as a top or wall,
for, when said tea table is functioning as a table, providing an interchangeable surface to act as a top or wall, and
for, when said tea table is functioning as a cooler, providing an interchangeable surface to act as a top or wall;
a plurality of pole-receiving holes
respectively drilled into said pole-receiving panels
for vertically inserting at least one umbrella pole in multiple different locations through said tea table, for horizontally inserting at least one umbrella pole in multiple different locations through said tea table, and for diagonally inserting at least one umbrella pole in multiple different locations through said tea table;

a plurality of solid panels respectively slidably inserted into said top frame or said side frame for, when said tea table is functioning as a kennel, providing an interchangeable surface to act as a top or wall, for, when said tea table is functioning as a grooming station, providing an interchangeable surface to act as a top or wall, for, when said tea table is functioning as a pet drying platform, providing an interchangeable surface to act as a top or wall, for, when said tea table is functioning as a storage locker, providing an interchangeable surface to act as a top or wall, for, when said tea table is functioning as a table, providing an interchangeable surface to act as a top or wall, and for, when said tea table is functioning as a cooler, providing an interchangeable surface to act as a top or wall;

a plurality of double-sized panels respectively slidably inserted into said top frame or said side frame for, when said tea table is functioning as a kennel, providing an interchangeable surface to act as a top or wall, for, when said tea table is functioning as a grooming station, providing an interchangeable surface to act as a top or wall, for, when said tea table is functioning as a pet drying platform, providing an interchangeable surface to act as a top or wall, for, when said tea table is functioning as a storage locker, providing an interchangeable surface to act as a top or wall, for, when said tea table is functioning as a table, providing an interchangeable surface to act as a top or wall, and for, when said tea table is functioning as a cooler, providing an interchangeable surface to act as a top or wall;

a pole-receiver-shaft for vertically attaching an umbrella pole for shade or privacy, for horizontally attaching an umbrella pole for shade or privacy, for horizontally mounting a half umbrella directly against a wall, for slidably attaching to a fence post, and for slidably attaching to a tow hitch receiver;

a pole-receiver-shaft bracket attached around said pole-receiver shaft, screwed to said top frame, said side frame, or said bottom frame; and a pole-receiver-shaft base-plate welded to said pole-receiver shaft.

20. The five-device-in-one tea table of claim 19, further comprising:

a plurality of fabric walls respectively sewn to each other;

a plurality of cord tunnels respectively sewn into said fabric walls; and a securing cord inserted into said cord tunnels, wherein:

said fabric walls are each for securely holding rocks, sand, or water to act as a ballast to provide added stability for said tea table, for waterproofingly and insulatedly holding ice to function as a cooler, for securing contents when functioning as a cinch-sack, for protecting contents when functioning as a back-pack;

said cord tunnels are each for providing a tunnel where said securing cord can be cinched to secure contents inside, and said securing cord is for cinchably securing contents inside said fabric walls, for acting as cinching-straps when used as a cinch-sack, and for wearably providing shoulder straps when used as a backpack.

* * * * *